US011181864B2

(12) United States Patent
Okamura et al.

(10) Patent No.: US 11,181,864 B2
(45) Date of Patent: Nov. 23, 2021

(54) TIMEPIECE WITH INCREASED INFORMATION VIEW ABILITY

(71) Applicant: CITIZEN WATCH CO., LTD., Nishitokyo (JP)

(72) Inventors: Naoaki Okamura, Kokubunji (JP); Akihiko Kuroda, Tokorozawa (JP)

(73) Assignee: CITIZEN WATCH CO., LTD., Tokyo (JP)

( * ) Notice: Subject to any disclaimer, the term of this patent is extended or adjusted under 35 U.S.C. 154(b) by 184 days.

(21) Appl. No.: 16/571,512

(22) Filed: Sep. 16, 2019

(65) Prior Publication Data

US 2020/0103828 A1 Apr. 2, 2020

(30) Foreign Application Priority Data

Sep. 27, 2018 (JP) ..... JP2018-182955
Oct. 4, 2018 (JP) ..... JP2018-189338
Oct. 15, 2018 (JP) ..... JP2018-194161

(51) Int. Cl.

*G04B 19/04* (2006.01)
*G04G 21/02* (2010.01)
*G04C 10/02* (2006.01)
*G04C 10/04* (2006.01)

(52) U.S. Cl.

CPC ..... *G04B 19/042* (2013.01); *G04C 10/02* (2013.01); *G04C 10/04* (2013.01); *G04G 21/02* (2013.01)

(58) Field of Classification Search

CPC ..... G04B 19/042; G04C 10/04; G04C 3/146; G04C 10/02; G04G 21/02; G04G 21/04

USPC ..... 368/80

See application file for complete search history.

(56) References Cited

U.S. PATENT DOCUMENTS 2,251,021 A * 7/1941 Nebergall ..... G04B 19/04 368/21
5,204,846 A * 4/1993 Brahaney ..... G04B 19/04 368/223
8,400,883 B2 * 3/2013 Lin ..... G04C 17/0091 368/228
2016/0223991 A1 8/2016 Kojima et al.

FOREIGN PATENT DOCUMENTS

JP 59-116077 A 7/1984
JP 60-37817 U 3/1985
JP 03-18722 A 1/1991
JP 07-191153 A 7/1995
JP 2013-57519 A 3/2013
JP 2016-142545 A 8/2016

* cited by examiner

*Primary Examiner* — Edwin A. Leon
(74) *Attorney, Agent, or Firm* — Foley & Lardner LLP

(57) ABSTRACT

In a timepiece, moments of inertia of a first pointer and a second pointer that are for displaying first information and second information, respectively and that have a same rotation axis are the same. As a result, parts having identical specifications may be used in a drive mechanism of the first pointer and a drive mechanism of the second pointer. Further, color schemes of the first pointer and second pointer differ. As a result, a user may easily distinguish the first pointer and the second pointer.

20 Claims, 26 Drawing Sheets

TIMEPIECE WITH INCREASED INFORMATION VIEW ABILITY

CROSS REFERENCE TO RELATED APPLICATIONS

This application is based upon and claims the benefit of priority of the prior Japanese Patent Application No. 2018-182955 filed on Sep. 27, 2018, the prior Japanese Patent Application No. 2018-189338 filed on Oct. 4, 2018, and the prior Japanese Patent Application No. 2018-194161 filed on Oct. 15, 2018, the entire contents of which are incorporated herein by reference.

BACKGROUND OF THE INVENTION

1. Field of the Invention

Embodiments of the invention relate to a timepiece.

2. Description of the Related Art

Conventionally, for example, clocks having multiple pointers that rotate around a single rotation axis such as an hour hand, a minute hand, and a second hand are known. Further, a clock that displays weather forecast information and barometric pressure information using the hour hand and the minute hand, which are for displaying the current time is known (for example, refer to Japanese Laid-Open Patent Publication No. H07-191153). An instrument having a single pointer in which a portion pointing to main indices and a portion pointing to auxiliary indices are separated by color is further known (for example, refer to Japanese Utility Model Publication No. S60-37817). A configuration in which a pointer is driven with a tip of the pointer being fixed to an outer peripheral wheel provided at an outer rim of a clock is also known (for example, refer to Japanese Laid-Open Patent Publication No. 2013-057519).

Further, conventionally, in a timepiece, a configuration is known in which a measured value of a physical quantity such as remaining battery level is displayed by a pointer. Further, in tachymeters, pressure gauges, and other display devices having indices that indicate a quantity, a configuration is known in which the indices are shown aligned in increasing order of length (for example, refer to Japanese Laid-Open Patent Publication No. H3-18722. Further, an analog timepiece is known in which a crescent-shaped index is shown as a power indicator of a secondary battery (for example, refer to Japanese Laid-Open Patent Publication No. 2016-142545).

Further, conventionally, a timepiece is known in which the contents of information displayed by a pointer and operation modes such as turning a specified function ON/OFF may be switched by user operation. A timepiece having multiple operation buttons such as a crown, a push button, etc. operated by a user is further known. A further configuration is known in which an operation button for changing display contents of a display unit that uses a pointer, is disposed near the display unit (for example, refer to Japanese Laid-Open Patent Publication No. 859-116077).

SUMMARY OF THE INVENTION

According to an embodiment of the invention, a timepiece includes a first pointer that rotates around a rotation axis; a second pointer that rotates around the rotation axis and has a moment of inertia that is a same as a moment of inertia of the first pointer, the second pointer having a color scheme that is different from a color scheme of the first pointer; and a controller that displays first information by controlling rotation of the first pointer and displays second information different from the first information, by controlling rotation of the second pointer.

Objects, features, and advantages of the present invention are specifically set forth in or will become apparent from the following detailed description of the invention when read in conjunction with the accompanying drawings.

DETAILED DESCRIPTION OF THE INVENTION

First, problems associated with the conventional techniques are discussed. With the conventional techniques, it is difficult to suppress decreases in the ease of viewing information in the timepiece.

Embodiments of a timepiece according to the present invention will be described in detail with reference to the accompanying drawings.

Figure 1:
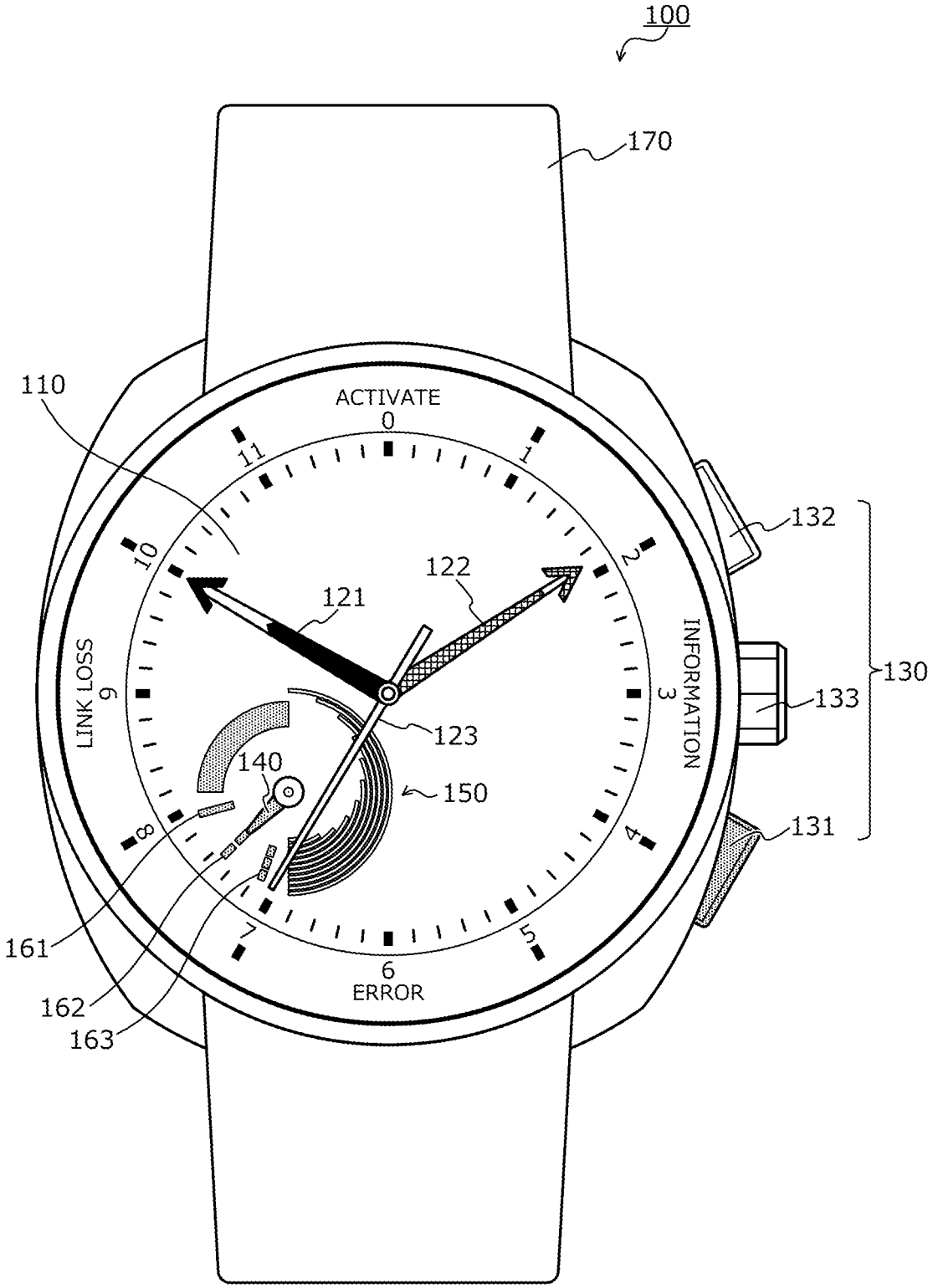
FIG. 1 is a diagram depicting an example of an external appearance of a timepiece according to a first embodiment.

FIG. 1 is a diagram depicting an example of an external appearance of a timepiece according to a first embodiment. As depicted in FIG. 1, a timepiece 100 according to the first embodiment includes a dial (display face) 110, a first pointer 121, a second pointer 122, a second hand 123, and a sub-pointer 140 in a body that is a housing (case). The first pointer 121, the second pointer 122, and the second hand 123 are pointers that rotate on the dial 110 and display a current time by pointing to indices or time (for example, "0", "1", "2", "3", "4", etc.) shown on the dial 110.

The current time is an internal time of the timepiece 100, counted in the timepiece 100. The current time, for example, may be set by an operation by a user. Alternatively, the current time may be set according to a reception result of a reference radio wave or Global Positioning System (GPS) signal.

While lengths of the first pointer 121 and the second pointer 122 are the same (moment of inertia is the same for each), an hour hand and a minute hand are respectively drawn on each, enabling use as an hour hand and a minute hand by the user. This point will be discussed hereinafter (refer to FIG. 2).

An example of first information displayed by controlling rotation of the first pointer 121 is the hour of the current time. In other words, the timepiece 100 displays the current hour to the user by controlling the rotation of the first pointer 121 so that a pointing direction of the first pointer 121 is a direction corresponding to the current hour.

An example of second information displayed by controlling rotation of the second pointer 122 is the minute of the current time. In other words, the timepiece 100 displays the current minute to the user by controlling the rotation of the second pointer 122 so that a pointing direction of the second pointer 122 is a direction corresponding the current minute.

The sub-pointer 140, by pointing to a position of any one of indices 150 shown on the dial 110, displays a measurement result obtained by measurement in the timepiece 100. For example, the indices 150 indicate a remaining battery level of the timepiece 100, and the sub-pointer 140 displays a measured value of the remaining battery level of the timepiece 100 by pointing to the indices 150.

Further, the sub-pointer 140 displays an operation mode of the timepiece 100 by pointing to any one of mode marks 161, 162, 163 shown on the dial 110. For example, the mode marks 161 to 163 correspond to different operation modes of the timepiece 100, respectively, and the sub-pointer 140 points to a mode mark that of the mode marks 161 to 163, corresponds to a current operation mode of the timepiece 100. An example of the operation modes will be described hereinafter.

Further, the timepiece 100 includes as operation buttons 130 that are operated by the user of the timepiece 100 (receive a user operation), a first push-button 131, a second push-button 132, and a crown 133 at a side surface of the body. In the example depicted in FIG. 1, the first push-button 131 is disposed near a 4-hour index, the second push-button 132 is disposed near a 2-hour index, and the crown 133 is disposed near a 3-hour index.

A crystal formed using a transparent material such as a glass is attached to the body of the timepiece 100 so as to cover the dial 110. Further, a case back is attached to the body of the timepiece 100, on a side of the body, opposite that where the crystal is attached. Hereinafter, in the timepiece 100, a side toward (direction opposite viewing direction in FIG. 1) the disposed crystal is called a front side, and in the timepiece 100, a side toward the disposed case back (viewing direction in FIG. 1) is called a rear side. A strap 170 is attached to the body of the timepiece 100 so that the timepiece 100 is portable by the user of the timepiece 100 wrapping the strap 170 around his/her wrist.

The timepiece 100 may be a solar-powered timepiece powered by light energy. For example, a solar cell is disposed at a rear side of the dial 110, and power is generated in the solar cell by light entering from a front side thereof. Therefore, the dial 110 is formed using a material that transmits light to a certain extent. The power generated by the solar cell accumulates in a secondary battery (for example, a secondary battery 512 depicted in FIG. 5), and the power accumulated in the secondary battery is used as a power source of the timepiece 100. The secondary battery, for example, may be realized by a lithium-ion battery or the like. The sub-pointer 140 and the indices 150 described above, for example, display a remaining level of the secondary battery.

The first pointer 121, the second pointer 122, and the second hand 123 may each be used to also display information different from the current time. For example, the timepiece 100, in a time display mode (first state), the hour, the minute, and the second of the current time are displayed by the first pointer 121, the second pointer 122, and the second hand 123, respectively.

Further, the timepiece 100, in an information display mode (second state) different from the time display mode, may display third information other than the time by the first pointer 121, and fourth information other than the time and different from the third information by the second pointer 122. Here, the timepiece 100 may display the second of the current time by the second hand 123 and may display other information by the second hand 123.

In the information display mode, the displayed third information and fourth information, for example, may each be a measurement result obtained by measurement in the timepiece 100, or may be information received by the timepiece 100 from an external communications device. As an example, a measurement result of cardinal direction by the timepiece 100 may be set as the third information and a measurement result of altitude by the timepiece 100 may be set as the fourth information.

In this case, for example, the timepiece 100, in the information display mode, uses the first pointer 121 to point to a certain cardinal direction (for example, north) identified based on measurement of the cardinal direction, whereby the measurement result of the cardinal direction is displayed. The measurement of the cardinal direction may be performed using a magnetic sensor and an acceleration sensor provided in the timepiece 100.

Further, the timepiece 100, in the information display mode, displays a measurement result of altitude by the second pointer 122. A measurement of the altitude may be performed using an altitude sensor of a GPS unit or the like provided in the timepiece 100. For example, in the timepiece 100, each altitude obtained by measurement and a minute displayed by the second pointer 122 are assumed to be associated by a predetermined rule. In this case, the timepiece 100 uses the second pointer 122 to point to a direction of a minute corresponding to a measurement result of the altitude.

However, the third information and the fourth information are not limited to cardinal direction and altitude, and may be set as various types of information. For example, the third information and the fourth information may each be information of humidity, temperature, etc. measured in the timepiece 100. Further, the third information and the fourth information may be set as information received from an external communications device by the timepiece 100, such as weather information like a weather forecast, and user schedule information registered in an external communications device.

The information display mode described above, for example, is included among the operation modes that correspond to the mode marks 161 to 163. For example, the information display mode displaying the third information and the fourth information described above corresponds to the mode mark 163. In this case, in the information display mode displaying the third information and the fourth information described above, the timepiece 100, using the sub-pointer 140, points to the mode mark 163. As a result, the user may understand that the timepiece 100 is in the information display mode.

Further, in the time display mode described above, for example, the timepiece 100, using the sub-pointer 140, points to a portion that corresponds to a measured value of the remaining battery level of the indices 150 and thereby, displays that the operation mode of the timepiece 100 is the time display mode and displays the measured value of the remaining battery level of the timepiece 100. Alternatively, the time display mode described above may be included among the operation modes that correspond to the mode marks 161 to 163. For example, the time display mode described above may correspond to the mode mark 161, and the timepiece 100, in the time display mode described above, may use the sub-pointer 140 to point to the mode mark 161.

Switching of the described operations modes in the timepiece 100, for example, is performed according to user operation with respect to the operation buttons 130. As one example, switching of the operation modes including the time display mode and the information display mode described above is allocated to the first push-button 131, and each time the first push-button 131 is pressed, the operation mode of the timepiece 100 is switched.

A color of the first push-button 131 is identical or similar to a color of the sub-pointer 140 and/or colors of the mode mark 161, the mode mark 162, and the mode mark 163 in the dial 110. As one example, the first push-button 131, the sub-pointer 140, the mode mark 161, the mode mark 162, and the mode mark 163 may each be yellow. Further, the second push-button 132, the crown 133, and a portion in the dial 110 where the mode mark 161, the mode mark 162, and the mode mark 163 are not shown are a color (for example, black) different from yellow. As a result, the user may easily (intuitively) know that of the operation buttons 130, the first push-button 131 is the operation button for switching the operation mode of the timepiece 100 displayed by the sub-pointer 140, etc.

The external appearance of the timepiece 100 depicted in FIG. 1 is one example and the external appearance of the timepiece 100 is not limited hereto. For example, the body may be square instead of round, and the presence/absence, quantity, arrangement, shape, etc. of the crown 133 and the like may be arbitrarily changed. Alternatively, a date display unit and/or a pointer for displaying various types of information such as day, daylight savings time, radio wave reception state, etc. may be added. Further, while description is given regarding a configuration in which the timepiece 100 is a wristwatch, the timepiece 100 is not limited to such a configuration. For example, the timepiece 100 may be a clock such as a pocket watch, a table clock, a wall clock, etc.

Figure 2:
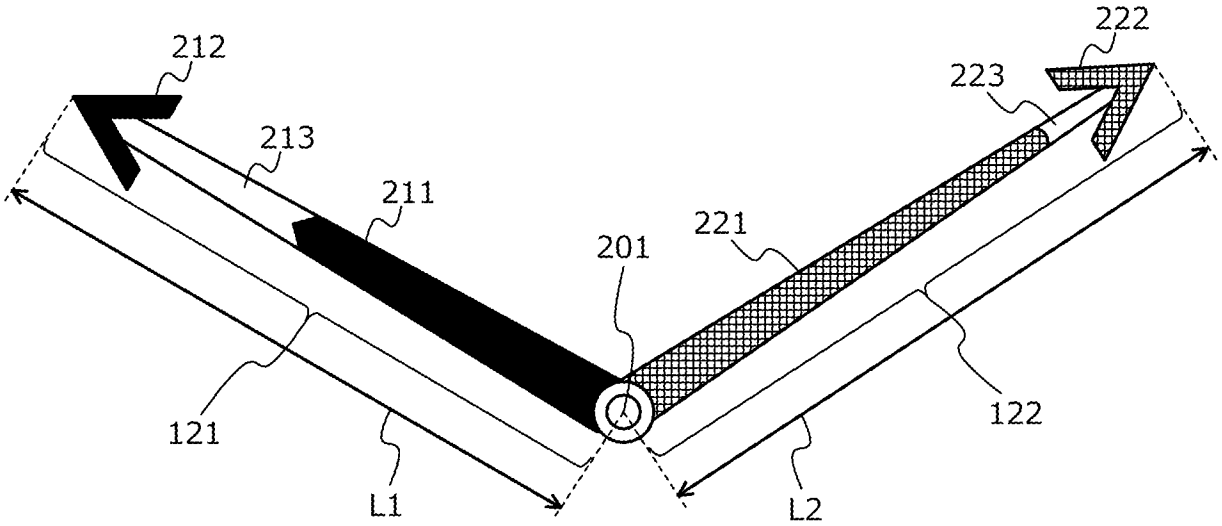
FIG. 2 is a diagram depicting an example of a first pointer and a second pointer of the timepiece according to the first embodiment.

FIG. 2 is a diagram depicting an example of the first pointer and second pointer of the timepiece according to the first embodiment. The first pointer 121 and the second pointer 122 depicted in FIG. 1 will be described. A rotation axis 201 depicted in FIG. 2 is a rotation axis of the first pointer 121 and the second pointer 122, i.e., the second pointer 122 rotates around a rotation axis (the rotation axis 201) that is a rotation axis of the first pointer 121. In other words, the first pointer 121 and the second pointer 122 have a common rotation center.

The first pointer 121 has an arrow shape that originates at the rotation axis 201. In particular, the first pointer 121 is configured by a tapered portion that becomes thinner with increasing distance from the rotation axis 201 and an arrowhead shaped portion provided at a tip (end opposite from the rotation axis 201) of the tapered portion.

The second pointer 122, similarly to the first pointer 121, has an arrow shape that originates at the rotation axis 201. In particular, the second pointer 122 is configured by a tapered portion that becomes thinner with increasing distance from the rotation axis 201 and an arrowhead shaped portion provided at a tip (end opposite from the rotation axis 201) of the tapered portion.

As described above, the first pointer 121 and the second pointer 122 mutually have a same moment of inertia. The moment of inertia of the first pointer 121 and the moment of inertia of the second pointer 122 being the same, for example, means that the moment of inertia of the first pointer 121 and the moment of inertia of the second pointer 122 are close to an extent that parts having the same specifications may be used for a drive mechanism of the first pointer 121 and a drive mechanism of the second pointer 122.

For example, materials and shapes (including size and length) are set to be the same for the first pointer 121 and the second pointer 122, whereby the moment of inertia of the first pointer 121 and the moment of inertia of the second pointer 122 are the same. However, for example, configuration is not limited to the shapes of the first pointer 121 and the second pointer 122 being the same and, for example, even when thicknesses of the first pointer 121 and the second pointer 122 differ, by adjusting masses and centers of gravity of the first pointer 121 and the second pointer 122, the moment of inertia of the first pointer 121 and the moment of inertia of the second pointer 122 may be set to be the same. For example, the first pointer 121 and the second pointer 122 have a thin, long shape and therefore, by setting lengths in longitudinal directions of the first pointer 121 and the second pointer 122 to be the same, the moment of inertia of the first pointer 121 and the moment of inertia of the second pointer 122 may be set to be the same.

The moment of inertia of the first pointer. 121 and the moment of inertia of the second pointer 122 are the same, whereby power necessary for driving the first pointer 121 and for driving the second pointer 122 are the same. As a result, parts having the same specifications may be used for the drive mechanism of the first pointer 121 and the drive mechanism of the second pointer 122. Therefore, the number of types of parts in the timepiece 100 is reduced, enabling manufacturing cost to be reduced. This point will be discussed hereinafter (for example, refer to FIGS. 3 and 4).

The moment of inertia of a pointer such as the first pointer 121 and the second pointer 122 is dependent on the length of the pointer. Therefore, the first pointer 121 and the second pointer 122 having the same moment of inertia also have the same length. The length of the pointer is the length of the pointer in the longitudinal direction and, for example, is the length from the rotation axis of the pointer to the tip (end in direction in which the pointer points) of the pointer.

The length of the first pointer 121 and the length of the second pointer 122 being the same, for example, means that the length of the first pointer 121 and the length of the second pointer 122 are close to an extent that distinguishing the first pointer 121 and the second pointer 122 by the lengths of the first pointer 121 and the second pointer 122 is difficult for the user. In the example depicted in FIG. 2, a distance L1 from the rotation axis 201 to the tip of the first pointer 121 and a distance L2 from the rotation axis 201 to the tip of the second pointer 122 are the same (L1=L2).

Normally, the user distinguishes the hour hand and the minute hand mainly by length and therefore, when the first pointer 121 and the second pointer 122 have the same length, distinguishing the first pointer 121 and the second pointer 122 is difficult for the user, and grasping the current time is difficult. Thus, in the timepiece 100, color schemes of the first pointer 121 and the second pointer 122 differ from each other, whereby the first pointer 121 and the second pointer 122 are easily distinguished from each other. The color scheme, for example, is a color combination or arrangement in a portion visible by the user.

In particular, an hour hand 211 that extends from the rotation axis 201 and that is shorter than the first pointer 121 is drawn at a portion (for example, a front surface of the first pointer 121) of the first pointer 121 visible by the user. Drawing of a pointer such as the hour hand 211, for example, is implementation of a color scheme by adding color so that a color border outlines a shape of the pointer.

For example, in the tapered portion of the first pointer 121, the hour hand 211 is drawn by coloring a portion toward the rotation axis 201 a color different from a color of the material of the first pointer 121 and a color of the dial 110. As one example, when the color of the material of the first pointer 121 is black and the color of the dial 110 is also black, the color of the hour hand 211 may be red. The hour hand 211 drawn on the first pointer 121 rotates around the rotation axis 201 by the rotation of the first pointer 121.

At a portion (for example, a front surface of the second pointer 122) of the second pointer 122 visible by the user, a minute hand 221 that extends from the rotation axis 201 and that is longer than the hour hand 211 described above and shorter than the second pointer 122 is drawn. In the tapered portion of the second pointer 122, the minute hand 221 is drawn by coloring a portion that is toward the rotation axis 201 and that is longer than the portion of the hour hand 211 a color different from a color of a material of the second pointer 122 and a color of the dial 110. As one example, when the color of the material of the second pointer 122 is black and the color of the dial 110 is also black, the color of the minute hand 221 may be blue. The minute hand 221 drawn on the second pointer 122 rotates around the rotation axis 201 by the rotation of the second pointer 122.

As described above, the minute hand 221 drawn on the second pointer 122 is longer than the hour hand 211 drawn on the first pointer 121. As a result, even when the lengths of the first pointer 121 and the second pointer 122 are the same, the first pointer 121 and the second pointer 122 are easily distinguished from each other by the user. Therefore, the user may easily know that the pointing direction of the first pointer 121 indicates the hour of the current time and the pointing direction of the second pointer 122 indicates the minute of the current time.

In this manner, the moment of inertia of the first pointer 121 and the moment of inertia of the second pointer 122 are set to be the same, whereby the number of types of parts in the timepiece 100 is reduced, enabling the manufacturing cost to be reduced. Further, color schemes of the first pointer 121 and the second pointer 122 differ, whereby difficulty in distinguishing the first pointer 121 and the second pointer 122 by the user is prevented. In particular, the hour hand 211 is drawn on the first pointer 121 and the minute hand 221 is drawn on the second pointer 122, thereby enabling the user to know that the first pointer 121 and the second pointer 122 are the hour hand and the minute hand, respectively.

Further, the hour hand 211 and the minute hand 221 are drawn in respectively different colors (for example, red and blue), whereby the user easily distinguishes the first pointer 121 and the second pointer 122. Nonetheless, the hour hand 211 and the minute hand 221 may be drawn in the same color. In this case as well, color arrangement (for example, length) for the hour hand 211 and the minute hand 221 differs, thereby enabling the user to easily distinguish the first pointer 121 and the second pointer 122 from each other.

The arrowhead shaped portion of the first pointer 121 and described above is a first pointing portion 212 for displaying the third information that is information other than the time and described above. In the example depicted in FIG. 2, while the first pointing portion 212 is colored with the same color (for example, red) as that of the hour hand 211, the first pointing portion 212 may be colored with a color different from that of the hour hand 211, or the first pointing portion 212 may have no coloring.

The arrowhead shaped portion of the second pointer 122 and described above, is a second pointing portion 222 for displaying the fourth information that is information other than the time, different from the third information, and described above. In the example depicted in FIG. 2, while the second pointing portion 222 is colored with the same color (for example, blue) as that of the minute hand 221, the second pointing portion 222 may be colored with a color different from that of the minute hand 221, or the second pointing portion 222 may have no coloring.

The timepiece 100, in the information display mode of displaying the third information and the fourth information described above, displays the third information by the first pointing portion 212 by controlling the rotation of the first pointer 121 and displays the fourth information by the second pointing portion 222 by controlling the rotation of the second pointer 122. In this state, the user knows the third information by the pointing direction of the first pointing portion 212 and knows the fourth information by the pointing direction of the second pointing portion 222.

As described above, the lengths of the first pointer 121 and the second pointer 122 are the same. Further, the first pointing portion 212 and the second pointing portion 222 are respectively disposed at the tips of the first pointer 121 and the second pointer 122. Therefore, the first pointing portion 212 and the second pointing portion 222 move on a same circumference centered on the shared rotation axis 201.

In other words, according to the timepiece 100, the hour hand 211 and the minute hand 221 that are easily distinguished by mutually differing lengths and the first pointing portion 212 and the second pointing portion 222 that are visually attractive by moving on the same circumference may be realized by the first pointer 121 and the second pointer 122. Therefore, as described above, the manufacturing cost of the timepiece 100 is reduced and the quality of the external appearance of the timepiece 100 may be enhanced.

In the first pointer 121, in an intermediate portion 213 (region where the hour hand 211 and the first pointing portion 212 are not drawn) between the hour hand 211 and the first pointing portion 212, a portion visible by the user is colored with a color (for example, black) that is a color of a portion of the dial 110 visible by the user. In the intermediate portion 213, a portion visible by the user, for example, is a front surface of the intermediate portion 213. The portion in the dial 110 visible by the user is a portion of the dial 110 visible by the user through the crystal described above and in particular, is a front surface of the dial 110. As a result, for the user, the intermediate portion 213 appears integrated with the dial 110 and therefore, the user naturally recognizes the hour hand 211 drawn on the first pointer 121 as the hour hand. Therefore, as described above, the manufacturing cost of the timepiece 100 is reduced and the quality of the external appearance of the timepiece 100 may be enhanced.

Similarly, in the second pointer 122, in an intermediate portion 223 (region where the minute hand 221 and the second pointing portion 222 are not drawn) between the minute hand 221 and the second pointing portion 222, a portion visible by the user is colored with a color (for example, black) that is the color of the portion of the dial 110 visible by the user. In the intermediate portion 223, the portion visible by the user, for example, is a front surface of the intermediate portion 223. As a result, for the user, the intermediate portion 223 appears integrated with the dial 110 and therefore, the user naturally recognizes the minute hand 221 drawn on the second pointer 122 as the minute hand. Therefore, as described above, the manufacturing cost of the timepiece 100 is reduced and the quality of the external appearance of the timepiece 100 may be enhanced.

Further, the intermediate portions 213, 223 may each be transparent. As a result, similarly to when the intermediate portions 213, 223 are the same color as that of the dial 110, for the user, the intermediate portions 213, 223 appear integrated with the dial 110. Further, by the intermediate portions 213, 223 being transparent, a state in which characters, symbols, etc. displayed on the dial 110 are blocked by the intermediate portions 213, 223 and cannot be viewed by the user may be avoided.

Nonetheless, configuration is not limited to all of the intermediate portion 213 being transparent or the same color as that of the dial 110. In other words, configuration may be such that a portion of the intermediate portion 213 is not transparent or the same color as that of the dial 110. Similarly, configuration is not limited to all of the intermediate portion 223 being transparent or the same color as that of the dial 110. In other words, configuration may be such that a portion of the intermediate portion 223 is not transparent or the same color as that of the dial 110.

The colors of the parts of the first pointer 121 and the second pointer 122 described above may be colors realized by coloring the parts, or may be actual colors of the materials (for example, metals, resins) of the parts.

Figure 3:
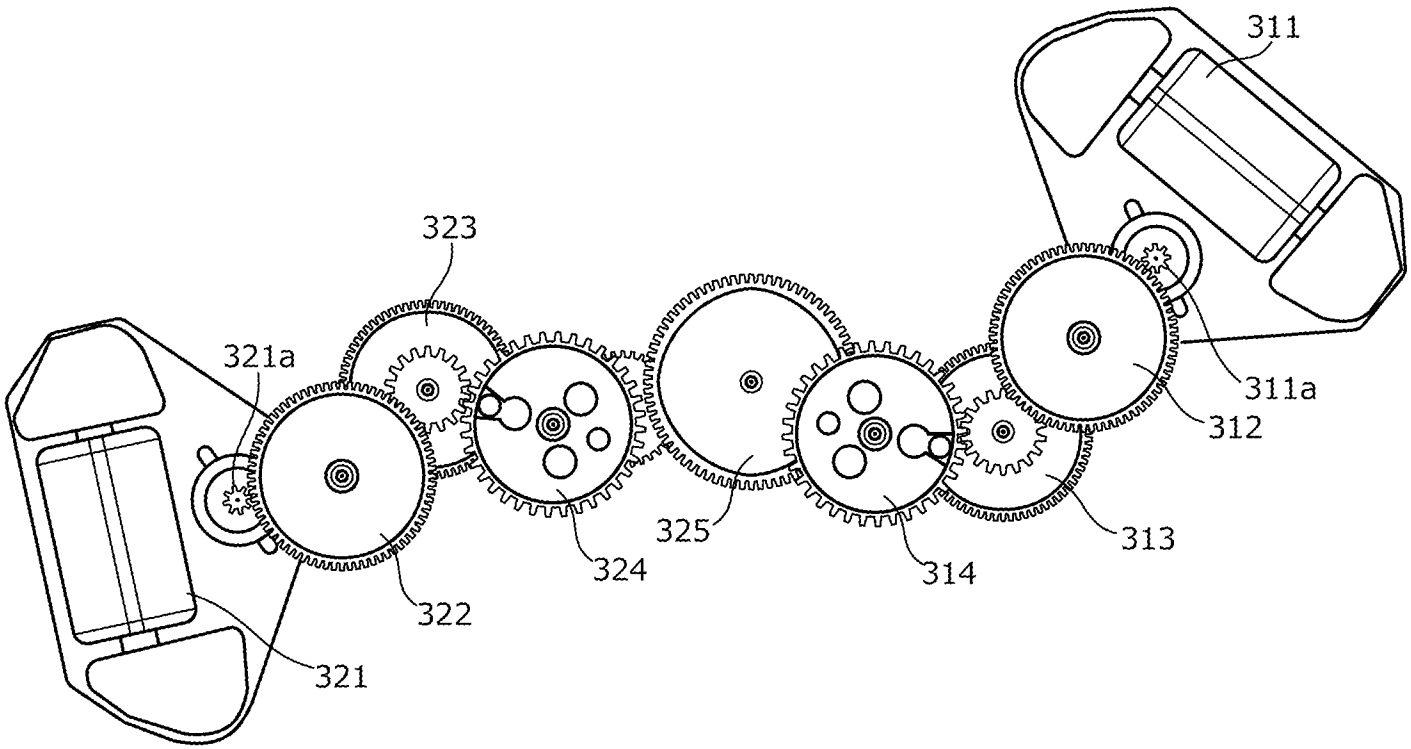
FIG. 3 is a top view of an example of a drive mechanism of the first pointer and the second pointer according to the first embodiment.
Figure 4:
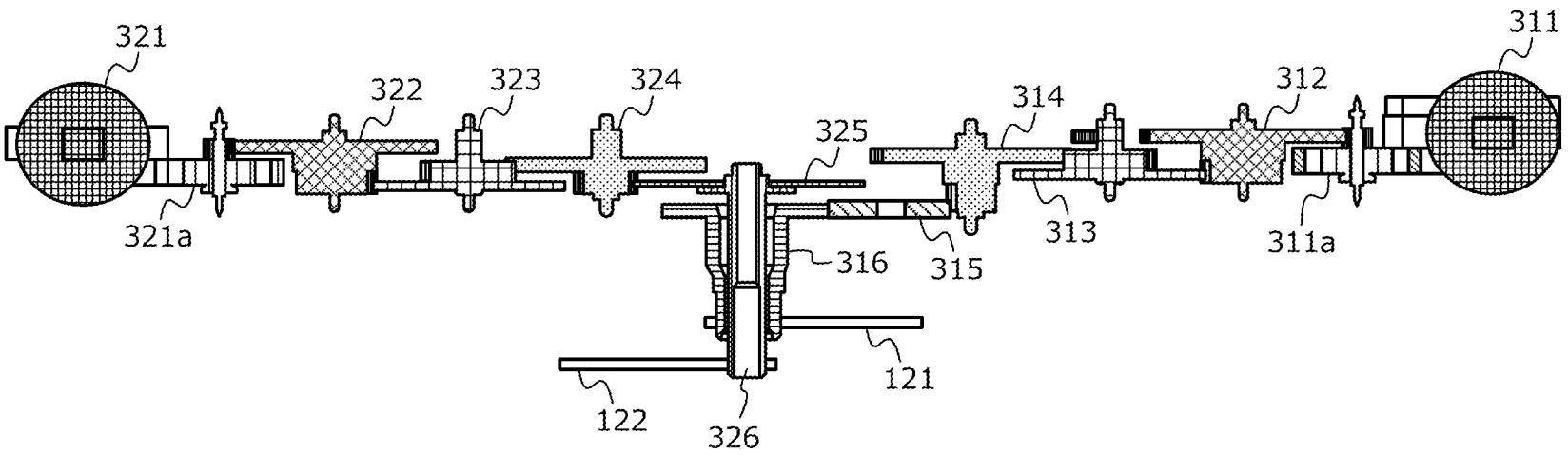
FIG. 4 is a cross-sectional view of the example of the drive mechanism of the first pointer and the second pointer according to the first embodiment.

FIG. 3 is a top view of an example of a drive mechanism of the first pointer and the second pointer according to the first embodiment. FIG. 4 is a cross-sectional view of the example of the drive mechanism of the first pointer and the second pointer according to the first embodiment. A step-motor (first motor) 311, wheels 312, 313, 314, 315 (first wheel train), and an hour wheel 316 are the drive mechanism of the first pointer 121. A step-motor (second motor) 321, wheels 322, 323, 324, 325 (second wheel train), and an hour wheel 326 are the drive mechanism of the second pointer 122.

The step-motor 311 has a rotor 311 a that rotates by an input drive signal. The wheels 312 to 315 are a wheel train that transmits rotation of the rotor 311 a to the hour wheel 316 while decelerating the rotation. The first pointer 121 is attached to the hour wheel 316 in a radial direction of rotation of the hour wheel 316, and the first pointer 121 rotates with the rotation of the hour wheel 316. As a result, the first pointer 121 rotates with the rotation of the rotor 311 a.

The step-motor 321 has a rotor 321*a* that rotates by an input drive signal. The wheels 322 to 325 are a wheel train that transmits rotation of the rotor 321*a* to the hour wheel 326 while decelerating the rotation. The second pointer 122 is attached to the hour wheel 326 in a radial direction of rotation of the hour wheel 326, and the second pointer 122 rotates with the rotation of the hour wheel 326. As a result, the second pointer 122 rotates with the rotation of the rotor 321 a.

As described above, the first pointer 121 and the second pointer 122 have the same moment of inertia. Here, the moment of inertia, as described above, is an amount (difficulty of rotation of an object) representing a magnitude of inertia of the rotation of an object that rotates around a certain axis and tries to maintain the same rotational motion. Further, power driving the first pointer 121 and the second pointer 122 is determined by motor capability and reduction ratio of the wheel train.

Therefore, the moment of inertia of the first pointer 121 and that of the second pointer 122 are the same, whereby the reduction ratio of the wheel train and the capability of the motor for driving the first pointer 121 may be the same as those for driving the second pointer 122. As a result, parts having the same specifications may be used for the drive mechanism of the first pointer 121 and for the drive mechanism of the second pointer 122.

In the example depicted in FIGS. 3 and 4, the step-motors 311, 321 are parts having the same specifications, the wheels 312, 322 are part having the same specifications, the wheels 313, 323 are parts having the same specifications, and the wheels 314, 324 are parts having the same specifications. Therefore, the number of types of parts in the timepiece 100 may be reduced, enabling suppression of the manufacturing cost of the timepiece 100 to be facilitated. The specifications of the step-motors 311, 321, for example, include torque, rotational speed, etc. The specifications of the wheels 312 to 315, 322 to 325 include diameter, cog shape, cog pitch, etc.

While the drive mechanism of the first pointer 121 and the drive mechanism of the second pointer 122 have been described to have configurations using parts having the same specifications, the drive mechanism of the first pointer 121 and the drive mechanism of the second pointer 122 may be shared. For example, configuration may be such that instead of the step-motors 311, 321, a single step-motor is provided, and rotation of a rotor of this single step-motor is transmitted to the hour wheel 316 and the hour wheel 326 by the wheels 312 to 315 and the wheels 322 to 325, respectively. In this manner, the drive mechanism of the second pointer 122 and the drive mechanism of the second pointer 122 may share the step-motor, thereby enabling the number of parts of the timepiece 100 to be reduced.

Furthermore, a portion of the wheels 312 to 315 and the wheels 322 to 325 may be shared. As one example, configuration may be such that instead of the wheel 312 and the wheel 322, a single wheel is provided and this single wheel transmits the rotation of the single step-motor to the wheels 313 to 315 and the wheels 323 to 325. Further, without limitation to the wheel 312 and the wheel 322, other wheels among the wheels 312 to 315 and the wheels 322 to 325 may be shared. In this manner, the drive mechanism of the second pointer 122 and the drive mechanism of the second pointer 122 may share wheels, thereby enabling the number of parts of the timepiece 100 to be reduced.

Figure 5:
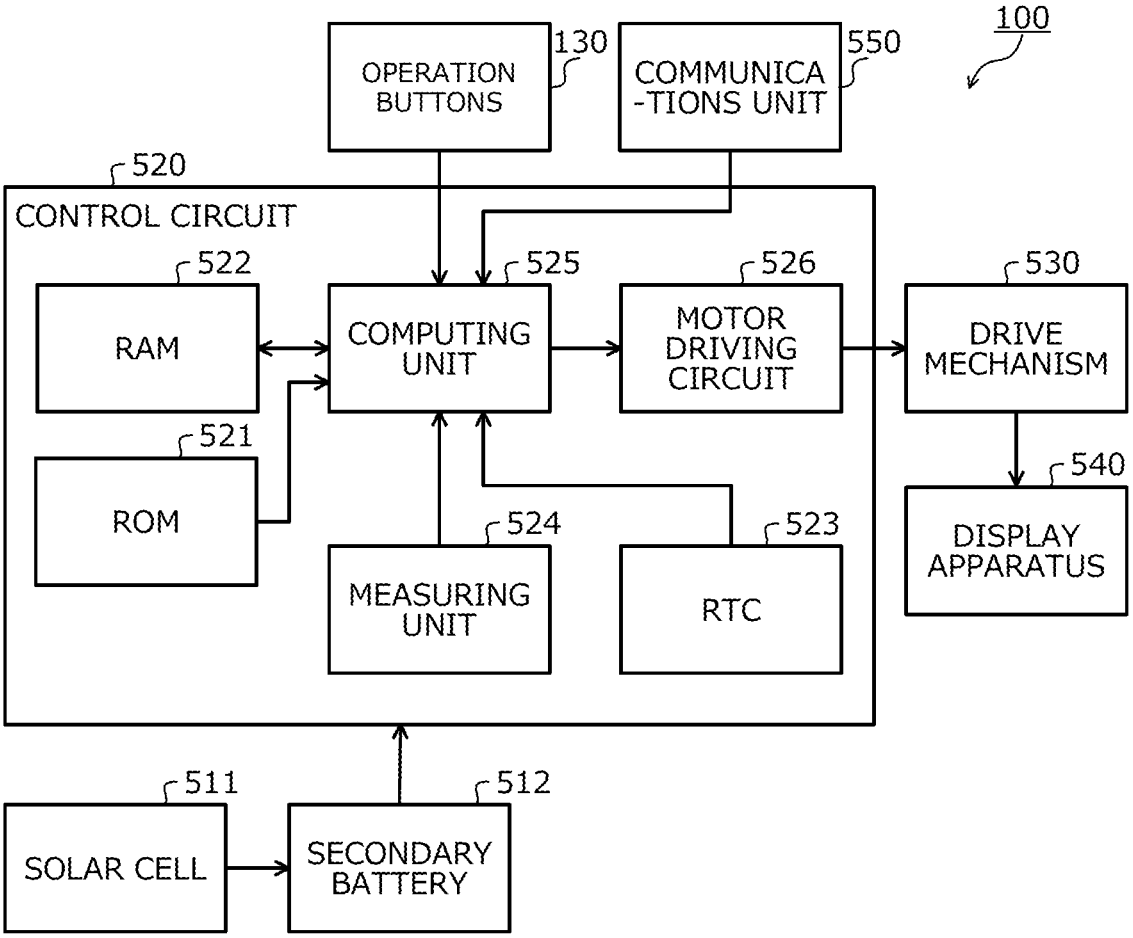
FIG. 5 is a diagram depicting an example of a hardware configuration of the timepiece according to the first embodiment.

FIG. 5 is a diagram depicting an example of a hardware configuration of the timepiece according to the first embodiment. In FIG. 5, parts identical to those depicted in FIG. 1 are given the same reference numerals used in FIG. 1 and description thereof is omitted hereinafter. As depicted in FIG. 5, the timepiece 100 according to the first embodiment is realized by the operation buttons 130, a solar cell 511, the secondary battery 512, a control circuit 520, a drive mechanism 530, a display apparatus 540, and a communications unit 550.

The solar cell 511, for example, is disposed at the rear side of the dial 110 depicted in FIG. 1. Further, the solar cell 511 generates power by external light such as sunlight irradiated on the timepiece 100 and supplies the generated power to the secondary battery 512. The secondary battery 512 accumulates the power generated by the solar cell 511. Further, the secondary battery 512 supplies the accumulated power to circuits of the timepiece 100, such as the control circuit 520. The secondary battery 512, for example, may be realized by a lithium-ion battery or the like.

The control circuit 520 includes read-only memory (ROM) 521, random access memory (RAM) 522, a real-time clock (RTC) 523, a measuring unit 524, a computing unit (controller) 525, and a motor driving circuit 526. The control circuit 520, for example, may be realized by an information processing apparatus such as a microcomputer.

The ROM 521 is auxiliary memory that stores therein data and various types of programs that operate the timepiece 100. The ROM 521, for example, is non-volatile memory such as a magnetic disk, flash memory, and the like. The RAM 522 is a main memory that is used as a work area of the computing unit 525 and to which data processed by the computing unit 525 is written.

The RTC 523 supplies a clock signal that is used for timing in the computing unit 525. For example, the RTC 523 oscillates a crystal oscillator included in the timepiece 100 and thereby, generates a clock signal and supplies the generated clock signal to the computing unit 525 as a reference signal.

The measuring unit 524 measures a measureable physical quantity in the timepiece 100 and outputs to the computing unit 525, a measured value obtained by the measurement. A physical quantity measured by the measuring unit 524, for example, includes the remaining battery level in the secondary battery 512. In this case, measurement of the remaining battery level by the measuring unit 524, for example, may be performed by detecting output voltage of the secondary battery 512. Nonetheless, a method of measuring the remaining battery level is not limited hereto and various methods of measurement are possible.

Further, the physical quantity measured by the measuring unit 524 may be the cardinal direction described above, altitude, temperature, humidity, etc., or the physical quantity for which a measured value is displayed in the mode indicated by the mode mark 161, the mode mark 162, or the mode mark 163. For example, a physical quantity measured by the measuring unit 524 includes the remaining battery level in the secondary battery 512 and the cardinal direction and altitude described above. In this case, the measuring unit 524 may be realized by a circuit that measures the remaining battery level in the secondary battery 512, a circuit that measures the cardinal direction, and a circuit that measures the altitude.

The computing unit 525 governs overall control of the timepiece 100. For example, the computing unit 525 performs various types of control by loading a program stored in the ROM 521 onto the RAM 522 and executing the program. For example, the computing unit 525, in the time display mode described above, counts the current time based on the clock signal received from the RTC 523 and controls the motor driving circuit 526 so that the counted current time is displayed by the display apparatus 540. At this time, the computing unit 525 controls the motor driving circuit 526 so that the first pointer 121 points in a direction corresponding to the hour of the current time, the second pointer 122 points in a direction corresponding to the minute of the current time, and the second hand 123 points in a direction corresponding to the second of the current time.

Further, the computing unit 525, in the information display mode described above, controls the motor driving circuit 526 so that a measured value output from the measuring unit 524 is displayed by the display apparatus 540. Further, in the information display mode described above, when the information to be displayed includes information received from an external communications device by the timepiece 100, the computing unit 525 may control the motor driving circuit 526 so that the information output from the communications unit 550 described above is displayed by the display apparatus 540.

The motor driving circuit 526, under the control of the computing unit 525, outputs a drive signal for driving a motor included in the drive mechanism 530 described hereinafter. As a result, for example, the current time counted by the control circuit 520 and each measured value obtained by the measuring unit 524 are displayed by the display apparatus 540.

The drive mechanism 530 includes the wheel train and the step-motor operated according to the drive signal output from the motor driving circuit 526 described above and the wheel train transmits the rotation of the step-motor, whereby a pointer included in the display apparatus 540 is rotated. The drive mechanisms of the first pointer 121 and the second pointer 122 depicted in FIGS. 3 and 4 are included in the drive mechanism 530. For example, the step-motor 311 depicted in FIGS. 3 and 4 rotates the rotor 311*a* according to a drive signal from the motor driving circuit 526. Further, the step-motor 321 depicted in FIGS. 3 and 4 rotates the rotor 321*a* according to a drive signal from the motor driving circuit 526.

The display apparatus 540, for example, includes the dial 110, the first pointer 121, the second pointer 122, the second hand 123, and the sub-pointer 140 depicted in FIG. 1. The pointers included in the display apparatus 540 are rotated on the dial 110, whereby information is displayed.

The communications unit 550 communicates with an external communications device of the timepiece 100. The communications unit 550, for example, performs wireless communication such as that of Bluetooth (registered trademark) and Wi-Fi (registered trademark) with an external communications device. Alternatively, the communications unit 550 may communicate with an external communications device by a wired connection such as a Universal Serial Bus (USB) cable. An external communications device may be, for example, an information terminal such as a personal computer or a smartphone, or may be a server configured to communicate with the timepiece 100 via various types of networks.

For example, under the control of the computing unit 525, the communications unit 550 outputs to the computing unit 525, information received from an external communications device. The information received from the external communications device by the communications unit 550, for example, may be various types of information receivable from an external communications device such as weather information like a weather forecast, user schedule information registered in an external communications device, etc.

The operation buttons 130 are operated by the user and output operation details thereof to the control circuit 520. The control circuit 520 executes various types of processes according to the input operation details received by the operation buttons 130. The operation buttons 130, for example, include the first push-button 131, the second push-button 132, and the crown 133 depicted in FIG. 1.

For example, the computing unit 525 of the control circuit 520 sequentially switches the operation mode such as the time display mode and the information display mode described above, each time the first push-button 131 included among the operation buttons 130 is pushed.

Figure 6:
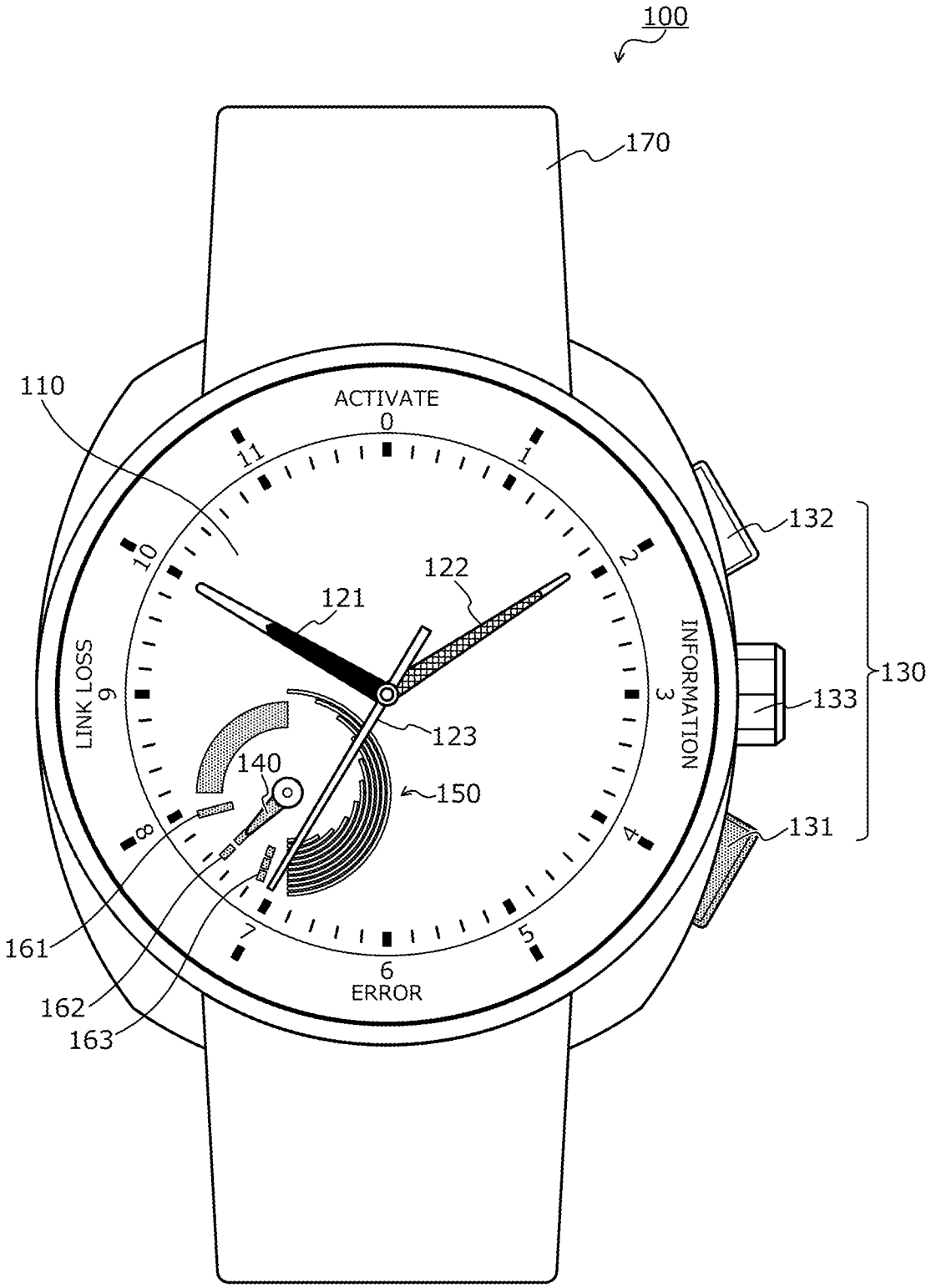
FIG. 6 is a diagram depicting another example of the external appearance of the timepiece according to the first embodiment.

FIG. 6 is a diagram depicting another example of the external appearance of the timepiece according to the first embodiment. In FIG. 6, parts identical to those depicted in FIG. 1 are given the same reference numerals used in FIG. 1 and description thereof is omitted hereinafter. As depicted in FIG. 6, the first pointer 121 may omit the first pointing portion 212 (refer to FIG. 2). In this case, the first pointer 121 is configured by the tapered portion that becomes thinner with increasing distance from the rotation axis 201.

Similarly, the second pointer 122 may omit the second pointing portion 222 (refer to FIG. 2). In this case, the second pointer 122 is configured by the tapered portion that becomes thinner with increasing distance from the rotation axis 201. Even with such a configuration, as described above, the number of types of parts in the timepiece 100 is reduced, thereby reducing the manufacturing cost, and difficulty in distinguishing the first pointer 121 and the second pointer 122 by the user may be prevented.

Figure 7:
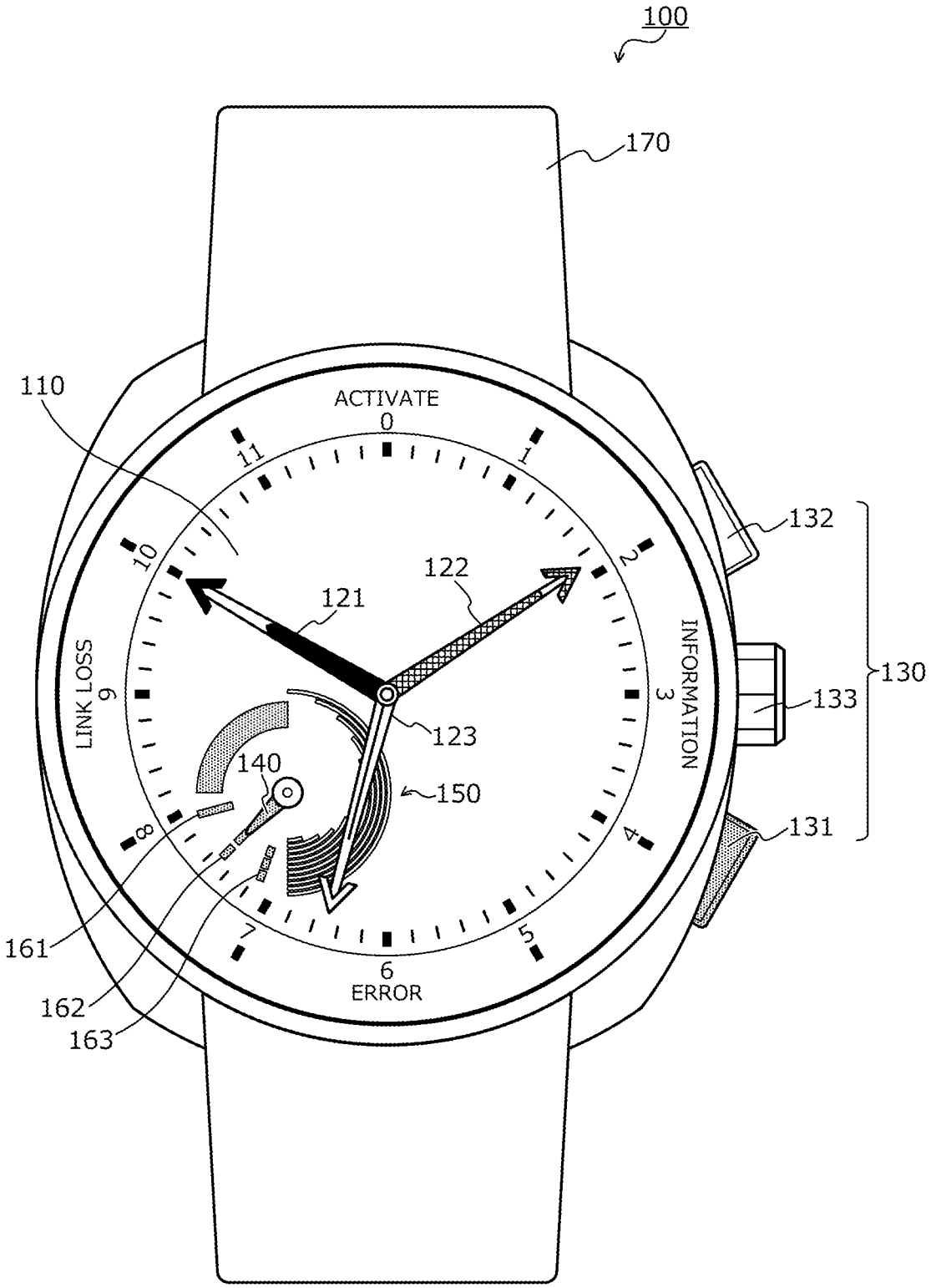
FIG. 7 is a diagram depicting another example of the external appearance of the timepiece according to the first embodiment.

FIG. 7 is a diagram depicting another example of the external appearance of the timepiece according to the first embodiment. In FIG. 7, parts identical to those depicted in FIG. 1 are given the same reference numerals used in FIG. 1 and description thereof is omitted hereinafter. As depicted in FIG. 7, the second hand 123 may be formed so that the moment of inertia of the second hand 123 is the same as the moment of inertia of the first pointer 121 and the moment of inertia of the second pointer 122. For example, the length of the second hand 123 may be the same as the length of the first pointer 121 and the length of the second pointer 122.

As a result, parts having the same specifications may be used for the drive mechanism of the first pointer 121, the drive mechanism of the second pointer 122, and the drive mechanism of the second hand 123. Therefore, the number of types of parts in the timepiece 100 may be further reduced, enabling the manufacturing cost of the timepiece 100 to be suppressed.

Further, the pointer is drawn on the second hand 123 so that the user knows that the second hand 123 is a second hand for displaying the second of the current time. For example, as depicted in FIG. 7, the pointer is a straight line in the longitudinal direction of the second hand 123, and may be drawn by drawing or coloring on the second hand 123, a straight line that is thinner than the hour hand 211 and the minute hand 221. As a result, even when the second hand 123 is formed so that the moment of inertia of the second hand 123 is the same as the moment of inertia of the second pointer 122, the user may know that the second hand 123 is the second hand.

In the configuration depicted in FIG. 7, for example, the first pointer 121 may be formed so that the moment of inertia of the first pointer 121 differs from the moment of inertia of the second pointer 122 and the moment of inertia of the second hand 123. For example, the first pointer 121 may be a pointer that is shorter than the second pointer 122 and the second hand 123. In this case, the user may know that the first pointer 121 is the hour hand by the length of the first pointer 121. In such a configuration, the hour hand 211 needs not be drawn on the first pointer 121.

In this case, a first pointer and a second pointer having the rotation axes and the moments of inertia that are the same as each other and color schemes that differ from each other may be set as the second pointer 122 and the second hand 123, respectively. In this case, the rotation of the first pointer (the second pointer 122) is controlled, whereby the first information that is displayed is the minute of the current time. Further, the rotation of the second pointer (the second hand 123) is controlled, whereby the second information that is displayed is the second of the current time.

Further, in the configuration depicted in FIG. 7, like in the example depicted in FIG. 6, the first pointer 121 and the second pointer 122 do not include the first pointing portion 212 or the second pointing portion 222, and similarly the second hand 123 may also have a configuration that does not include a pointing portion of an arrowhead shape.

Figure 8:
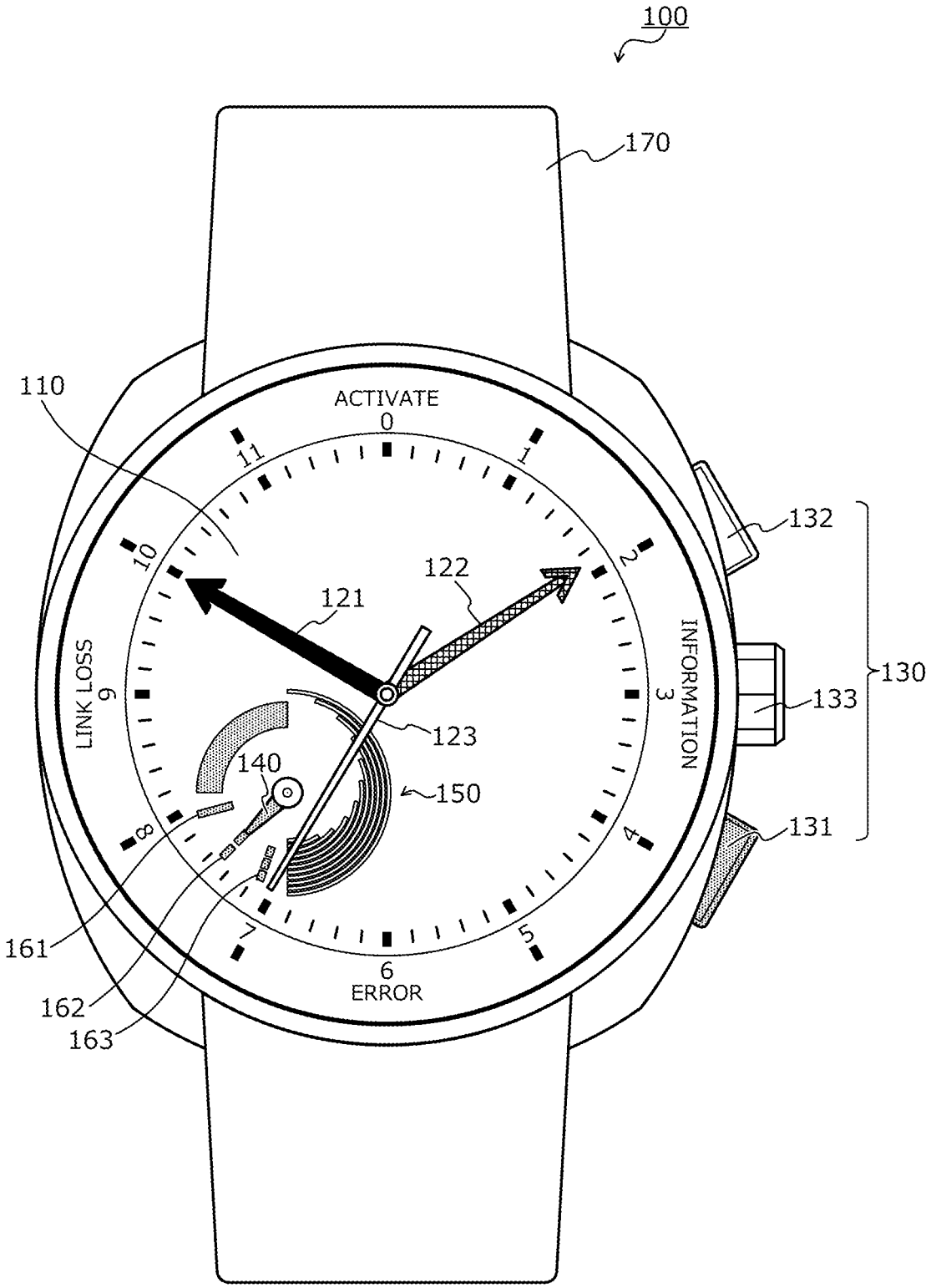
FIG. 8 is a diagram depicting another example of the external appearance of the timepiece according to the first embodiment.

FIG. 8 is a diagram depicting another example of the external appearance of the timepiece according to the first embodiment. In FIG. 8, parts identical to those depicted in FIG. 1 are given the same reference numerals used in FIG. 1 and description thereof is omitted hereinafter. As depicted in FIG. 8, the hour hand 211 that is shorter than the first pointer 121 need not be drawn on the first pointer 121.

Similarly, the minute hand 221 that is shorter than the second pointer 122 need not be drawn on the second pointer 122.

In the example depicted in FIG. 8, a portion (for example, the front surface) of the first pointer 121 visible by the user is colored a single color (as one example, red) overall. Further, a portion (for example, front surface) of the second pointer 122 visible by the user is colored a single color (as one example, blue) different from the color of the first pointer 121.

Even in such a configuration, the user, for example, by remembering that red is the hour hand and blue is the minute hand, is able to distinguish the first pointer 121 and the second pointer 122 from each other. As a result, the user may know the hour of the current time from the first pointer 121 and may know the minute of the current time from the second pointer 122.

Like the example depicted in FIG. 8, color schemes of the first pointer 121 and the second pointer 122 differ, whereby even without drawing the hour hand 211 and the minute hand 221 on the first pointer 121 and the second pointer 122, respectively, the user may distinguish the first pointer 121 and the second pointer 122 from each other.

In the configuration depicted in FIG. 8, like the example depicted in FIG. 6, the first pointer 121 and the second pointer 122 need not include the first pointing portion 212 and the second pointing portion 222, respectively (refer to FIG. 2). Further, in the configuration depicted in FIG. 8, like the example depicted in FIG. 7, the moment of inertia of the second hand 123, for example, may be the same as the moment of inertia of the second pointer 122.

In the timepiece 100 depicted in FIG. 1 and FIGS. 6 to 8, for example, while a case is described in which the first pointer 121 and the second pointer 122 have lengths that are the same, the first pointer 121 and the second pointer 122 may have shapes (including size) that are the same. In this case, the moment of inertia of the first pointer 121 and the moment of inertia of the second pointer 122 are the same and pointers having the same specifications may be used for the first pointer 121 and the second pointer 122.

Therefore, the number of types of parts in the timepiece 100 may be further reduced and the manufacturing cost of the timepiece 100 may be suppressed. Further, even in configurations in which the first pointer 121 and the second pointer 122 have the same shape, as described above, the color schemes of the first pointer 121 and the second pointer 122 differ, whereby the user may distinguish the first pointer 121 and the second pointer 122 from each other.

In the timepiece 100 depicted in FIG. 1 and FIGS. 6 to 8, as an example, the first pointer and the second pointer are described to have rotation axes and moments of inertia identical to each other while the color schemes thereof differ, while a combination of the first pointer 121 and the second pointer 122, and a combination of the second pointer 122 and the second hand 123 are described, the first pointer and the second pointer are not limited hereto.

For example, a second sub-pointer having a rotation axis and a moment of inertia identical to those of the sub-pointer 140 may be provided in the timepiece 100, and the sub-pointer 140 may be set as the first pointer and the second sub-pointer may be set as the second pointer. In this case, parts having the same specifications may be used as the drive mechanism of the sub-pointer 140 and the drive mechanism of the second sub-pointer, and the manufacturing cost of the timepiece 100 may be reduced. Further, color schemes of the sub-pointer 140 and the second sub-pointer differ, thereby enabling difficulty in distinguishing the sub-pointer 140 and the second sub-pointer to be prevented.

In this manner, in the timepiece according to the first embodiment, the moments of inertia of the first pointer and the second pointer respectively for displaying the first information and the second information and having the same rotation axis are set to be the same, thereby enabling parts having the same specifications to be used as the drive mechanism of the first pointer and the drive mechanism of the second pointer. Therefore, the number of types of parts in the timepiece is reduced, enabling the manufacturing cost to be reduced.

Further, the color schemes of the first pointer and the second pointer differ, thereby enabling the user to easily distinguish the first pointer and the second pointer even when the moments of inertia of the first pointer and the second pointer are the same. Therefore, the user may distinguish and know the first information and the second information by the first pointer and the second pointer. Therefore, according to the timepiece according to the first embodiment, decreases in the ease of viewing information are suppressed and manufacturing cost may be reduced.

As described above, according to the timepiece according to the first embodiment, decreases in the ease of viewing information are suppressed and manufacturing cost may be reduced.

The timepiece according to a second embodiment will be described.

Figure 9:
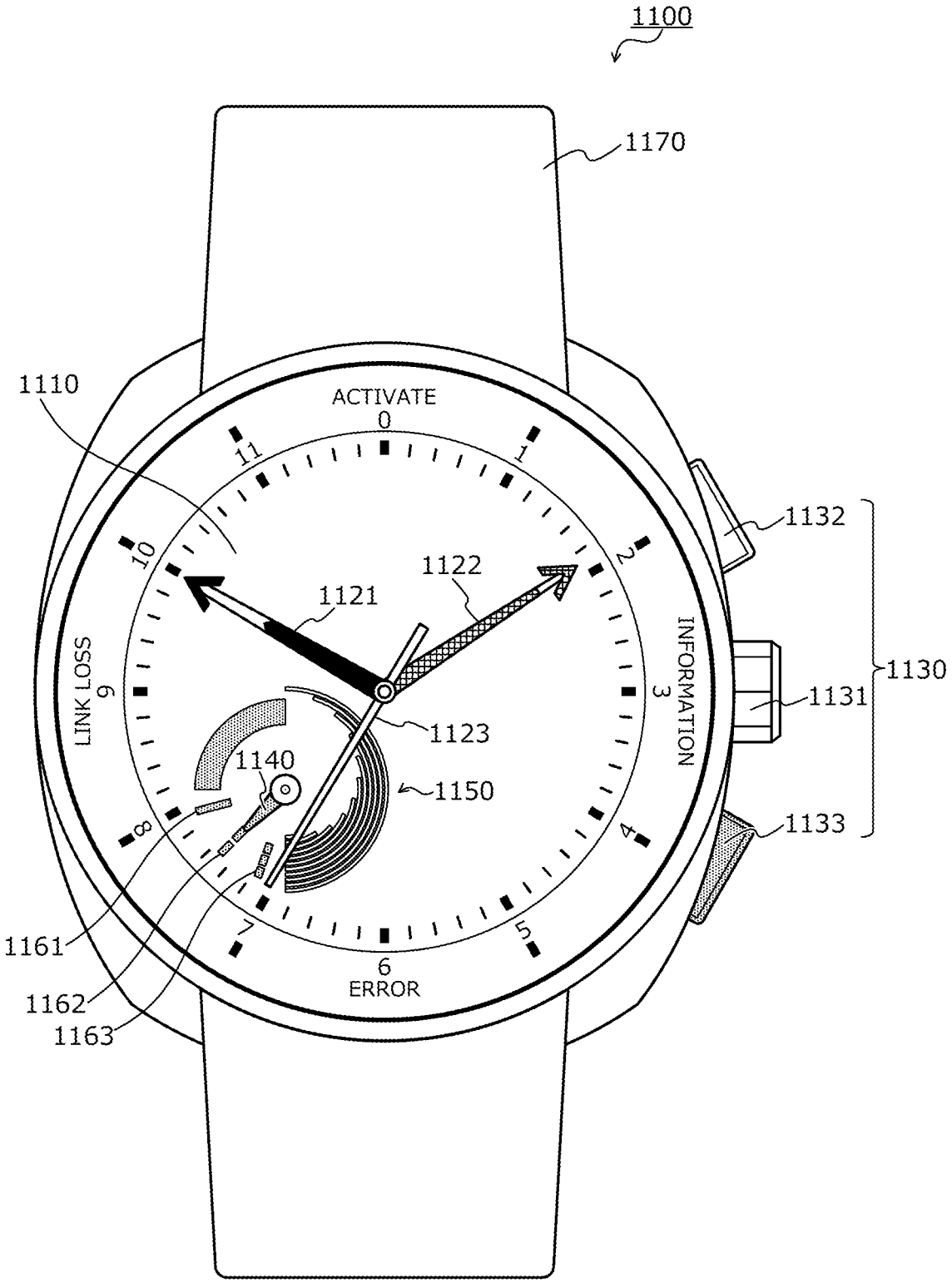
FIG. 9 is a diagram depicting an example of an external appearance of the timepiece according to a second embodiment.

FIG. 9 is a diagram depicting an example of an external appearance of the timepiece according to the second embodiment. As depicted in FIG. 9, a timepiece 1100 according to the second embodiment includes a dial (display face) 1110, an hour hand 1121, a minute hand 1122, a second hand 1123, and a pointer 1140 in a body that is a housing (case).

The hour hand 1121, the minute hand 1122, and the second hand 1123 are pointers that display the current time by pointing to indices or time (for example, "0", "1", "2", "3", "4", etc.) shown on the dial 1110. In the example depicted in FIG. 9, while the hour hand 1121 and the minute hand 1122 are pointers having the same length, sizes and positions of respective colored regions differ, thereby enabling the pointers to be distinguished from each other. The hour hand 1121, the minute hand 1122, and the second hand 1123 may each be used to display information different from the current time.

The pointer 1140 points to a position of an arc of an arc group 1150 shown on the dial 1110 and thereby, displays a measured value obtained by measurement of a predetermined physical quantity in the timepiece 1100. The predetermined physical quantity, for example, is the remaining battery level of the timepiece 1100, however, without limitation to the remaining battery level of the timepiece 1100, may be set as another physical quantity (for example, refer to a measuring unit 1901 in FIG. 17). Here, description will be given for a case in which the predetermined physical quantity is the remaining battery level of the timepiece 1100. For example, the arc group 1150 represents the remaining battery level of the timepiece 1100 and the pointer 1140 points to the arc group 1150 and thereby, displays a measured value of the remaining battery level of the timepiece 1100.

A color of a portion of the pointer 1140 visible by the user is a color different from a color of the arc group 1150. The portion of the pointer 1140 visible by the user is a surface (surface depicted in FIG. 9) of the pointer 1140, opposite a surface of the pointer 1140 facing toward the dial 1110. As a result, visibility of the pointer 1140 and the arc group 1150 is enhanced, and knowing the remaining battery level from the pointer 1140 and the arc group 1150 is facilitated. A shape of the arc group 1150 will be described hereinafter (for example, refer to FIG. 10).

Further, the pointer 1140 displays an operation mode of the timepiece 1100 by pointing to any one of mode marks 1161, 1162, 1163 shown on the dial 1110. For example, the mode marks 1161 to 1163 correspond to different operation modes of the timepiece 1100, respectively, and the pointer 1140 points to a mode mark that of the mode marks 1161 to 1163, corresponds to a current operation mode of the timepiece 1100.

Further, in the timepiece 1100, a crown 1131, a first push-button 1132, and a second push-button 1133 are disposed at a side surface of the body, as operation buttons 1130 for the user of the timepiece 1100 to perform various operations. In the example depicted in FIG. 9, the crown 1131 is disposed near a 3-hour index, the first push-button 1132 is disposed near a 2-hour index, and the second push-button 1133 is disposed near a 4-hour index.

The second push-button 1133 is an operation button for switching the operation mode of the timepiece 1100 displayed by the pointer 1140 and the mode marks 1161 to 1163. Further, a color of a portion of the second push-button 1133 visible by the user of the timepiece 1100 is a color of the mode marks 1161 to 1163. The second push-button 1133 and the mode marks 1161 to 1163, for example, are each a yellow color.

A crystal formed using a transparent material such as a glass is attached to the body of the timepiece 1100 so as to cover the dial 1110. Further, a case back is attached to the body of the timepiece 1100, on a side of the body, opposite that where crystal is attached. Hereinafter, in the timepiece 1100, a side toward the disposed crystal (direction opposite viewing direction in FIG. 9) is called a front side, and in the timepiece 1100, a side toward the disposed case back (viewing direction in FIG. 9) is called a rear side. Further, a strap 1170 is attached to the body of the timepiece 1100 so that the timepiece 1100 is portable by the user of the timepiece 1100 wrapping the strap 1170 around his/her wrist.

The timepiece 1100 may be a solar-powered timepiece powered by light energy. For example, a solar cell is disposed at a rear side of the dial 1110, and power is generated in the solar cell by light entering from a front side thereof. Therefore, the dial 1110 is formed using a material that transmits light to a certain extent. The power generated by the solar cell accumulates in a secondary battery (for example, a secondary battery 1312 depicted in FIG. 11), and the power accumulated in the secondary battery is used as a power source of the timepiece 1100. The secondary battery, for example, may be realized by a lithium-ion battery or the like. The pointer 1140 and the arc group 1150 described above, for example, display a remaining level of the secondary battery.

An external appearance of the timepiece 1100 depicted in FIG. 9 is an example and the external appearance of the timepiece 1100 is not limited hereto. For example, the body may be square instead of round, and the presence/absence, quantity, arrangement, shape, etc. of the crown 1131 and the like may be arbitrarily changed. Further, without limitation to the configuration in which three hands including the hour hand 1121, the minute hand 1122, the second hand 1123 are included as pointers indicating the current time, for example, the second hand 1123 may be omitted. Alternatively, a date display unit and/or a pointer for displaying various types of information such as day, daylight savings time, radio wave reception state, etc. may be added.

Further, while description is given regarding a configuration in which the timepiece 100 is a wristwatch, the timepiece 1100 is not limited to such a configuration. For example, the timepiece 1100 may be a clock such as a pocket watch, a table dock, a wall clock, etc. Further, while description is given regarding a configuration in which the timepiece 1100 is an analog clock that displays the current time by a pointer, the configuration is not limited hereto. For example, the timepiece 1100 may be a digital clock that displays the current time by numeric values or an audio clock that gives notification of the time by sound. Further, the timepiece 1100 may be a clock (for example, smartwatch) that gives notification of the current time by displaying, by a display, an image depicting a time displaying unit of an analog clock or digital clock.

However, in these cases as well, the timepiece 1100 includes the pointer 1140 and the arc group 1150. When the timepiece 1100 includes the display, the pointer 1140 and the arc group 1150 may be a virtual pointer and arc group realized by an image displayed by the display.

Figure 10:
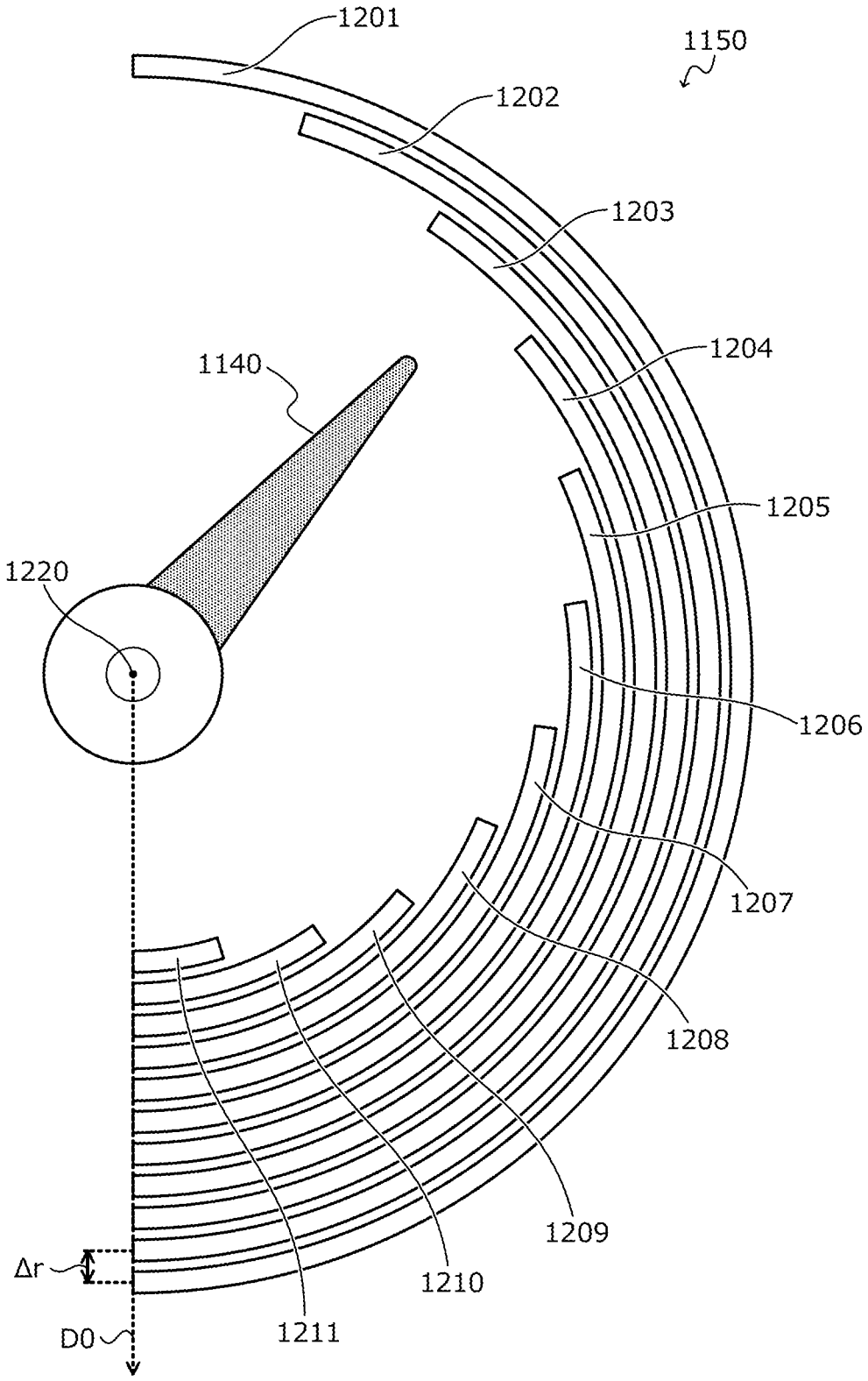
FIG. 10 is a diagram depicting an example of an arc group of the timepiece according to the second embodiment.

FIG. 10 is a diagram depicting an example of the arc group of the timepiece according to the second embodiment. The arc group 1150 depicted in FIG. 9, as depicted in FIG. 10, for example, is formed by arcs 1201, 1202, 1203, 1204, 1205, 1206, 1207, 1208, 1209, 1210, 1211. Here, the rotation center 1220 depicted in FIG. 10 is a rotation center (rotation axis) of the pointer 1140. The arcs 1201 to 1211 are arcs included multiple circles that are centered around the rotation center 1220 of the pointer 1140 and that have radii that differ by a predetermined interval (predetermined unit $\Delta r$).

For example, the arc 1201 is an arc having a radius that is largest among radii of the arcs 1201 to 1211. The radius of an arc is the radius of the circle in which the arc is included. The arc 1202 is an arc having a radius that is shorter than that of the arc 1201 by the predetermined unit $\Delta r$. The arc 1203 is an arc having a radius that is shorter than that of the arc 1202 by the predetermined unit $\Delta r$. Similarly, the arcs 1204 to 1211 have radii that respectively differ by the predetermined unit $\Delta r$.

Further, the arcs 1201 to 1211 are arcs obtained by rotating in a same direction (counter-clockwise in FIG. 10) around the rotation center 1220, at mutually differing rotation angles, points that are positioned in a same direction from the rotation center 1220, at mutually differing distances from the rotation center 1220.

Therefore, lengths of the arcs 1201 to 1211 respectively differ. For example, the arc 1201 is an arc having a length that is longest and the arcs 1202 to 1211 are arcs having lengths that are second longest to eleventh longest, respectively. In the example depicted in FIG. 10, the arcs 1201 to 1211 in ascending order (geometric series) of length are the arc 1211, the arc 1210, the arc 1209, the arc 1208, the arc 1207, the arc 1206, the arc 1205, the arc 1204, the arc 1203, the arc 1202, the arc 1201. Serial relationship of the lengths of the arcs 1201 to 1211 will be described hereinafter (for example, refer to FIG. 16).

Further, first ends (hereinafter, start points) of the arcs 1201 to 1211 are positioned along a single direction (hereinafter, reference direction D0) from the rotation center 1220 while second ends (hereinafter, end points) of the arcs 1201 to 1211 are positioned in mutually differing directions from the rotation center 1220.

When a measured value is displayed by the pointer 1140 and the arc group 1150, rotation of the pointer 1140, for example, a pointing direction of the pointer 1140 is controlled to be within a range in which one of the arcs 1201 to 1211 is present. In the example depicted in FIG. 10, at least one of the arcs 1201 to 1211 is present in a range 180 degrees counter-clockwise from the reference direction D0 as viewed from the rotation center 1220. Therefore, the rotation of the pointer 1140 is controlled to be within a range (semicircular-shaped range) 180 degrees counter-clockwise from the reference direction D0.

A case in which a measurement value of the remaining battery level of the timepiece 1100 is displayed by the pointer 1140 will be described. In this case, of the arcs 1201 to 1211, rotation of the pointer 1140 is controlled so that the number of arcs present in the pointing direction of the pointer 1140 as viewed from the rotation center 1220 is a number corresponding to the measurement value of the remaining battery level of the timepiece 1100. For example, the rotation of the pointer 1140 is controlled so that the greater is the remaining battery level of the timepiece 1100, the greater is the number of arcs that, of the arcs 1201 to 1211, are present in the pointing direction of the pointer 1140 as viewed from the rotation center 1220. An arc present in the pointing direction of the pointer 1140 is an arc intersecting the pointing direction of the pointer 1140.

In the example depicted in FIG. 10, the rotation of the pointer 1140 is controlled so that an angle between the reference direction D0 and the pointing direction of the pointer 1140 is an angle corresponding to the measurement value of the remaining battery level of the timepiece 1100. For example, when the remaining battery level of the timepiece 1100 is close to a maximum value (for example, 100%), the angle between the reference direction D0 and the pointing direction of the pointer 1140 is the smallest (for example, about 0 degrees to 10 degrees.

Further, the lower is the remaining battery level of the timepiece 1100, the pointer 1140 is rotated counter-clockwise so that the angle between the reference direction D0 and the pointing direction of the pointer 1140 increases. Further, when the remaining battery level of the timepiece 1100 is near a minimum value (for example, 0%), the angle between the reference direction D0 and the pointing direction of the pointer 1140 is greatest (for example, about 170 degrees to 180 degrees).

By such control, as the remaining battery level of the timepiece 1100 decreases, the number of arcs present in the pointing direction of the pointer 1140 decreases among the arcs 1201 to 1211. For example, when the remaining battery level of the timepiece 1100 is near a maximum value, the pointing direction of the pointer 1140 is substantially in a downward direction in FIG. 10, and eleven arcs (the arcs 1201 to 1211) are present in the pointing direction of the pointer 1140.

Further, when the remaining battery level of the timepiece 1100 decreases, the pointing direction of the pointer 1140, for example, becomes like the pointing direction depicted in FIG. 10 and in this case, three arcs (the arc 1201 to 1203) are present in the pointing direction of the pointer 1140. Further, when the remaining battery level of the timepiece 1100 is near the minimum value, the pointing direction of the pointer 1140 is substantially in an upward direction in FIG. 10, and one arc (the arc 1201) is in the pointing direction of the pointer 1140. Therefore, the user of the timepiece 1100 may know the remaining battery level of the timepiece 1100 from the number of arcs that are present in the pointing direction of the pointer 1140, among the arcs 1201 to 1211.

Use of the arc group 1150 depicted in FIG. 10 enables, as compared to the conventional techniques, increased size of the display unit formed by the pointer 1140 and the arc group 1150 and degradation of the external appearance quality to be avoided, and enables the user to easily know the remaining battery level of the timepiece 1100.

For example, in the conventional technique in Japanese Laid-Open Patent Publication No. H3-18722 described above, in an outer peripheral portion of the circular display unit, indices in the radial direction are lined up in a peripheral direction and of the indices, near a representatively index, the value thereof is shown. Therefore, space for showing the representative value is necessary and a problem arises in that the display unit is larger in size.

In contrast, according to the timepiece 1100, even without such showing of the value, the user may know the remaining battery level by counting the arcs in the pointing direction (on an extended line of the pointer 1140) of the pointer 1140. Therefore, even without increasing the size of the display unit formed by the pointer 1140 and the arc group 1150 to provide space for showing a representative value, the user may know the remaining battery level. Further, degradation of the quality of the external appearance due to the showing of a value on the dial 1110 as described above may be avoided. The number of arcs need not be accurately counted by the user. In other words, provided the user may roughly know the number of arcs, the user may roughly know the remaining battery level of the timepiece 1100.

Further, in the configuration described in Japanese Laid-Open Patent Publication No. H3-18722, a method is conceivable in which without showing the value described above, the user counts how many indices the index in the pointing direction of the pointer is from the index at the end. Nonetheless, in this case, the user, first, looks at the pointer and then moves the line of sight in the pointing direction of the pointer to thereby, identify the index to which the pointer is pointing and then, while moving the line of sight along the peripheral direction, counts how many indices the identified index is from the index at the end. Therefore, the direction of movement of the line of sight has to be changed and the value displayed by the pointer cannot be easily known.

In contrast, according to the timepiece 1100, the user, first, looks at the pointer 1140 and while moving the line of sight in the pointing direction of the pointer 1140, counts the arcs in the pointing direction of the pointer 1140 and thereby, knows the remaining battery level. Accordingly, the user may count the arcs by moving the line of sight in a constant direction and thereby, may easily know the remaining battery level.

Further, in the configuration described in Japanese Laid-Open Patent Publication No. 2016-142545, the measured value is displayed using a pointer and a crescent-shaped index. The crescent-shaped index, for example, is a shape obtained by cutting a crescent formed from two arcs in a radial direction of the arcs. In such a configuration, the user knows the measurement result from a thickness of a portion of the crescent-shaped index to which the pointer points and therefore, the measurement result is difficult to know quantitatively. Further, provision of division lines on the crescent shaped index, in a radial direction of a circle centered at the rotation center of the pointer to facilitate quantitatively knowing the displayed value is conceivable. Nonetheless, when such division lines in the radial direction are provided, the crescent-shaped index is divided along the direction of rotation of the pointer and the quality of the external appearance degrades.

In contrast, in the timepiece 1100, a crescent-shaped index (the arc group 1150) may be realized by a combination of the arcs 1201 to 1211 centered around the rotation center 1220 of the pointer 1140. As a result, no lines in the radial direction are present in the crescent-shaped index formed by the arc group 1150 and therefore, the crescent-shaped index is not divided along the rotation of the pointer 1140, whereby degradation of the quality of the external appearance may be avoided. Further, the crescent-shaped index is configured by only the arcs 1201 to 1211 along the direction of the rotation of the pointer 1140 and thereby, enables the quality of the external appearance to be enhanced.

Further, when the crescent-shaped index is implemented by coloring the dial 1110, the crescent-shaped index is realized by the combination of the arcs 1201 to 1211, whereby as compared to a case of, for example, a solid coating in a crescent-shape, costs such as for colorant may be suppressed.

Further, the user may wish to know battery usage (difference of battery capacity and remaining battery level) and not the remaining battery level. In this case, the user identifies an arc that is nearest the rotation center 1220 among the arcs present in the pointing direction of the pointer 1140 of the arcs 1201 to 1211, and looks at the length of the identified arc to, thereby, easily know the battery usage. For example, in the example depicted in FIG. 10, the arc nearest the rotation center 1220 of the arcs 1201 to 1203 present in the pointing direction of the pointer 1140 is the arc 1203 and by looking at the length of the arc 1203, the user may easily know the battery usage.

For example, in the configuration described in Japanese Laid-Open Patent Publication No. H3-18722, while indices are drawn in a space of a circle centered around the rotation center of the pointer, the length of these indices is at most a radius of this circle. In particular, when a radius (radius of the arc 1201) of a space of a semicircular shape in which the arc group 1150 depicted in FIG. 10 is r and in this space of a semicircular shape, assuming indices in a radial direction are provided like the configuration described in Japanese Laid-Open Patent Publication No. H3-18722, the length of the indices is at most r.

Therefore, differences in lengths of the indices decrease and it is difficult for the user to know the extent to which the length of the index indicated by the pointer and the length of an index other than the indicated index differ. Therefore, from the length of the index indicated by the pointer, it is difficult for the user to know the value indicated by the pointer.

In contrast, in the timepiece 1100, the arcs 1201 to 1211 are shown in a space of a circle centered around the rotation center 1220 of the pointer 1140 and the length of the arc 1201 that is longest is $2\times\pi\times r/2=\pi\times r$. Therefore, as described above, the largest value of the lengths of the arcs 1201 to 1211 may be $\pi$ ($\approx 3.14$) times that in a case in which indices in the radial direction are provided. As a result, lengths in a wide range from a length nearly 0 to $\pi\times r$ may be used as lengths of the arcs 1201 to 1211, thereby enabling differences in the lengths of the arcs 1201 to 1211 to be increased.

As a result, the user may easily know an extent to which the length of an identified arc and the length of an arc other than the identified arc differ. For example, the user may know a ratio of the current battery usage to the maximum battery usage by comparing the length of the identified arc and the length of the arc 1201 indicating the maximum battery usage. Therefore, the user may easily know the battery usage of the timepiece 1100 by the arc group 1150 occupying a small space.

In other words, conventionally, configuration is such that lines of differing lengths are shown in a space having a circular (including semicircular) shape centered around the rotation center of a pointer and a measured value is displayed by the length of a line to which among these lines, is identified by the pointer. In such a configuration, the lines are arcs (the arcs 1201 to 1211) centered around the rotation center of the pointer like the timepiece 1100, whereby the differences in the lengths of the lines may be increased and the measured value may be easily known.

Further, in the arc group 1150 depicted in FIG. 10, of the arcs 1201 to 1211, arcs that are nearer to the rotation center 1220 are relatively shorter. As a result, the arc 1201 that is outermost of the arcs 1201 to 1211 is the longest. Therefore, an outer edge of a display region having a circular shape centered around the rotation center 1220 is clear by the arc 1201 and the quality of the external appearance of the timepiece 1100 may be enhanced.

Further, for example, in the configuration described in Japanese Laid-Open Patent Publication No. 2016-142545, as described above a measured value is displayed using the pointer and the crescent-shaped index. Therefore, for example, when the remaining battery level is displayed by the thickness of the portion of the crescent-shaped index to which the pointer points, a problem arises in that the user has difficulty in using the crescent-shaped index to know the battery usage.

In contrast, in the timepiece 1100, the crescent-shaped index is realized by the arc group 1150 formed by the arcs 1201 to 1211, whereby the remaining battery level is displayed by the number of arcs that are in the pointing direction of the pointer 1140 and the battery usage may be displayed by the length of the arc identified by the pointer 1140. In other words, display of the remaining battery level and display of the battery usage may both be achieved by a single set of the pointer 1140 and the arc group 1150.

The arc group 1150 depicted in FIG. 10 is one example and, for example, provided that the number of arcs present in the pointing direction of the pointer 1140 as viewed from the rotation center 1220 differs according to the pointing direction of the pointer 1140, the arc group 1150 may be variously changed. For example, while a configuration in which the arc group 1150 includes eleven arcs (the arcs 1201 to 1211) is described, configuration may be such that the arc group 1150 includes two to 10 arcs, or twelve or more arcs.

Further, while a configuration in which the arc group 1150 is shown in a range (semicircular range) from a twelve-o'clock direction to a six-o'clock direction of the timepiece 1100, i.e., the arc 1201 that is longest in the arc group 1150 is an arc from a zero-o'clock direction to the six-o'clock direction is described, configuration is not limited hereto. For example, the arc group 1150 may be shown in a range (semicircular range) from the six-o'clock direction to the twelve-o'clock direction. In this case, the arc 1201 that is longest in the arc group 1150 is an arc from the six-o'clock direction to the twelve-o'clock direction. Additionally, the arc group 1150 may be shown in a range (fan-shape with a central angle of 90 degrees) from a three-o'clock direction to the six-o'clock direction, or may be shown in a range (region of a fan-shape with a central angle of 270 degrees) from the zero-o'clock direction to a nine-o'clock direction.

Further, while a configuration in which, of the arcs 1201 to 1211, arcs that are nearer to the rotation center 1220 are relatively shorter is described, configuration is not limited hereto. For example, of the arcs 1201 to 1211, arcs that are nearer to the rotation center 1220 may be relatively longer. Further, all of the lengths of the arcs 1201 to 1211 may be the same.

Furthermore, while a configuration in which the lengths of the arcs 1201 to 1211 serially increase in order of arrangement, configuration is not limited hereto. For example, configuration may be such that the lengths of the arcs 1201 to 1211 increase in order of arrangement by an equal interval.

Further, while a configuration in which the arcs 1201 to 1211 are arranged at constant intervals (predetermined unit Δr) is described, without limitation hereto, configuration may be such that the arcs 1201 to 1211 are arranged non-constant intervals.

Further, while a configuration in which the first ends of the arcs 1201 to 1211 are positioned along a single direction as viewed from the rotation center 1220 and the second ends of the arcs 1201 to 1211 are positioned in mutually differing directions from the rotation center 1220 is described, configuration is not limited hereto. For example, configuration may be such that the first ends of the arcs 1201 to 1211 are positioned in mutually differing positions from the rotation center 1220 and the second ends of the arcs 1201 to 1211 are also positioned in mutually differing directions from the rotation center 1220. Further, the first ends of the arcs 1201 to 1211 are the start points described above and are points corresponding to a high remaining battery level. The second ends of the arcs 1201 to 1211 are the start points described above and are points corresponding to a low remaining battery level.

Figure 11:
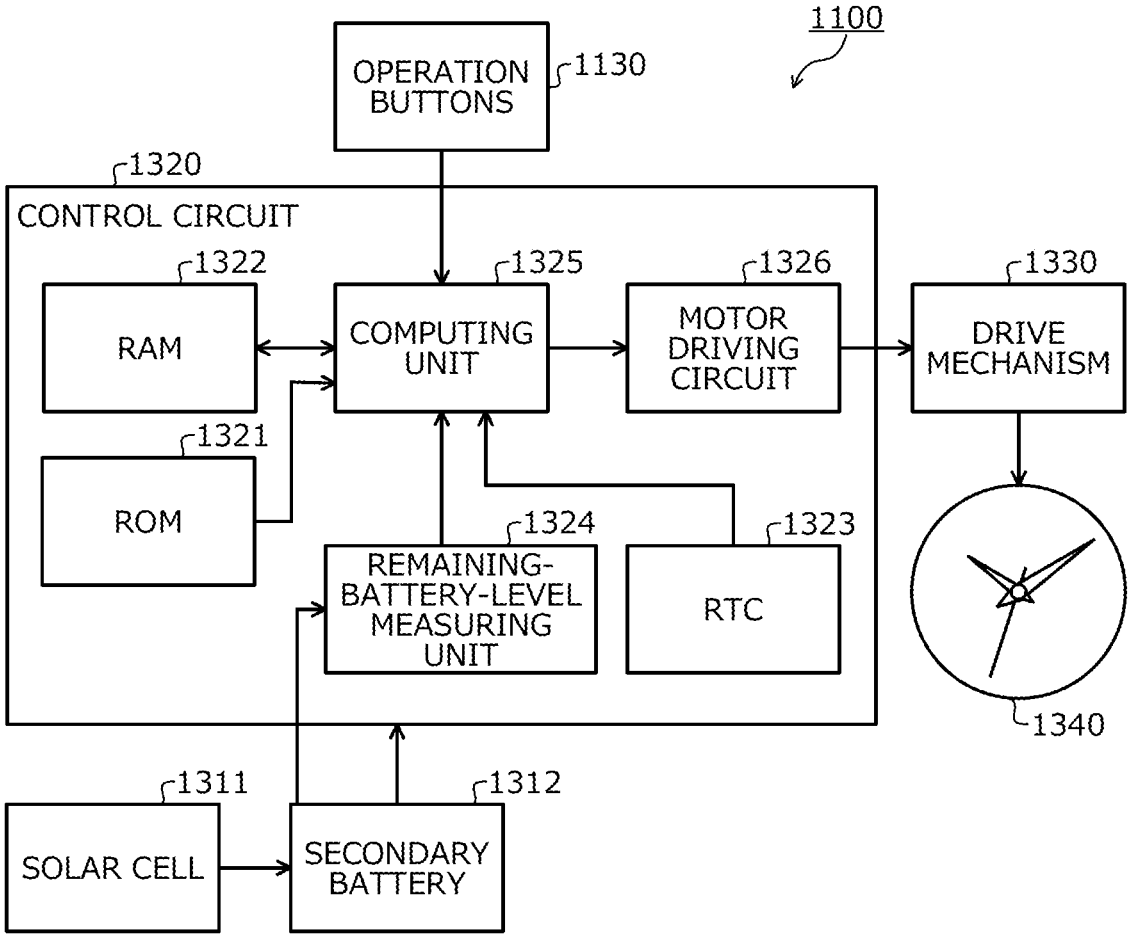
FIG. 11 is a diagram depicting an example of a hardware configuration of the timepiece according to the second embodiment.

FIG. 11 is a diagram depicting an example of a hardware configuration of the timepiece according to the second embodiment. In FIG. 11, parts identical to those depicted in FIG. 9 are given the same reference numerals used in FIG. 9 and description thereof is omitted hereinafter. As depicted in FIG. 11, the timepiece 1100 according to the second embodiment is realized by the operation buttons 1130, a solar cell 1311, the secondary battery 1312, a control circuit 1320, a drive mechanism 1330, and a display unit 1340.

The solar cell 1311, for example, is disposed at the rear side of the dial 1110 depicted in FIG. 9. Further, the solar cell 1311 generates power by external light such as sunlight irradiated on the timepiece 1100 and supplies the generated power to the secondary battery 1312. The secondary battery 1312 accumulates the power generated by the solar cell 1311. Further, the secondary battery 1312 supplies the accumulated power to circuits of the timepiece 1100, such as the control circuit 1320. The secondary battery 1312, for example, may be realized by a lithium-ion battery or the like.

The control circuit 1320 includes a ROM 1321, a RAM 1322, a RTC 1323, a remaining-battery-level measuring unit 1324, a computing unit (controller) 1325, and a motor driving circuit 1326. The control circuit 1320, for example, may be realized by an information processing apparatus such as a microcomputer.

The ROM 1321 is an auxiliary memory that stores therein data and various programs that operate the timepiece 1100. The ROM 1321, for example, is non-volatile memory such as a magnetic disk, flash memory, and the like. The RAM 1322 is a main memory used as a work area of the computing unit 1325 and to which data processed by the computing unit 1325 is written.

The RTC 1323 supplies a clock signal that is used for timing in the computing unit 132. For example, the RTC 1323 oscillates a crystal oscillator provided in the timepiece 1100 and thereby, generates a clock signal and supplies the generated clock signal to the computing unit 1325 as a reference signal.

The remaining-battery-level measuring unit 1324 measures, as the predetermined physical quantity described above, the remaining battery level in the secondary battery 1312 and outputs to the computing unit 1325, a measured value of the remaining battery level. Measurement of the remaining battery level by the remaining-battery-level measuring unit 1324, for example, may be performed by detecting output voltage of the secondary battery 1312. However, the method of measuring the remaining battery level is not limited hereto and any of various types of methods of measurement may be adopted.

The computing unit 1325 governs overall control of the timepiece 1100. For example, the computing unit 1325 performs various types of control by loading a program stored in the ROM 1321 onto the RAM 1322 and executing the program. For example, the computing unit 1325 counts the current time based on the clock signal supplied from the RTC 1323, and controls the motor driving circuit 1326 so that the measured current time is displayed by the display unit 1340.

The computing unit 1325 further controls the motor driving circuit 1326 so that the measured value of the remaining battery level output from the remaining-battery-level measuring unit 1324 is displayed by the display unit 1340. For example, the computing unit 1325, as described hereinafter, controls the motor driving circuit 1326 so that the pointing direction of the pointer 1140 included in the display unit 1340 is in a pointing direction corresponding to the measured value of the remaining battery level. An example of control of display of a measured value of the remaining battery level by the computing unit 1325 will be described hereinafter (for example, refer to FIG. 16).

The motor driving circuit 1326, under the control of the computing unit 1325, outputs a drive signal for driving a motor included in the drive mechanism 1330 described hereinafter. As a result, for example, a display time determined by the control circuit 1320, the remaining battery level of the secondary battery 1312 measured by the remaining-battery-level measuring unit 1324, and the like are displayed by the display unit 1340.

The drive mechanism 1330 includes the wheel train and the step-motor operated according to the drive signal output from the motor driving circuit 1326 described above and the wheel train transmits the rotation of the step-motor, whereby a pointer included in the display unit 1340 is rotated.

The display unit 1340, for example, includes the dial 1110, the hour hand 1121, the minute hand 1122, the second hand 1123, and the pointer 1140 depicted in FIG. 9. The pointers included in the display unit 1340 are rotated on the dial 1110, whereby information is displayed.

The operation buttons 1130 are operated by the user and output operation details thereof to the control circuit 1320. The control circuit 1320 executes various types of processes according to the input operation details received by the operation buttons 1130. The operation buttons 1130, for example, include the crown 1131, the first push-button 1132, and the second push-button 1133 depicted in FIG. 9.

Figure 12:
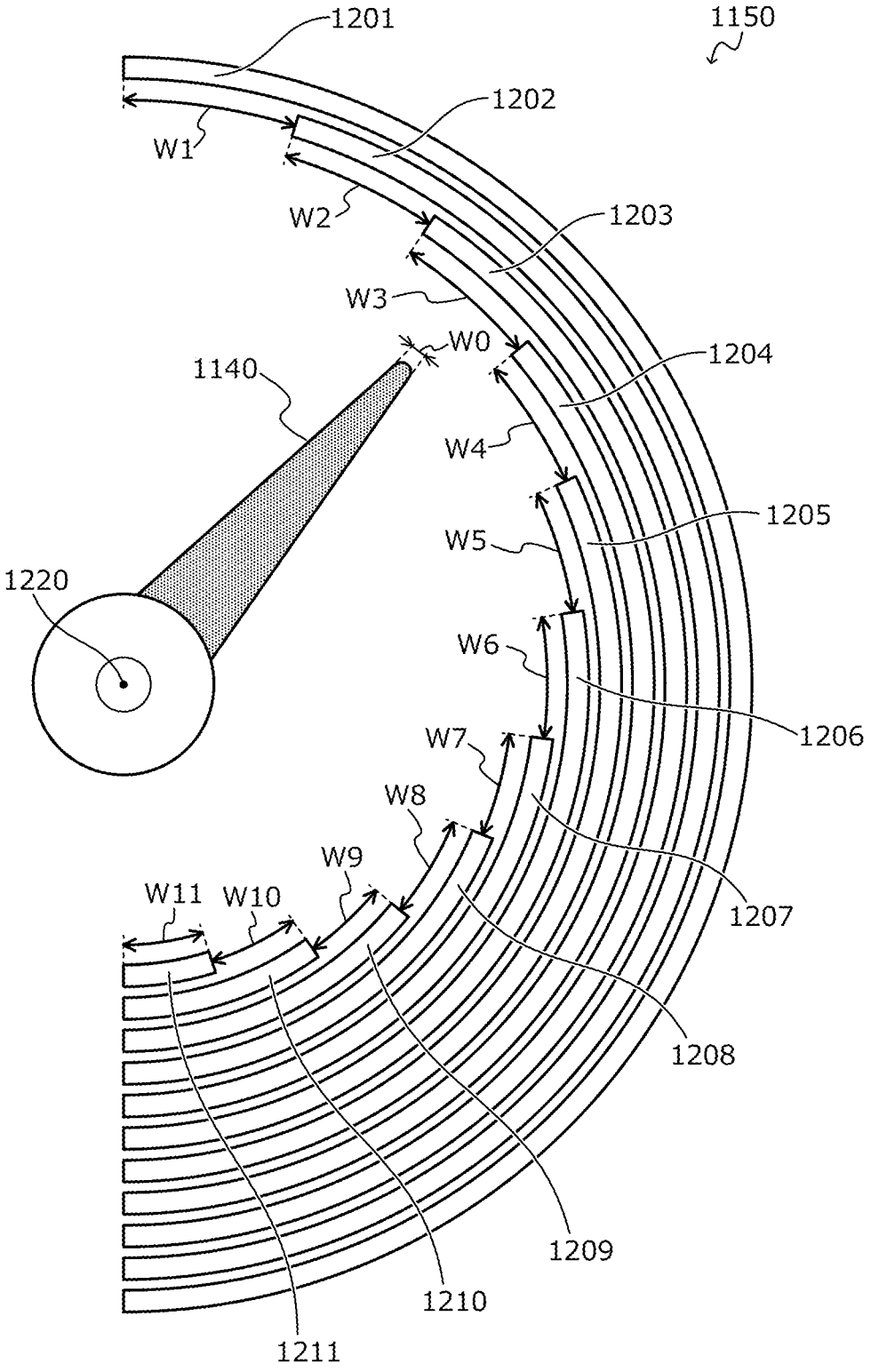
FIG. 12 is a diagram depicting an example of a width of a tip of a pointer according to the second embodiment.

FIG. 12 is a diagram depicting an example of a width of a tip of a pointer according to the second embodiment. In FIG. 12, portions similar to those depicted in FIG. 10 are given the same reference numerals used in FIG. 10 and description thereof is omitted hereinafter. Ranges W1 to W11 depicted in FIG. 12 are ranges defined by increasing lengths in order of arrangement of the arcs 1201 to 1211.

For example, the range W1 is a fan-shaped range from an end point of the arc 1201 to an end point of the arc 1202, as viewed from the rotation center 1220. The range W2 is a fan-shaped range from the end point of the arc 1202 to an end point of the arc 1203, as viewed from the rotation center 1220, and similarly for the ranges W3 to W10. For example, the range W10 is a fan-shaped range from an end point of the arc 1210 to an end point of the arc 1211, as viewed from the rotation center 1220. The range W11 is a fan-shaped range from the end point of the arc 1211 to the start point thereof, as viewed from the rotation center 1220.

As depicted in FIG. 12, relationships of differences in length are (difference in length between arcs 1201, 1202)>(difference in length between arcs 1202, 1203)>(difference in length between arcs 1203, 1204)>(difference in length between arcs 1204, 1205)>(difference in length between arcs 1205, 1206)>(difference in length between arcs 1206, 1207)>(difference in length between arcs 1207, 1208)>(difference in length between arcs 1208, 1209)>(difference in length between arcs 1209, 1210)>(difference in length between arcs 1210, 1211). In the example depicted in FIG. 12, a further relationship is (difference in length between arcs 1210, 1211)>(length of arc 1211). Therefore, relationships of range widths are (width of range W1)>(width of range W2)>(width of range W3)>(width of range W4)>(width of range W5)>(width of range W6)>(width of range W7)>(width of range W8)>(width of range W9)>(width of range W10)>(width of range W11).

W0 is a width of a tip of the pointer 1140, at an end in the pointing direction of the pointer 1140. The width W0 of the tip of the pointer 1140 is a minimum value of a difference in length between the arcs 1201 to 1211 and is a width less than the difference in length between the arcs 1210, 1211. As a result, a pointing range of the tip of the pointer 1140 is prevented from straddling three or more ranges of the ranges W1 to W11, and the ease of viewing by the user is enhanced.

For example, like the example depicted in FIG. 12, when the pointer 1140 points to a vicinity of a center of the range W3, the width W0 of the tip of the pointer 1140 is narrower than the difference in length of the arcs 1203, 1204, whereby it is clear that the pointer 1140 is pointing to the range W3. Therefore, the user may easily know that of the arcs 1201 to 1211, three arcs are present in the pointing direction of the pointer 1140. Further, for example, while the pointer 1140 may point to a vicinity of a border between the ranges W2, W3, whereby the pointing range of the tip of the pointer 1140 may straddle two of the ranges, the pointing range of the tip of the pointer 1140 is prevented from straddling three or more of the ranges.

Figure 13:
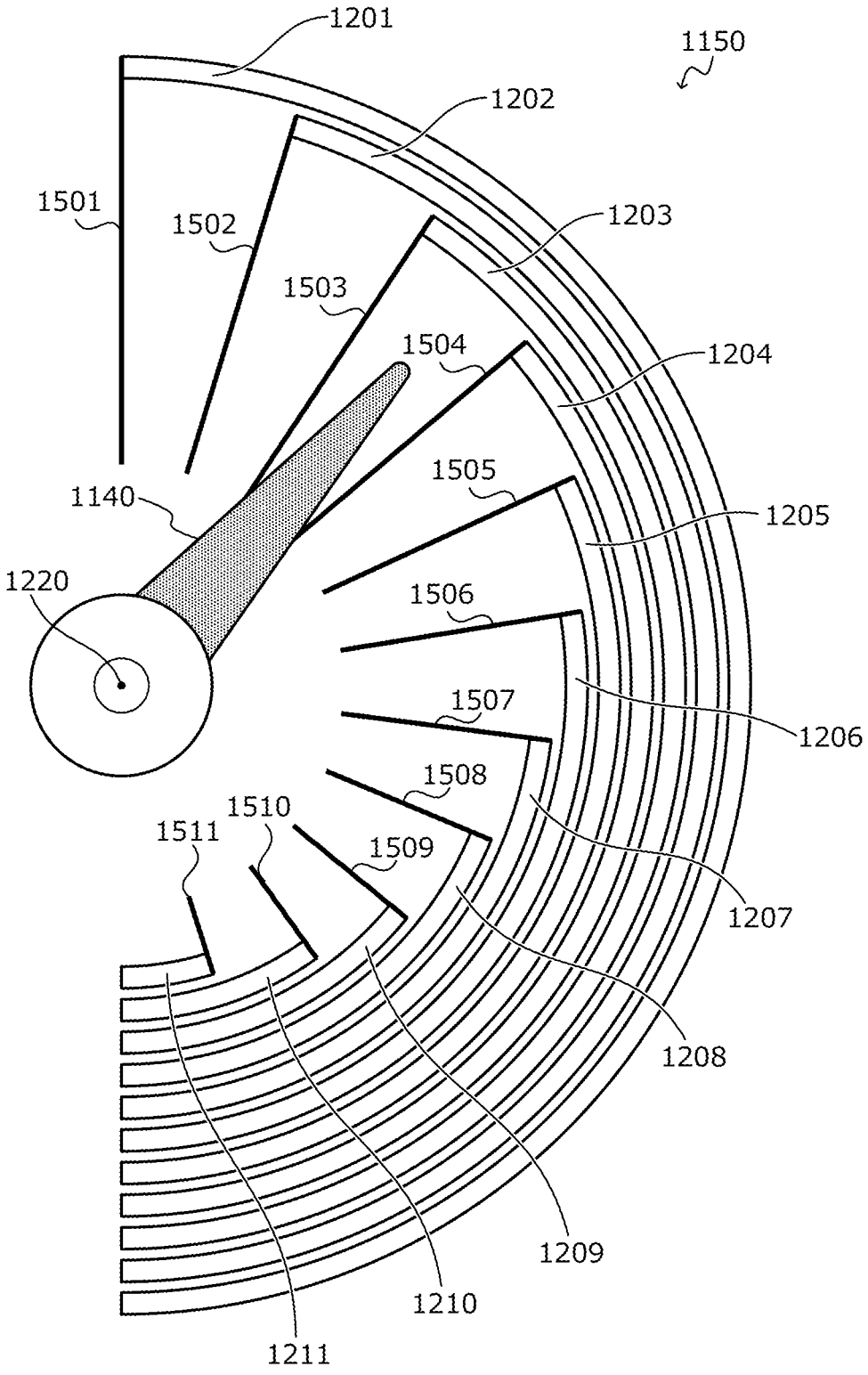
FIG. 13 is a diagram depicting an example of auxiliary indices of an arc group of a dial according to the second embodiment.

FIG. 13 is a diagram depicting an example of auxiliary indices of an arc group of a dial according to the second embodiment. In FIG. 13, parts depicted in FIG. 10 are given the same reference numerals used in FIG. 10 and description thereof is omitted hereinafter. In the dial 1110, for example, as depicted in FIG. 13, in addition to the arc group 1150 (the arcs 1201 to 1211), auxiliary indices 1501 to 1511 may be shown.

The auxiliary index 1501 is a line segment from the end point of the arc 1201 toward the rotation center 1220. Similarly, the auxiliary indices 1502 to 1511 are respectively line segments from end points of the arcs 1202 to 1211 toward the rotation center 1220. In other words, the auxiliary indices 1501 to 1511 are shown that are lines extending toward the rotation center of the pointer 1140, from first ends of the arcs 1202 to 1211, opposite second ends of the arcs 1202 to 1211 positioned along a same direction as viewed from the rotation center 1220 of the pointer 1140 of the arc group 1150. From the auxiliary indices 1502 to 1511, the user, for example, may easily recognize borders between the ranges W1 to W11 depicted in FIG. 12 and therefore, may easily count the arcs in the pointing direction of the pointer 1140.

Further, in the example depicted in FIG. 13, the auxiliary indices 1501 to 1511 have ends that are toward the rotation center 1220 and positioned on a same circle centered around the rotation center 1220. Therefore, of the auxiliary indices 1501 to 1511, the auxiliary index 1501 is a line segment that is longest, and the auxiliary indices 1502 to 1511 are line segments that are the second to eleventh longest, respectively.

As a result, for example, the user may easy know the range to which the pointer 1140 is pointing of the ranges W1 to W11 depicted in FIG. 12. For example, when the pointer 1140 points to the range W1 depicted in FIG. 12, a distance between the tip of the pointer 1140 and the nearest arc (the arc 1201) is relatively large. However, the auxiliary indices 1501, 1502 are relatively long and therefore, the user may easily recognize that the pointer 1140 is pointing to the range W1 between the auxiliary indices 1501, 1502. Therefore, the user may easily know that a single arc (the arc 1201) is positioned in the pointing direction of the pointer 1140.

The lengths of the auxiliary indices 1501 to 1511, for example, even when the pointer 1140 points to any one of the ranges W1 to W11 depicted in FIG. 12, may be set so that the tip of the pointer 1140 may be sandwiched between any of the auxiliary indices 1501 to 1511. As a result, the user may easily recognize to which of the ranges W1 to W11 the pointer 1140 is pointing.

Figure 14:
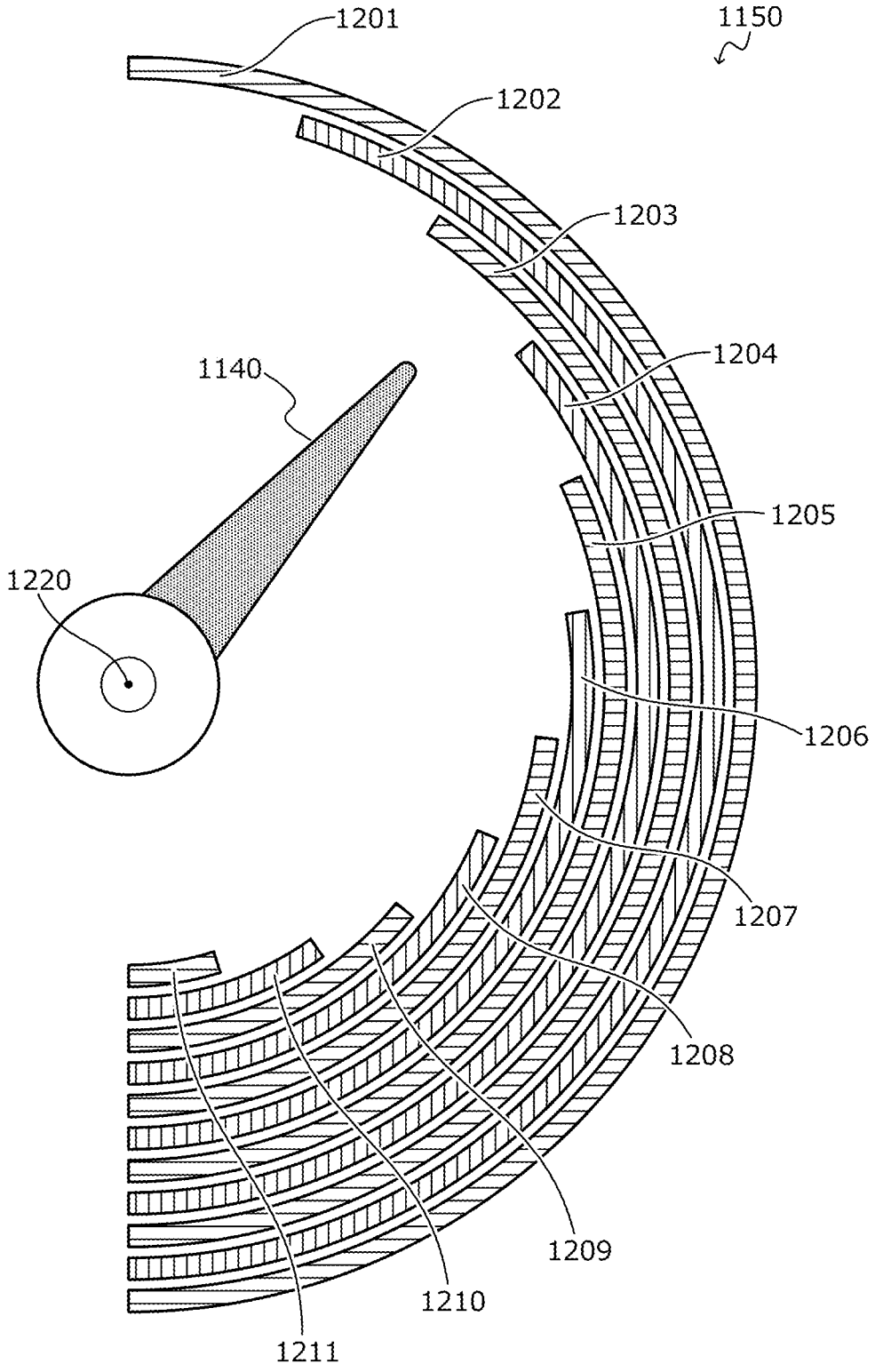
FIG. 14 is a diagram depicting an example of color coding of the arcs of the dial according the second embodiment.

FIG. 14 is a diagram depicting an example of color coding of the arcs of the dial according the second embodiment. In FIG. 14, parts identical to those depicted in FIG. 10 are given the same reference numerals used in FIG. 10 and description thereof is omitted hereinafter. In FIG. 14, patterns applied the arcs 1201 to 1211 represent colors of the arcs 1201 to 1211. In the example depicted in FIG. 14, the arcs 1201, 1203, 1205, 1207, 1209, 1211 are a first color, and the arcs 1202, 1204, 1206, 1208, 1210 are a second color different from the first color.

The color coding of the arcs 1201 to 1211, for example, may be performed by coloring with a paint or the like. As depicted in FIG. 14, of the arcs 1201 to 1211, arcs that are adjacent to each other have colors mutually different from each other, whereby of the arcs 1201 to 1211, the user may easily know the number of arcs present in the pointing direction of the pointer 1140. Further, for example, as described above, when the user wishes to know the battery usage, after an arc that is nearest the rotation center 1220 is identified from among the arcs that, of the arcs 1201 to 1211, are present in the pointing direction of the pointer 1140, the length of the identified arc may be known. Therefore, the battery usage may be easily known.

Figure 15:
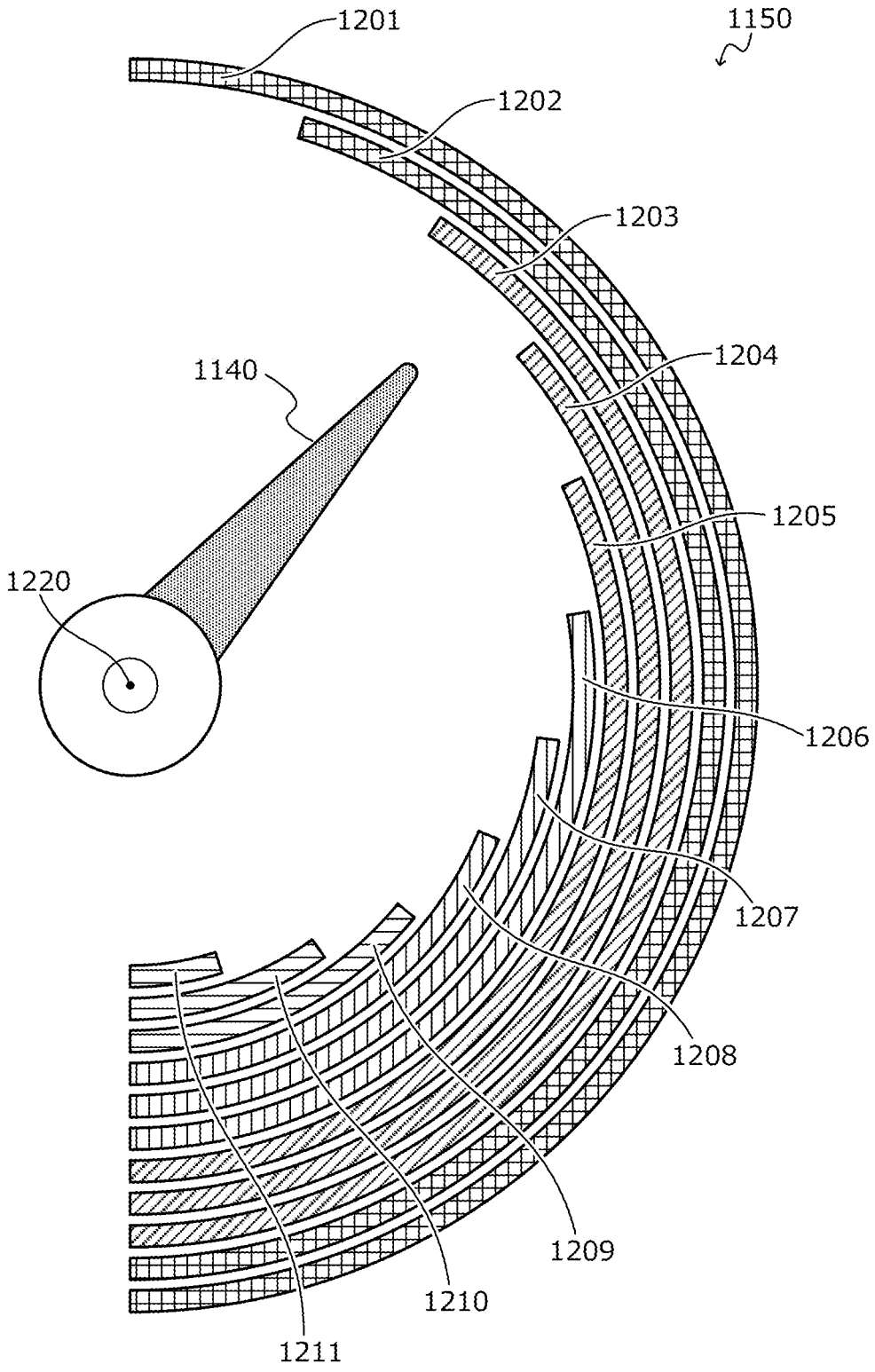
FIG. 15 is a diagram depicting another example of color coding the arcs of the dial according to the second embodiment.

FIG. 15 is a diagram depicting another example of color coding the arcs of the dial according to the second embodiment. In FIG. 15, parts identical to those depicted in FIG. 10 are given the same reference numerals used in FIG. 10 and description thereof is omitted hereinafter. In FIG. 15, patterns applied to the arcs 1201 to 1211 represent colors of the arcs 1201 to 1211. In the example depicted in FIG. 15, the arcs 1201, 1202 are the first color, and the arcs 1203 to 1205 are the second color different from the first color. Further, the arcs 1206 to 1208 are a third color different from the first and the second colors, and the arcs 1209 to 1211 are a fourth color different from the first to the third colors.

As depicted in FIG. 15, the arcs 1201 to 1211 may be such that every predetermined number of two or more arcs (in the example depicted in FIG. 15, three), sequentially toward the rotation center 1220, are a different color. Alternatively, the arcs 1201 to 1211 may be such that every predetermined number of two or more arcs, sequentially away from the rotation center 1220, are a different color. As a result, of the arcs 1201 to 1211, the user may easily know the number of arcs present in the pointing direction of the pointer 1140. Further, by using the same color for each predetermined number of arcs, the number of colors used for the dial 1110 may be suppressed.

Other than the examples depicted in FIGS. 14 and 15, for example, only one of the arcs 1201 to 1211 may be a color different from the color of the other arcs of the arcs 1201 to 1211. In other words, of the arcs, at least one site may be such that arcs adjacent to each other are different colors. Further, configurations depicted in FIGS. 13 to 15 may be combined. For example, as depicted in FIG. 13, in the configuration in which the auxiliary indices 1501 to 1511 are provided, color coding of the arcs 1201 to 1211 may be further performed.

Figure 16:
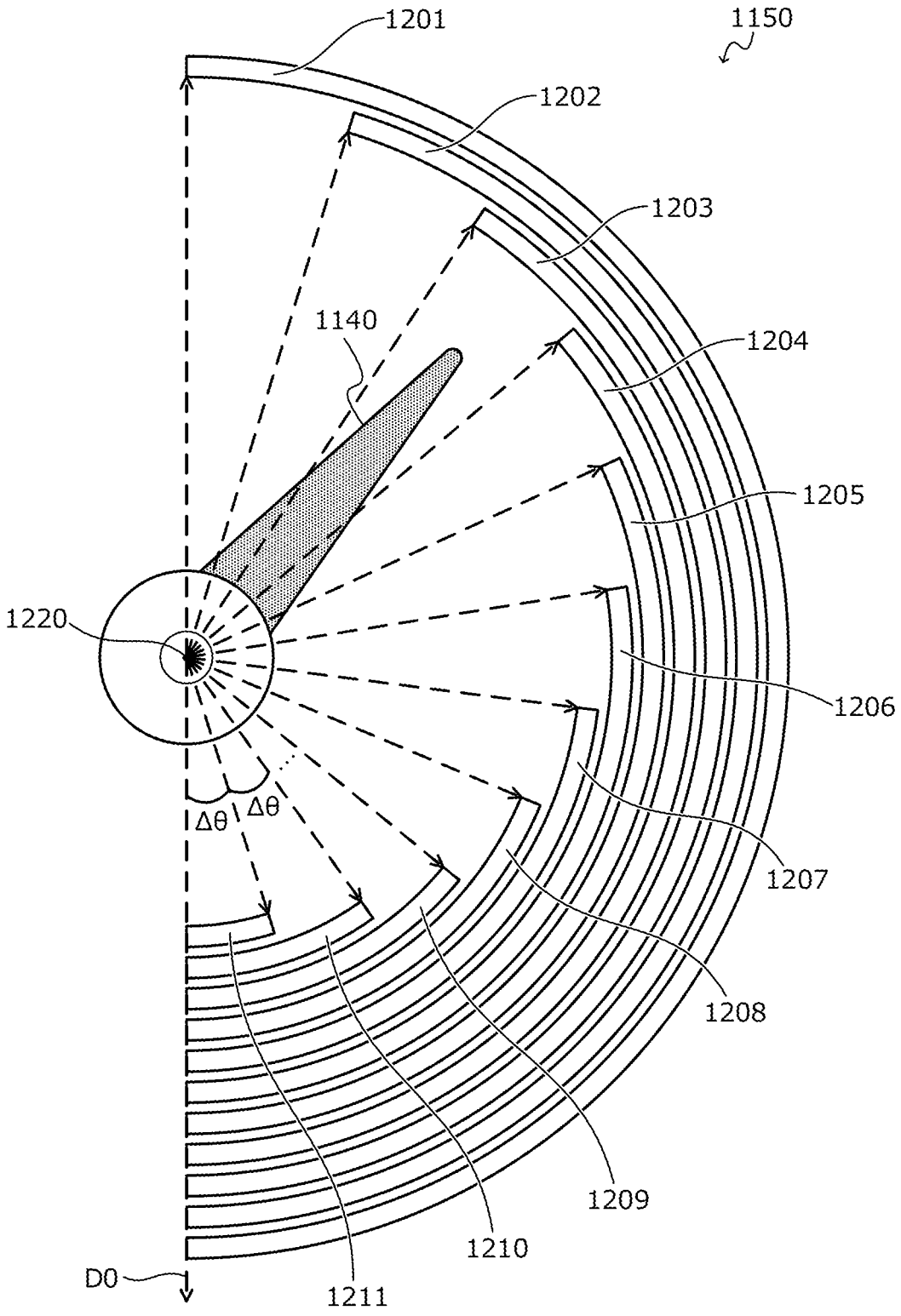
FIG. 16 is a diagram depicting an example of control of a pointer according to the second embodiment.

FIG. 16 is a diagram depicting an example of control of the pointer according to the second embodiment. In FIG. 16, parts identical to those depicted in FIG. 10 are given the same reference numerals used in FIG. 10 and description thereof is omitted hereinafter. As described above, the arcs 1201 to 1211 are arcs obtained by rotating in a same direction around the rotation center 1220, at mutually differing rotation angles, points that are positioned in a same direction from the rotation center 1220, at mutually differing distances from the rotation center 1220.

The rotation angles of the points for obtaining the arcs 1201 to 1211, for example, are equal intervals. This interval is assumed to be $\Delta\theta$ degrees (=180/11 degrees). For example, the arc 1211 is an arc obtained by rotating $\Delta\theta$ degrees counter-clockwise around the rotation center 1220, a point positioned along the reference direction D0 as viewed from the rotation center 1220.

The arc 1210 is an arc obtained by rotating $\Delta\theta\times2$ degrees counter-clockwise around the rotation center 1220, a point positioned along the reference direction D0 as viewed from the rotation center 1220, and similarly for the arcs 1201 to 1209. For example, the arc 1201 is an arc obtained by rotating $\Delta\theta\times11$ degrees counter-clockwise around the rotation center 1220, a point positioned along the reference direction D0 as viewed from the rotation center 1220.

As a result, the arcs 1201 to 1211 in serially ascending order of length are the arc 1211, the arc 1210, the arc 1209, the arc 1208, the arc 1207, the arc 1206, the arc 1205, the arc 1204, the arc 1203, the arc 1202, and the arc 1201. For example, when a radius of a circle that includes the arc 1211 is r1, the length of the arc 1211 is $2\times\pi\times r1\times(\Delta\theta/360)$. Further, when a radius of a circle that includes the arc 1210 is r2 ($=r1+\Delta r$), the length of the arc 1210 is $2\times\pi\times r2\times(\Delta\theta\times2/360)$ and similarly for the lengths of the arcs 1203 to 1211. For example, when a radius of a circle that includes the arc 1201 is r11 ($=r1+\Delta r\times10$), the length of the arc 1201 is $2\times\pi\times r11\times(\Delta\theta\times11/360)=\pi\times r11$.

Further, an angle between the pointing direction of the pointer 1140 and the reference direction D0 is inversely proportional to the number of arcs that of the arcs 1201 to 1211, are present in the pointing direction of the pointer 1140. Therefore, control of the rotation of the pointer 1140 with respect to changes in the remaining battery level is simple. For example, the computing unit 1325 depicted in FIG. 11 suffices to control the rotation of the pointer 1140 so that the angle between the pointing direction of the pointer 1140 and the reference direction D0 is inversely proportional (or proportional to the battery usage) to the measured value of the remaining battery level output from the remaining-battery-level measuring unit 1324.

Further, the computing unit 1325, for example, may discretize the measured value of the remaining battery level to a value of 11 levels. For example, the computing unit 1325 converts the measured value of the remaining battery level into any one of 0%, 10%, 20%, 30%, 40%, 50%, 60%, 70%, 80%, 90%, 100% by rounding the measured values.

Further, the computing unit 1325 controls the rotation of the pointer 1140 so that a center of the range W1 depicted in FIG. 12 is pointed to when the converted value is 0%. Similarly, the computing unit 1325 controls the rotation of the pointer 1140 so that centers of the ranges W2 to W11 depicted in FIG. 12 are pointed to respectively when the converted value is 10%, 20%, 30%, 40%, 50%, 60%, 70%, 80%, 90%, 100%, respectively. As a result, the user may know to which of the ranges W1 to W11 the pointer 1140 is pointing.

In this manner, the timepiece 1100 according to the second embodiment has a center that coincides with the rotation center 1220 of the pointer 1140, and the timepiece 1100 has the dial 1110 on which the arcs 1201 to 1211 that are included in the multiple circles having mutually differing radii are shown. The arcs 1201 to 1211 are shown so that as viewed from the rotation center 1220 of the pointer 1140, the number of arcs present in the pointing direction of the pointer 1140 differs according to the pointing direction of the pointer 1140.

Further, the timepiece 1100 controls the rotation of the pointer 1140 so that, of the arcs 1201 to 1211, the number of arcs present in the pointing direction of the pointer 1140 as viewed from the rotation center 1220 of the pointer 1140 corresponds to the remaining battery level measured by the remaining-battery-level measuring unit 1324. As a result, increased size of the display unit for the remaining battery level and degradation of the quality of the external appearance may be avoided and the user may easily know the measurement result.

For example, as described above, the user may count the arcs by moving the line of sight in a constant direction and thereby, may easily know the remaining battery level. Further, when the user wishes to know the battery usage, the user identifies an arc that is nearest the rotation center 1220 among the arcs present in the pointing direction of the pointer 1140 of the arcs 1201 to 1211, and looks at the length of the identified arc to, thereby, easily know the battery usage.

Further, even when space of the dial 1110 is limited, the arcs 1201 to 1211 having large differences in length are shown in a small space and therefore, the user may easily know the battery usage of the timepiece 1100. Further, a crescent-shaped index (the arc group 1150) that prevents degradation of the quality of the external appearance and enables the user to easily know the battery usage of the timepiece 1100 may be realized. Further, display of the remaining battery level and display of the battery usage may both be achieved by a single set of the pointer 1140 and the arc group 1150.

Figure 17:
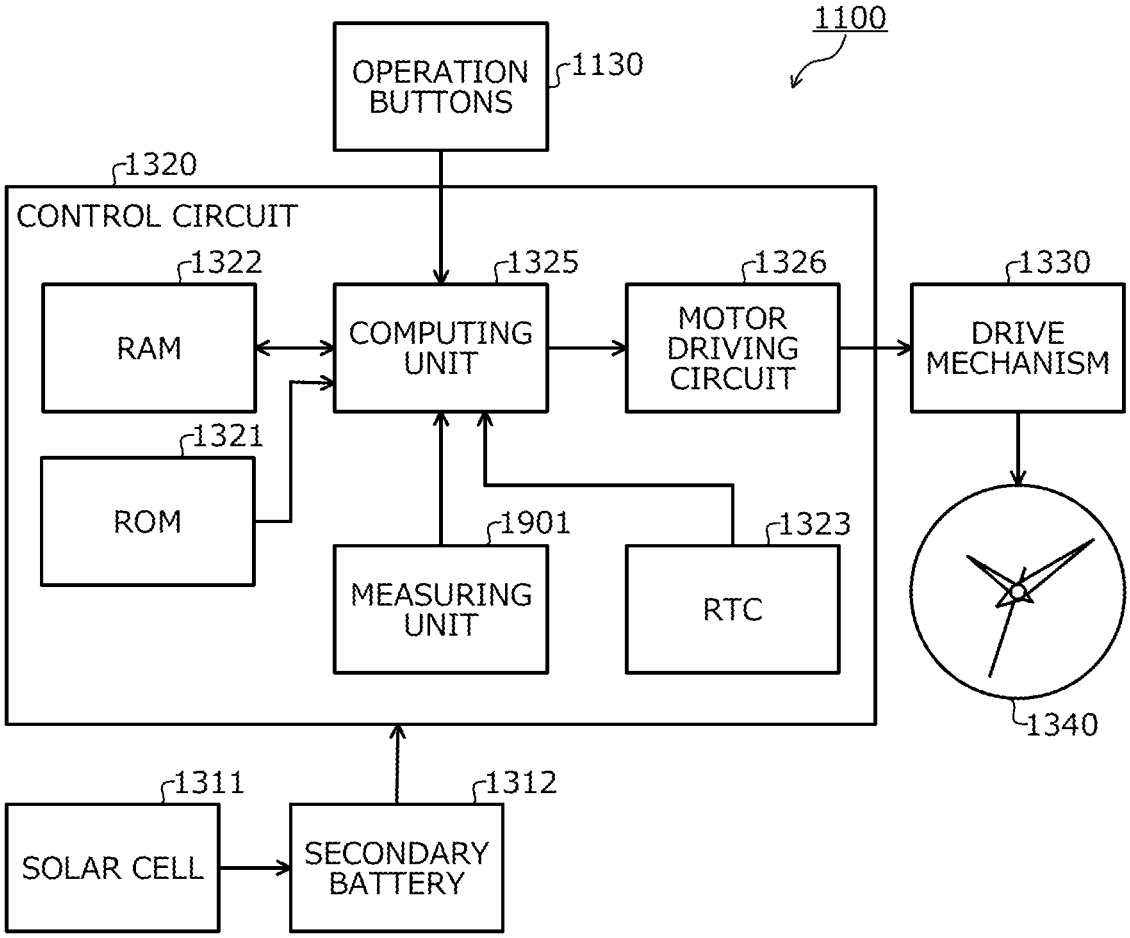
FIG. 17 is a diagram depicting another example of a hardware configuration of the timepiece according to the second embodiment.

FIG. 17 is a diagram depicting another example of a hardware configuration of the timepiece according to the second embodiment. In FIG. 17, parts identical to those depicted in FIG. 11 are given the same reference numerals used in FIG. 11 and description thereof is omitted hereinafter. While the predetermined physical quantity to be measured and displayed by the timepiece 1100, for example, as described above, is the remaining battery level of the timepiece 1100, the predetermined physical quantity is not limited to the remaining battery level of the timepiece 1100. For example, as depicted in FIG. 17, the timepiece 1100 may include the measuring unit 1901 instead of the remaining-battery-level measuring unit 1324 depicted in FIG. 11.

Alternatively, the timepiece 1100 may include the measuring unit 1901 and the remaining-battery-level measuring unit 1324 depicted in FIG. 11.

The measuring unit 1901 measures a quantity different from the remaining battery level of the timepiece 1100 and outputs to the computing unit 1325, a measured value obtained by the measurement. For example, the measuring unit 1901 measures a physical quantity related to a surrounding environment of the timepiece 1100, such as temperature, air pressure, humidity, illuminance, etc. Alternatively, for example, when the timepiece 1100 has a function of a pedometer, the measuring unit 1901 may measure the number of steps (number of predetermined vibrations) of the user.

Alternatively, for example, when the timepiece 1100 has a function of receiving wireless signals such as satellite radio waves, reference radio waves, and wireless communications signals, the measuring unit 1901 may measure reception strength or the like of these wireless signals. Further, the measuring unit 1901 may measure the amount of power generated by the solar cell 1311. Nonetheless, the quantity to be measured by the measuring unit 1901 is not limited hereto and may be any type of measurable physical quantity in the timepiece 1100.

The computing unit 1325 controls the motor driving circuit 1326 so that the measured value output from the measuring unit 1901 is displayed by the display unit 1340. In this manner, measurement and display of the predetermined physical quantity by the timepiece 1100 may be any type of physical quantity without limitation to the remaining battery level. According to the timepiece 1100, increased size of the display unit and degradation of the quality of the external appearance may be avoided and the user may easily know the measurement result of a physical quantity other than the remaining battery level.

In this manner, the measuring unit that measures a predetermined physical quantity to be displayed by the timepiece 1100 may be the remaining-battery-level measuring unit 1324 depicted in FIG. 11, or may be the measuring unit 1901 depicted in FIG. 17. In other words, a predetermined physical quantity to be measured and displayed by the timepiece 1100 may be the remaining battery level measured by the remaining-battery-level measuring unit 1324 depicted in FIG. 11, or may be a physical quantity that is other than the remaining battery level and that is measured by the measuring unit 1901 depicted in FIG. 17.

Further, the measuring unit that measures the predetermined physical quantity to be displayed by the timepiece 1100 may include both the remaining-battery-level measuring unit 1324 and the measuring unit 1901. In this case, for example, multiple combinations of the pointer 1140 and the arc group 1150 are provided on the dial 1110, whereby the timepiece 1100 is configured to display values measured by the remaining-battery-level measuring unit 1324 and values measured by the measuring unit 1901. In other words, the predetermined physical quantities to be measured and displayed by the timepiece 1100 may include both the remaining battery level measured by the remaining-battery-level measuring unit 1324 depicted in FIG. 11, and a physical quantity that is other than the remaining battery level and measured by the measuring unit 1901 depicted in FIG. 17.

Further, the measuring unit that measures the predetermined physical quantity to be displayed by the timepiece 1100 may include the measuring unit 1901 in plural, where the measuring units 1901 measure mutually different physical quantities (e.g., temperature and reception strength) excluding the remaining battery level. In this case, for example, plural combinations of the pointer 1140 and the arc group 1150 are provided on the dial 1110, whereby the timepiece 1100 displays the respective measured values of the plural measuring units 1901. In other words, the predetermined physical quantities to be measured and displayed by the timepiece 1100 may include plural physical quantities that are other than the remaining battery level and measured by the measuring unit 1901 depicted in FIG. 17.

As described above, according to the timepiece according to the second embodiment, decreases in the ease of viewing information may be suppressed. In particular, for example, increased size of the display unit of a physical quantity such as the remaining battery level and degradation of the quality of the external appearance may be prevented and the user may easily know the measurement result.

The timepiece according to a third embodiment will be described.

Figure 18:
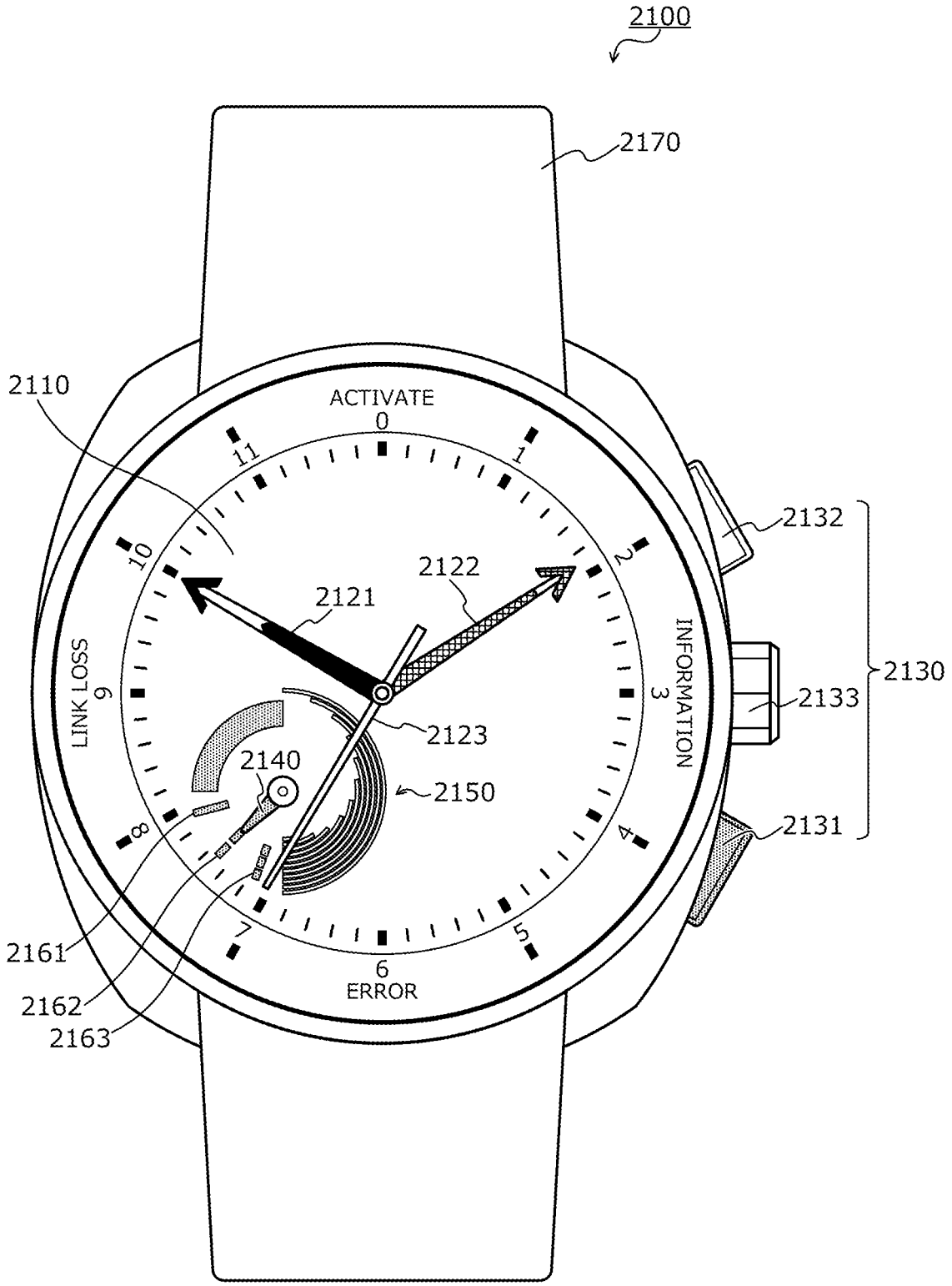
FIG. 18 is a diagram depicting an example of an external appearance of the timepiece according to a third embodiment.

FIG. 18 is a diagram depicting an example of an external appearance of the timepiece according to the third embodiment. As depicted in FIG. 18, a timepiece 2100 according to the third embodiment includes a dial (display face) 2110, an hour hand 2121, a minute hand 2122, a second hand 2123, and a pointer 2140 in a body that is a housing (case).

The hour hand 2121, the minute hand 2122, and the second hand 2123 are pointers that display the current time by pointing to indices or time (for example, "0", "1", "2", "3", "4", etc.) shown on the dial 2110. In the example depicted in FIG. 18, while the hour hand 2121 and the minute hand 2122 are pointers having the same length, sizes and positions of respective colored regions differ, thereby enabling the pointers to be distinguished from each other.

The hour hand 2121, the minute hand 2122, and the second hand 2123 may each be used to display information different from the current time. For example, while the hour and the minute of the current time is displayed by the hour hand 2121 and the minute hand 2122, information different from the second of the current time may be displayed by the second hand 2123. Such information-display by the second hand 2123 will be described hereinafter.

The timepiece 2100 has plural operation modes that are interchangeable with each other. These operation modes, for example, are operation states related to a predetermined function in the timepiece 2100. For example, the plural operation modes are operation modes related to information-display by the second hand 2123 and are operation modes for which the type of the information displayed by the second hand 2123 differs.

In this case, in the plural operation modes, the information displayed by the second hand 2123, for example, includes a measurement result obtained by measurement in the timepiece 2100. Further, in the plural operation modes, the information displayed by the second hand 2123 may include information received from an external communications device by the timepiece 2100.

As one example, the plural operation modes include an operation mode that displays by the second hand 2123, a cardinal direction measurement result obtained by the timepiece 2100; an operation mode that displays by the second hand 2123, a temperature measurement result obtained by the timepiece 2100; and an operation mode that displays by the second hand 2123, an altitude measurement result obtained by the timepiece 2100. A method of measuring and a method of displaying the cardinal direction, the temperature, and the altitude will be described hereinafter.

Nonetheless, the plural operation modes are not limited to operation modes related to information-display by the second hand 2123 and may be various types of operation modes that are interchangeable with each other. For example, the plural operation modes may be operation modes related to information-display by the hour hand 2121, the minute hand 2122, the pointer 2140, or another display member.

Alternatively, the plural operation modes may be operation modes related to an energy-saving function of the timepiece 2100. In this case, as one example, the plural operation modes include an operation mode in which the energy-saving function is ON, and an operation mode in which the energy-saving function is OFF. Further, in this case, as another example, the plural operation modes include an operation mode in which a first energy-saving function is ON, an operation mode in which a second energy-saving function for which an energy-saving level is lower than that of the first energy-saving function is ON, and an operation mode in which the energy-saving function is OFF. The energy-saving function will be described hereinafter (for example, refer to FIG. 27).

Alternatively, the plural operation modes may be operation modes related to a function of automatic correction of the internal time by the timepiece 2100 receiving a reference radio wave or the like. In this case, as one example, the plural operation modes include an operation mode that automatically corrects the internal time by a reception of a reference radio wave, and an operation mode that refrains from automatically correcting the internal time. Further, in this case, as another example, the plural operation modes include an operation mode that automatically corrects the internal time by a reception of a reference radio wave, an operation mode that automatically corrects the internal time by a reception of a GPS signal, and an operation mode that refrains from automatically correcting the internal time.

Alternatively, the plural operation modes may be operation modes for which time zones of the time displayed by the hour hand 2121, the minute hand 2122, and the second hand 2123 differ. In this case, as one example, the plural operation modes include an operation mode that displays the time of the time zone of Japan by the hour hand 2121, the minute hand 2122, and the second hand 2123; and an operation mode that displays the time of a time zone of a country other than Japan, by the hour hand 2121, the minute hand 2122 and the second hand 2123.

Alternatively, the plural operation modes may be operation modes having differing applications such as day-light savings time related to the time displayed by the hour hand 2121, the minute hand 2122, and the second hand 2123. In this case, as one example, the plural operation modes include an operation mode that, by the hour hand 2121, the minute hand 2122 and the second hand 2123, displays the time when day-light savings time is applicable; and an operation mode that, by the hour hand 2121, the minute hand 2122 and the second hand 2123, displays the time when day-light savings time is not applicable.

In this manner, the plural operation modes may be set to various types of operation modes that are interchangeable with each other in the timepiece 2100. Here, as one example, a case will be described in which the plural operation modes are an operation mode that displays the second of the current time by the second hand 2123; an operation mode that displays a cardinal direction measurement result by the second hand 2123; an operation mode that displays a temperature measurement result by the second hand 2123; and an operation mode that displays an altitude measurement result by the second hand 2123.

The pointer 2140, by pointing to any one of indices 2150 shown on the dial 2110, displays a measurement result obtained by measurement in the timepiece 2100. For example, the indices 2150 indicate a remaining battery level of the timepiece 2100, and the pointer 2140 displays a measured value of the remaining battery level of the timepiece 2100 by pointing to the indices 2150.

Figure 20:
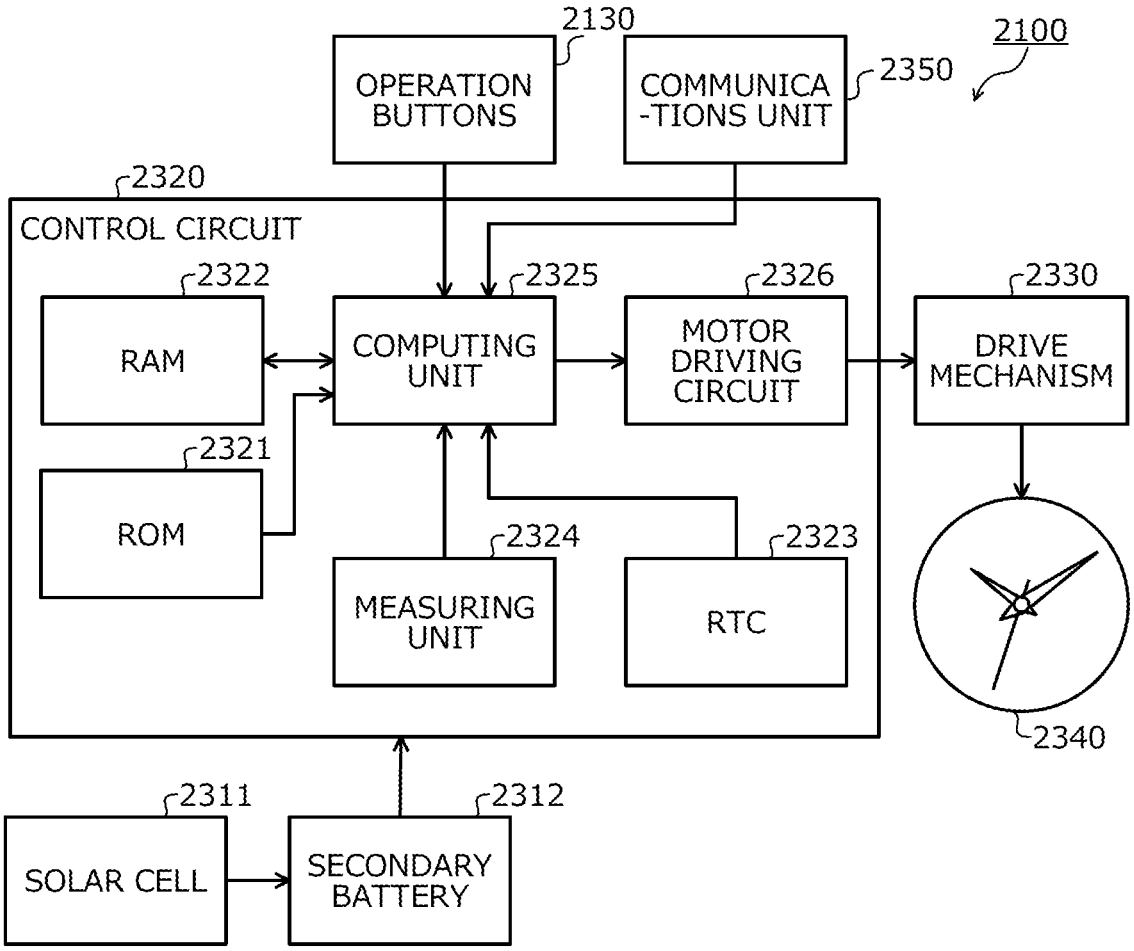
FIG. 20 is a diagram depicting an example of a hardware configuration of the timepiece according to the third embodiment.

In the example depicted in FIG. 18, a display unit that displays a current operation mode of the timepiece 2100 among the plural operation modes described above is configured by the pointer 2140, a portion of the dial 2110 in which a first mode mark 2161, a second mode mark 2162, and a third mode mark 2163 are shown, and a driving unit (for example, a motor driving circuit 2326 and a drive mechanism 2330 depicted in FIG. 20) of the pointer 2140. Hereinafter, the display unit may be referred to as "the display unit configured by the pointer 2140, etc."

The first mode mark 2161, the second mode mark 2162, and the third mode mark 2163 are shown corresponding to respectively different operation modes of the plural operation modes of the timepiece 2100 described above. Further, the pointer 2140 points to a mode mark that, of the first mode mark 2161, the second mode mark 2162 and the third mode mark 2163, corresponds to the current operation mode of the timepiece 2100.

For example, the first mode mark 2161 corresponds to an operation mode that displays a cardinal direction measurement result by the second hand 2123. The second mode mark 2162 corresponds to an operation mode that displays a temperature measurement result by the second hand 2123. The third mode mark 2163 corresponds to an operation mode that displays an altitude measurement result by the second hand 2123.

When the operation mode of the timepiece 2100 is the operation mode that displays a cardinal direction measurement result by the second hand 2123, the pointer 2140 points to the first mode mark 2161. Here, the timepiece 2100, by the second hand 2123, points to a predetermined cardinal direction (for example, north) identified by cardinal direction measurement and thereby, displays a measurement result of the predetermined cardinal direction. The cardinal direction measurement may be performed using a magnetic sensor and an acceleration sensor provided in the timepiece 2100.

Further, when the operation mode of the timepiece 2100 is the operation mode that displays a temperature measurement result by the second hand 2123, the pointer 2140 points to the second mode mark 2162. Here, the timepiece 2100 displays the temperature measurement result by the second hand 2123. Temperature measurement may be performed using a temperature sensor provided in the timepiece 2100. For example, in the timepiece 2100, the second displayed by the second hand 2123 is assumed to be associated with temperature. In this case, for example, when temperature measurement result is 20 degrees, the timepiece 2100 points in a direction (direction where "4" is shown) of 20 seconds by the second hand 2123, and when the temperature measurement result is 30 degrees, points in a direction (direction where "6" is shown) of 30 seconds by the second hand 2123.

Further, when the operation mode of the timepiece 2100 is the operation mode that displays an altitude measurement result by the second hand 2123, the pointer 2140 points to the third mode mark 2163. Here, the timepiece 2100 displays the altitude measurement result by the second hand 2123. Altitude measurement may be performed using an altitude sensor such as that of a GPS unit provided in the timepiece 2100. For example, in the timepiece 2100, each altitude obtained by measurement and the second displayed by the second hand 2123 are assumed to be associated by a predetermined rule. In this case, the timepiece 2100, by the second hand 2123, points in a direction of a second that corresponds to the altitude measurement result.

Further, when the operation mode of the timepiece 2100 is the operation mode that displays the second of the current time by the second hand 2123, the pointer 2140 points to a portion different from the first mode mark 2161, the second mode mark 2162, and the third mode mark 2163. For example, in this case, the timepiece 2100, by the pointer 2140, points to a portion of the indices 2150 corresponding to a measured value of the remaining battery level and thereby, displays that the operation mode of the timepiece 2100 is the operation mode that displays the second of the current time by the second hand 2123 and displays the measured value of the remaining battery level of the timepiece 2100.

In this manner, of the plural operation modes, the current operation mode of the timepiece 2100 is displayed by the display unit configured by the pointer 2140, etc.

Further, the timepiece 2100 includes as operation buttons 2130 that are operated by the user of the timepiece 2100 (receive a user operation), a first push-button 2131, a second push-button 2132, and a crown 2133 at a side surface of the body. In the example depicted in FIG. 18, the first push-button 2131 is disposed near a 4-hour index, here, equivalent to a first operation button. The second push-button 2132 is disposed near a 2-hour index and the crown 2133 is disposed near a 3-hour index. Here, the second push-button 2132 or the crown 2133 is equivalent to a second operation button.

The first push-button 2131 is an operation button for switching the operation mode of the timepiece 2100 described above. For example, each time the first push-button 2131 is pressed (pushed) by the user, the operation mode of the timepiece 2100 is switched and in conjunction with this, the operation mode to which the pointer 2140 points is switched. Switching of the operation mode of the timepiece 2100 by the first push-button 2131 will be described hereinafter (for example, refer to FIG. 21).

The second push-button 2132 is an operation button for performing an operation different from switching the operation mode of the timepiece 2100 described above. As one example, when the second push-button 2132 is pressed by the user, the timepiece 2100 receives a reference radio wave or the like and performs an operation of correcting the internal time. Nonetheless, without limitation to an operation performed by a pressing of the second push-button 2132, the operation may be any of various operations different from that of switching the operation mode of the timepiece 2100 described above. For example, when the second push-button 2132 is pressed, the operation mode related to information-display by the second hand 2123 described above may be switched to a different operation mode (for example, ON/OFF of the energy-saving function) (for example, refer to FIG. 27).

At least a part of a portion of the first push-button 2131, the portion visible to the user of the timepiece 2100 is an identical color or a similar color to a color (predetermined color) of at least a part of a portion of the display unit configured by the pointer 2140, etc., the portion visible to the user of the timepiece 2100. The portion visible to the user, for example, is a part that may be seen by the user at least in a state in which the user attempts to recognize the operation button for switching the operation mode of the timepiece 2100.

The state in which the user attempts to recognize the operation button for switching the operation mode of the timepiece 2100, for example, includes a state in which the user attempts to switch the operation mode of the timepiece 2100, and a state in which the user attempts to know in advance the operation button for switching the operation mode of the timepiece 2100 to switch the operation mode of the timepiece 2100 in the future.

The portion visible to the user, for example, includes a part that may be seen by the user when viewing the timepiece 2100 in a state in which the user is wearing the timepiece 2100 his or her wrist, or a state in which the timepiece 2100 is placed at an arbitrary location. Alternatively, the portion visible to the user may be a part that may be seen by the user when a specific condition is satisfied. For example, when the timepiece 2100 includes a cover that protects the dial 2110, the portion visible to the user may be a portion that becomes visible to the user by the user opening the cover. Further, as described hereinafter, when the timepiece 2100 includes a display, the part visible to the user may be a portion included in a screen displayed by the display according to an operation from the user.

At least a part of the portion visible to the user, for example, is a part or all of the portion that may be seen by the user at least in a state in which the user attempts to recognize the operation button for switching the operation mode of the timepiece 2100.

In the example depicted in FIG. 18, in the display unit configured by the pointer 2140, etc., the portion of the dial 2110 visible to the user of the timepiece 2100, for example, is a portion in the display unit configured by the pointer 2140, etc. and may be seen by the user through a transparent crystal described hereinafter. In particular, in the display unit configured by the pointer 2140, etc., the portion visible to the user of the timepiece 2100 is a front surface (surface on a side opposite that facing the dial 2110) of the pointer 2140, and the first mode mark 2161, the second mode mark 2162 and the third mode mark 2163 shown in the dial 2110.

In the example depicted in FIG. 18, at least the first mode mark 2161, the second mode mark 2162, the third mode mark 2163 and a front surface of a needle portion of the pointer 2140 excluding a circular portion near a rotation center (refer to FIG. 19) are a predetermined color (for example, yellow). A rear surface (surface on the side facing the dial 2110) of the pointer 2140 and the driving unit of the pointer 2140 may or may not be the predetermined color.

Alternatively, the first mode mark 2161, the second mode mark 2162, and the third mode mark 2163 may be a predetermined color while the pointer 2140 needs not be the predetermined color. Alternatively, the first mode mark 2161, the second mode mark 2162, and the third mode mark 2163 need not be the predetermined color while the pointer 2140 may the predetermined color.

Of the first push-button 2131, the portion visible to the user of the timepiece 2100, for example, is a portion of the first push-button 2131 exposed externally from a body of the timepiece 2100. In the example depicted in FIG. 18, the entire portion of the first push-button 2131 exposed externally from the body of the timepiece 2100 is a color (for example, yellow) identical or similar to a color (predetermined color) of at least a portion of the display unit configured by the pointer 2140, etc.

Further, only a part of the portion of the first push-button 2131 exposed externally from the body of the timepiece 2100 may be identical or similar in color to the color (predetermined color) of at least a portion of the display unit configured by the pointer 2140, etc. For example, a mark or the like identical or similar in color to the color (predetermined color) of at least a portion of the display unit configured by the pointer 2140, etc. may be provided in the portion of the first push-button 2131 exposed externally from the body of the timepiece 2100.

A color of parts in the timepiece 2100 described above may be a color of a material (for example, metal or resin) of the parts, or may be a color realized by coloring the parts.

In the example depicted in FIG. 18, as described above, the pointer 2140, the first mode mark 2161, the second mode mark 2162, and the third mode mark 2163 are a same color (for example, yellow). Further, of the first push-button 2131, a portion externally exposed from the body of the timepiece 2100 is entirely a color (for example, yellow) identical to the color of the pointer 2140, the first mode mark 2161, the second mode mark 2162, and the third mode mark 2163. Here, of the first push-button 2131, the portion exposed from the body of the timepiece 2100 may be a color that is not identical to but is similar to the color of the pointer 2140, the first mode mark 2161, the second mode mark 2162, and the third mode mark 2163.

Two colors that are similar means that while at least hue, saturation, and/or lightness between the two colors differs, the user recognizes that the two colors are the same color. For example, when two colors are chromatic colors and hues of these two colors are identical, the two colors are similar and when the hues of the two colors differ from each other, the two colors are not similar. Hue in this case, for example, is a so-called rough hue of red, yellow, green, blue, and violet. As one example, while dark yellow and light yellow are similar dark yellow and dark red are not similar.

Further, when two colors are achromatic colors and a difference in brightness between the two colors is small, the two colors are similar and when the difference in brightness is large, the two colors are not similar. As one example, white and light gray are similar while white and dark gray are not similar. Further, when two colors are a chromatic color and an achromatic color, respectively, the two colors are not similar. As one example, black and yellow are not similar.

For example, the dial 2110 overall is assumed to be black, while the first mode mark 2161, the second mode mark 2162, and the third mode mark 2163 are assumed to be shown in yellow on the dial 2110. In this case, the first push-button 2131 is also yellow. In other words, the color of the first mode mark 2161, the second mode mark 2162 and the third mode mark 2163, and the color of the first push-button 2131 are identical or similar colors since the hues thereof are identical.

Further, the second push-button 2132 and the crown 2133 included among the operation buttons 2130 are not identical or similar in color to the first push-button 2131. As one example, the color of the first push-button 2131 is yellow while the color of the second push-button 2132 and the crown 2133 is black. In other words, other than the first push-button 2131, the timepiece 2100 does not include operation buttons that are operated by the user and that are identical or similar in color to the first mode mark 2161, the second mode mark 2162, and the third mode mark 2163.

As a result, the user may be easily (intuitively) recognize that the operation button for switching the operation mode of the timepiece 2100 displayed by the display unit configured by the pointer 2140, etc. is the first push-button 2131 of the operation buttons 2130.

Further, the display unit configured by the pointer 2140, etc. is provided on the dial 2110 of a color (for example, black) not identical or similar to the color (for example, yellow) used for the display unit. As a result, the color (for example, yellow) used for the display unit configured by the pointer 2140, etc. stands out in the dial 2110, thereby enabling the user to recognize a correspondence relationship between the display unit and the first push-button 2131 for which a color is used that is identical or similar to the color used for the display unit. Therefore, the user may easily recognize that the operation button for switching the operation mode of the timepiece 2100 displayed by the display unit configured by the pointer 2140, etc. is the first push-button 2131.

Further, the first push-button 2131 for switching the operation mode of the timepiece 2100 is the operation button that, of the operation buttons 2130, is provided nearest the display unit configured by the pointer 2140, etc. As a result, the user may easily recognize the correspondence relationship between the display unit configured by the pointer 2140, etc. and the first push-button 2131 for which a color is used that is identical or similar to the color used for the display unit. Therefore, the user may easily recognize that the operation button for switching the operation mode of the timepiece 2100 displayed by the display unit configured by the pointer 2140, etc. is the first push-button 2131.

Further, the display unit configured by the pointer 2140, etc. and the first push-button 2131 are both provided in a region of a lower half of a main body part (portion of the timepiece 2100 excluding a strap 2170) of the timepiece 2100. The region of the lower half of the main body part of the timepiece 2100, for example, when the main body part of the timepiece 2100 is divided into two regions by a line connecting a position of a 3-hour index (notation "3") and a position of a 9-hour index (notation "9"), is a region that includes the position of the 6-hour index (notation "6") of the two regions. The display unit configured by the pointer 2140, etc. and the first push-button 2131 are both provided in the region of the lower half of the main body part of the timepiece 2100, whereby the user may easily recognize the correspondence relationship between the display unit configured by the pointer 2140, etc. and the first push-button 2131. As a result, the user may easily recognize that the operation button for switching the operation mode of the timepiece 2100 displayed by the display unit configured by the pointer 2140, etc. is the first push-button 2131.

A crystal formed using a transparent material such as a glass is attached to the body of the timepiece 2100 so as to cover the dial 2110. Further, a case back is attached to the body of the timepiece 2100, on a first side of the body, opposite a second side of the body where the crystal is attached. Hereinafter, in the timepiece 2100, a side toward the disposed crystal (direction opposite viewing direction in FIG. 18) is called a front side, and in the timepiece 2100, a side toward the disposed case back (viewing direction in FIG. 18) is called a rear side. The strap 2170 is attached to the body of the timepiece 2100 so that the timepiece 2100 is portable by the user of the timepiece 2100 wrapping the strap 2170 around his/her wrist.

The timepiece 2100 may be a solar-powered timepiece powered by light energy. For example, a solar cell is disposed at a rear side of the dial 2110 and power is generated in the solar cell by light entering from a front side thereof. Therefore, the dial 2110 is formed using a material that transmits light to a certain extent. The power generated by solar cell accumulates in a secondary battery (for example, a secondary battery 2312 depicted in FIG. 20) and the power accumulated in the secondary battery is used as a power source of the timepiece 2100. The secondary battery, for example, may be realized by a lithium-ion battery or the like. The pointer 2140 and the indices 2150, for example, display a remaining level of the secondary battery.

An external appearance of the timepiece 2100 depicted in FIG. 18 is an example and the external appearance of the timepiece 2100 is not limited hereto. For example, the body may be square instead of round, and the presence/absence, quantity, arrangement, shape, etc. of the crown 2133 and the like may be arbitrarily changed. Further, a date display unit and/or pointer for displaying various types of information such as day, daylight savings time, radio wave reception state, etc. may be added.

Further, while description is given regarding a configuration in which the timepiece 2100 is a wristwatch, the timepiece 2100 is not limited to such a configuration. For example, the timepiece 2100 may be a clock such as a pocket watch, a table dock, a wall dock, etc. Further, while description is given regarding a configuration in which the timepiece 2100 is an analog clock that displays the current time by a pointer, the configuration is not limited hereto.

For example, the timepiece 2100 may be a digital clock that displays the current time by numeric values or an audio clock that gives notification of the time by sound. Further, the timepiece 2100 may be a clock (for example, smartwatch) that gives notification of the current time by displaying, by a display, an image depicting a time displaying unit of an analog clock or digital clock.

When the timepiece 2100 includes a display, for example, the pointer 2140, the first mode mark 2161, the second mode mark 2162, and the third mode mark 2163 may be a virtual pointer and mode mark realized by an image displayed by the display.

According to the timepiece 2100 depicted in FIG. 18, as described above, the user may easily recognize that the operation button for switching the operation mode displayed by the display unit configured by the pointer 2140, etc. is the first push-button 2131.

Further, according to the timepiece 2100 depicted in FIG. 18, for example, increases in the size of the timepiece 2100 for securing space necessary for notations such as character strings and degradation of the quality of the external appearance of the timepiece 2100 by notations such as character strings may be avoided as compared to a configuration in which character strings describing that the operation button near the display unit configured by the pointer 2140, etc. and for switching the operation mode is the first push-button 2131.

Further, according to the timepiece 2100 depicted in FIG. 18, for example, identical or similar colors are used for the first push-button 2131 and the display unit configured by the pointer 2140, etc., thereby enabling the user to easily recognize the correspondence relationship between the first push-button 2131 and the display unit configured by the pointer 2140, etc. as compared to a configuration in which only the first push-button 2131 is disposed near the display unit configured by the pointer 2140, etc.

Figure 19:
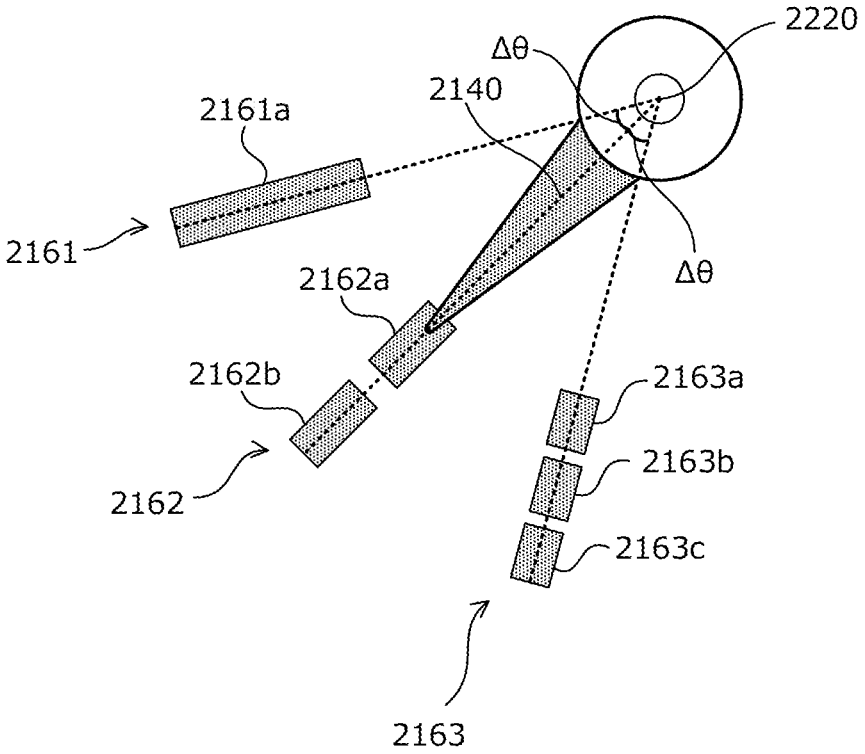
FIG. 19 is a diagram depicting an example of a display unit that displays an operation mode of the timepiece according to the third embodiment.

FIG. 19 is a diagram depicting an example of the display unit that displays the operation mode of the timepiece according to the third embodiment. A rotation center 2220 depicted in FIG. 19 is the rotation center (rotation axis) of the pointer 2140. The first mode mark 2161 is realized by a single rectangle 2161*a* of a color (for example, yellow) identical or similar to the color of the first push-button 2131. The rectangle 2161*a* is disposed so that the rotation center 2220 is disposed positioned on a straight line that is parallel to a longitudinal direction of the rectangle 2161*a* and passes through a center of the rectangle 2161*a*.

The second mode mark 2162 is realized by two rectangles 2162*a*, 2162*b* of a color (for example, yellow) that is identical or similar to the color of the first push-button 2131. The rectangles 2162*a*, 2162*b* are rectangles obtained by rotating the rectangle 2161*a* around the rotation center 2220 by a rotation angle $\Delta\theta$ and dividing the rotated rectangle 2161*a* into two by a line in a latitudinal direction. Therefore, the rotation center 2220 is positioned on straight lines that are parallel to the longitudinal directions of the rectangles 2162*a*, 2162*b* and that pass through centers of the rectangles 2162*a*, 2162*b*.

The third mode mark 2163 is realized by three rectangles 2163*a*, 2163*b*, 2163*c* that are of a color (for example, yellow) identical or similar to the color of the first push-button 2131 and that are shorter in the longitudinal direction that are the rectangles 2162*a*, 2162*b*. The rectangles 2163*a*, 2163*b*, 2163*c* are rectangles obtained by rotating the rectangle 2161*a* around the rotation center 2220 by the rotation angle $\Delta\theta\times2$ and dividing the rectangle 2161*a* into three by two lines in the latitudinal direction. Therefore, the rotation center 2220 is positioned on a straight line that is parallel to the longitudinal direction of the rectangles 2163*a*, 2163*b*, 2163*c* and that passes through centers of the rectangles 2163*a*, 2163*b*, 2163*c*.

Therefore, rotation of the pointer 2140 around the rotation center 2220 is controlled, whereby any one of the mode marks among the first mode mark 2161, the second mode mark 2162 and the third mode mark 2163 may be pointed to by the pointer 2140. Further, the first mode mark 2161, the second mode mark 2162, and the third mode mark 2163 are respectively realized by rectangles of differing quantities and lengths, thereby enabling each to be distinguished from each other. For example, the user may remember which mode mark represents which operation mode such as the first mode mark 2161 of a single rectangle represents cardinal direction display, the second mode mark 2162 of two rectangles represents temperature display, and the third mode mark 2163 of three rectangles represents altitude display.

Further, the second mode mark 2162 and the third mode mark 2163 are realized by rectangles obtained by dividing the first mode mark 2161 and therefore, the first mode mark 2161, the second mode mark 2162, and the third mode mark 2163 may be given a sense of unity. Therefore, the user may easily recognize that the first mode mark 2161, the second mode mark 2162, and the third mode mark 2163 represent the operation modes (for example, operation modes for operations of the second hand 2123) that may be switched to one another in the timepiece 2100.

FIG. 20 is a diagram depicting an example of a hardware configuration of the timepiece according to the third embodiment. In FIG. 20, parts identical to those depicted in FIG. 18 are given the same reference numerals used in FIG. 18 and description thereof is omitted hereinafter. As depicted in FIG. 20, the timepiece 2100 according to the third embodiment is realized by the operation buttons 2130, a solar cell 2311, the secondary battery 2312, a control circuit 2320, the drive mechanism 2330, a display apparatus 2340, and a communications unit 2350.

The solar cell 2311, for example, is disposed at the rear side of the dial 2110 depicted in FIG. 18. Further, the solar cell 2311 generates power by external light such as sunlight irradiated on the timepiece 2100 and supplies the generated power to the secondary battery 2312. The secondary battery 2312 accumulates the power generated by the solar cell 2311. Further, the secondary battery 2312 supplies the accumulated power to circuits of the timepiece 2100 such as the control circuit 2320. The secondary battery 2312, for example, may be realized by a lithium-ion battery or the like.

The control circuit 2320 includes a ROM 2321, a RAM 2322, a RTC 2323, a measuring unit 2324, a computing unit (controller) 2325, and the motor driving circuit 2326. The control circuit 2320, for example, maybe realized by an information processing apparatus such as a microcomputer.

The ROM 2321 is auxiliary memory that stores therein data and various types of programs that operate the timepiece 2100. The ROM 2321, for example, is non-volatile memory such as a magnetic disk, flash memory, and the like. The RAM 2322 is a main memory that is used as a work area of the computing unit 2325 and to which data processed by the computing unit 2325 is written.

The RTC 2323 supplies a clock signal that is used for timing in the computing unit 2325. For example, the RTC 2323 oscillates a crystal oscillator included in the timepiece 2100 and thereby, generates a clock signal and supplies the generated clock signal to the computing unit 2325 as a reference signal.

The measuring unit 2324 measures a measureable physical quantity in the timepiece 2100 and outputs to the computing unit 2325, a measured value obtained by the measurement. A physical quantity measured by the measuring unit 2324, for example, includes the remaining battery level of the secondary battery 2312. In this case, measurement of the remaining battery level by the measuring unit 2324, for example, may be performed by detecting output voltage of the secondary battery 2312. Nonetheless, a method of measuring the remaining battery level is not limited hereto and various methods of measurement are possible.

Further, the physical quantity measured by the measuring unit 2324 may be the cardinal direction described above, temperature, altitude or the like and may be a physical quantity for which a measured value is displayed in the mode represented by the first mode mark 2161, the second mode mark 2162, and the third mode mark 2163. For example, a physical quantity measured by the measuring unit 2324 includes the remaining battery level in the secondary battery 2312, the cardinal direction, the temperature and the altitude described above. In this case, the measuring unit 2324 may be realized by a circuit that measures remaining battery level in the secondary battery 2312, a circuit that measures the cardinal direction, a circuit that measures the temperature, and a circuit that measures the altitude.

The computing unit 2325 governs overall control of the timepiece 2100. For example, the computing unit 2325 performs various types of control by loading a program stored in the ROM 2321 onto the RAM 2322 and executing the program. For example, the computing unit 2325 counts the current time based on the clock signal supplied from the RTC 2323 and controls the motor driving circuit 2326 so that the counted current time is displayed by the display apparatus 2340.

Further, the computing unit 2325 controls the motor driving circuit 2326 so that the measured value output from the measuring unit 2324 is displayed by the display apparatus 2340. Further, in the plural operation modes described above, when the information to be displayed by the second hand 2123 includes information received from an external communications device by the timepiece 210, the computing unit 2325 may control the motor driving circuit 2326 so that the information output from the communications unit 2350 described hereinafter is displayed by the display apparatus 2340.

The motor driving circuit 2326, under the control of the computing unit 2325, outputs a drive signal for driving a motor included in the drive mechanism 2330 described hereinafter. As a result, for example, the current time counted by the control circuit 2320 and each measured value obtained by the measuring unit 2324 are displayed by the display apparatus 2340.

The drive mechanism 2330 includes the wheel train and the step-motor operated according to the drive signal output from the motor driving circuit 2326 described above and the wheel train transmits the rotation of the step-motor, whereby a pointer included in the display apparatus 2340 is rotated.

The display apparatus 2340, for example, includes the dial 2110, the hour hand 2121, the minute hand 2122, the second hand 2123, and the pointer 2140 depicted in FIG. 18. The pointers included in the display apparatus 2340 are rotated on the dial 2110, whereby information is displayed.

The communications unit 2350 communicates with an external communications device of the timepiece 2100. The communications unit 2350, for example, is a communications unit that performs wireless communication such as that of Bluetooth and Wi-Fi with an external communications device. Alternatively, the communications unit 2350 may be a communications unit that communicates with an external communications device by a wired connection such a USB cable. An external communications device, for example, may be an information terminal such as a personal computer or a smartphone, or may be a server configured to communicate via various types of networks.

The communications unit 2350, for example, under the control of the computing unit 2325, outputs to the computing unit 2325, information received from an external communications device. The information received from the external communications device by the communications unit 2350, for example, may be various types of information such as weather information like a weather forecast, user schedule information registered in an external communications device, etc. receivable from an external communications device.

The operation buttons 2130 are operated by the user and output operation details thereof to the control circuit 2320. The control circuit 2320 executes various types of processes according to the input operation details received by the operation buttons 2130. The operation buttons 2130, for example, include the first push-button 2131, the second push-button 2132, and the crown 2133 depicted in FIG. 18. For example, the computing unit 2325 of the control circuit 2320 sequentially switches the operation modes described above, each time the first push-button 2131 included among the operation buttons 2130 is pushed.

Figure 21:
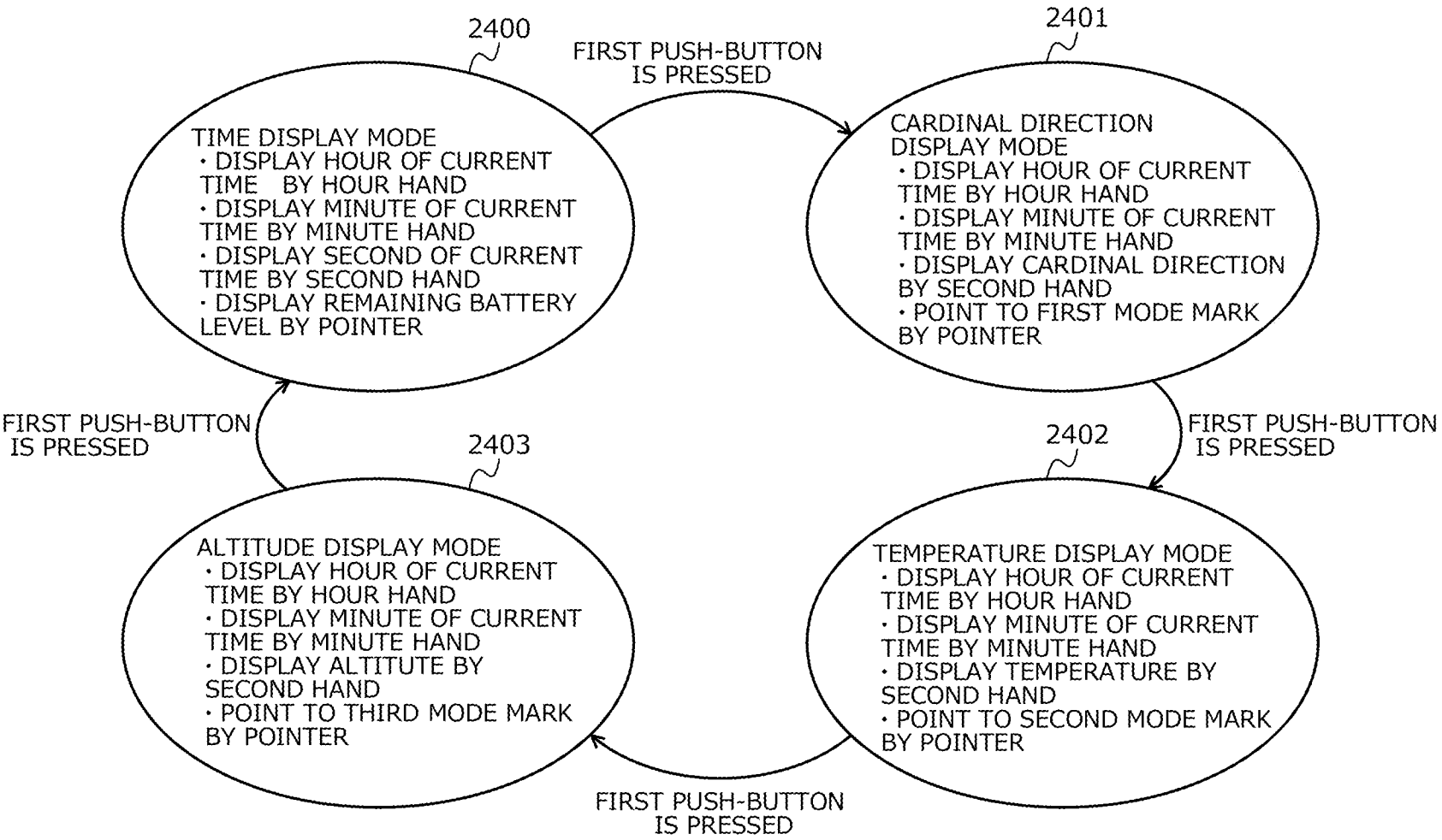
FIG. 21 is a state transition diagram of one example of each operation mode for operation of the timepiece according to the third embodiment.

FIG. 21 is a state transition diagram of one example of each operation mode for operation of the timepiece according to the third embodiment. The operation mode of the timepiece 2100 according to the third embodiment, for example, is switched to a time display mode 2400, a cardinal direction display mode 2401, a temperature display mode 2402, and an altitude display mode 2403 depicted in FIG. 21.

These operation modes are each an operation mode that displays the hour of the current time by the hour hand 2121 and the minute of the current time by the minute hand 2122. Therefore, in any of these operation modes, the computing unit 2325 depicted in FIG. 20 controls the motor driving circuit 2326 so that the hour and the minute of the current time counted based on the clock signal from the RTC 2323 are displayed by the hour hand 2121 and the minute hand 2122, respectively. Meanwhile, these operation modes display different information by the second hand 2123.

The timepiece 2100 displays which of the operation modes is the current operation mode of the timepiece 2100 by the display unit configured by the pointer 2140, etc.

The time display mode 2400 is the operation mode that displays the second of the current time by the second hand 2123. In the time display mode 2400, the computing unit 2325 controls the motor driving circuit 2326 so that the second of the current time counted based on the clock signal from the RTC 2323 is displayed by the second hand 2123.

Further, in the time display mode 2400, the computing unit 2325 controls the motor driving circuit 2326 so that the pointer 2140 points to a portion different from the first mode mark 2161, the second mode mark 2162, and the third mode mark 2163. As a result, the user may know that the current operation mode of the timepiece 2100 is the time display mode 2400 and not the cardinal direction display mode 2401, the temperature display mode 2402, or the altitude display mode 2403.

For example, in the time display mode 2400, the computing unit 2325 controls the motor driving circuit 2326 so that, of the indices 2150, the pointer 2140 points to a position that corresponds to the measured value of the remaining battery level output from the measuring unit 2324. As a result, the user may know that the current operation mode of the timepiece 2100 is the time display mode 2400 and may additionally know the measured value of the remaining battery level.

The time display mode 2400 is a default mode of the operation modes depicted in FIG. 21. In the time display mode 2400, when the first push-button 2131 is pressed, the timepiece 2100 transitions to the cardinal direction display mode 2401.

The cardinal direction display mode 2401 is the operation mode that displays a measurement result of the cardinal direction by the second hand 2123. In the cardinal direction display mode 2401, the computing unit 2325 controls the motor driving circuit 2326 so that based on the measured value of the cardinal direction output from the measuring unit 2324, the second hand 2123 points to a predetermined cardinal direction. Further, in the cardinal direction display mode 2401, the computing unit 2325 controls the motor driving circuit 2326 so that the pointer 2140 points to the first mode mark 2161. In the cardinal direction display mode 2401, when the first push-button 2131 is pressed, the timepiece 2100 transitions to the temperature display mode 2402.

The temperature display mode 2402 is the operation mode that displays a temperature measurement result by the second hand 2123. In the temperature display mode 2402, the computing unit 2325 controls the motor driving circuit 2326 so that a measured value of the temperature output from the measuring unit 2324 is displayed by the second hand 2123. Further, in the temperature display mode 2402, the computing unit 2325 controls the motor driving circuit 2326 so that the pointer 2140 points to the second mode mark 2162. In the temperature display mode 2402, when the first push-button 2131 is pressed, the timepiece 2100 transitions to the altitude display mode 2403.

The altitude display mode 2403 is the operation mode that displays an altitude measurement result by the second hand 2123. In the altitude display mode 2403, the computing unit 2325 controls the motor driving circuit 2326 so that a measured value of the altitude output from the measuring unit 2324 is displayed by the second hand 2123. Further, in the altitude display mode 2403, the computing unit 2325 controls the motor driving circuit 2326 so that the pointer 2140 points to the third mode mark 2163. In the altitude display mode 2403, when the first push-button 2131 is pressed, the timepiece 2100 transitions to the time display mode 2400.

In this manner, each time the first push-button 2131 is pressed, the operation mode of the timepiece 2100 switches in an order of the time display mode 2400, the cardinal direction display mode 2401, the temperature display mode 2402, the altitude display mode 2403, and the time display mode 2400.

When the pointer 2140 points to the indices 2150, the user may know that the operation of the timepiece 2100 is the time display mode 2400, in other words, the second hand 2123 is displaying the second of the current time. Further, when the pointer 2140 points to the first mode mark 2161, the user may know that the operation of the timepiece 2100 is the cardinal direction display mode 2401, in other words, the second hand 2123 displays a cardinal direction measurement result.

Further, when the pointer 2140 points to the second mode mark 2162, the user may know that the operation of the timepiece 2100 is the temperature display mode 2402, in other words, the second hand 2123 displays a temperature measurement result. Further, when the pointer 2140 points to the third mode mark 2163, the user may know that the operation of the timepiece 2100 is the altitude display mode 2403, in other words, the second hand 2123 displays an altitude measurement result.

For example, the user knows the current operation mode of the timepiece 2100 from the display unit configured by the pointer 2140, etc. and is assumed to wish to switch the operation mode. Here, as described above, a color (for example, yellow) identical or similar to a color (for example, yellow) used for the display unit configured by the pointer 2140, etc. is used for the first push-button 2131. Therefore, the user may easily know that by operating the first push-button 2131, the operation mode may be switched.

Figure 22:
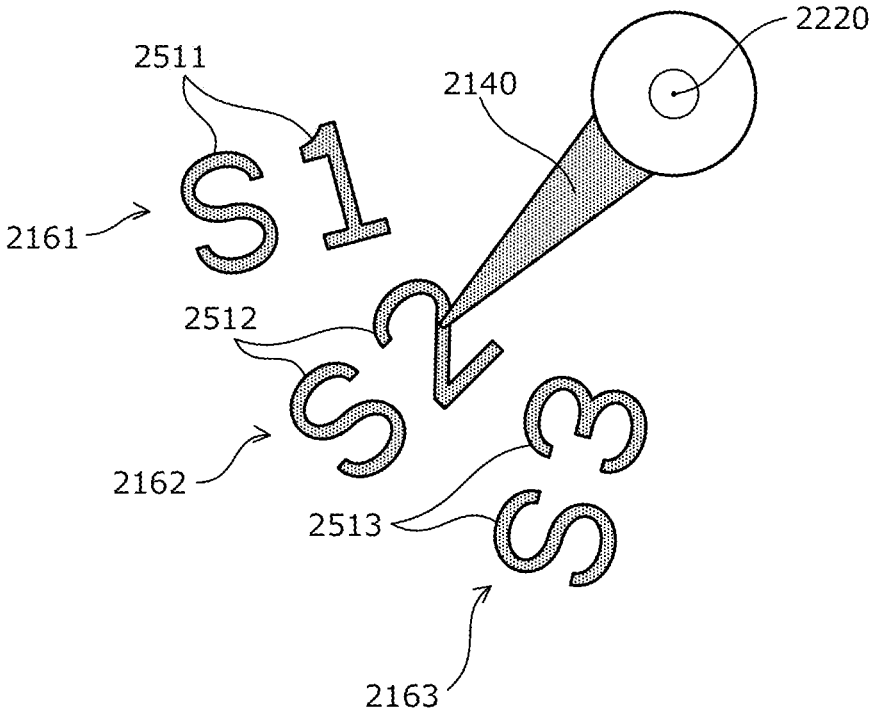
FIG. 22 is a diagram depicting another example of the mode marks of the timepiece according to the third embodiment.

FIG. 22 is a diagram depicting another example of the mode marks of the timepiece according to the third embodiment. In FIG. 22, parts identical to those depicted in FIG. 19 are given the same reference numerals used in FIG. 19 and description thereof is omitted hereinafter. As depicted in FIG. 22, the first mode mark 2161 may be realized by a character string 2511 "S1" instead of the rectangle 2161*a* depicted in FIG. 19.

Similarly, the second mode mark 2162 may be realized by a character string 2512 "S2" instead of the rectangles 2162*a*, 2162*b* depicted in FIG. 19. Further, the third mode mark 2163 may be realized by a character string 2513 "S3" instead of the rectangles 2163*a*, 2163*b*, 2163*c* depicted in FIG. 19. In this case, for example, colors of the character strings 2511 to 2513 may be a color (for example, yellow) identical or similar to the color used for the first push-button 2131.

Figure 23:
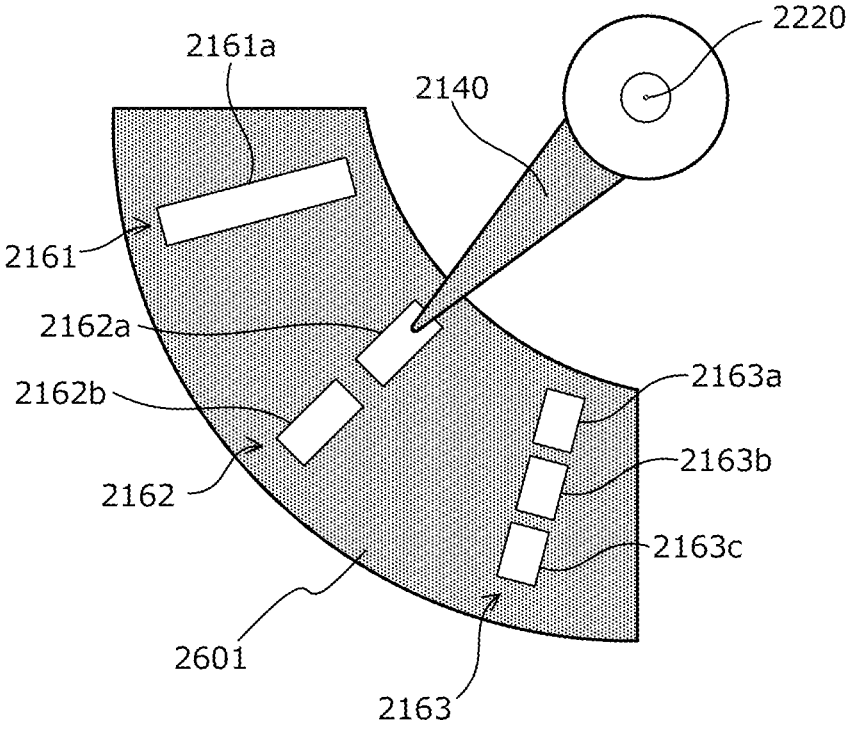
FIG. 23 is a diagram depicting another example of the display unit that displays the operation mode of the timepiece according to the third embodiment.

FIG. 23 is a diagram depicting another example of the display unit that displays the operation mode of the timepiece according to the third embodiment. In FIG. 23, parts identical to those depicted in FIG. 19 are given the same reference numerals used in FIG. 19 and description thereof is omitted hereinafter. As depicted in FIG. 23, the display unit that displays the operation mode of the timepiece 2100 may include a surrounding region 2601 in addition to the pointer 2140, the first mode mark 2161, the second mode mark 2162, and the third mode mark 2163.

The surrounding region 2601 is shown on the dial 2110 depicted in FIG. 18 so as to surround the first mode mark 2161, the second mode mark 2162, and the third mode mark 2163. A periphery of the surrounding region 2601 has a shape obtained by dividing a ring centered around the rotation center 2220 into quarters, and surrounds the first mode mark 2161, the second mode mark 2162, and the third mode mark 2163.

Furthermore, the surrounding region 2601 has a color (for example, yellow) identical or similar to the color (for example, yellow) used for the first push-button 2131. In this case, colors of the first mode mark 2161, the second mode mark 2162, and the third mode mark 2163 need not be a color (for example, yellow) identical or similar to the color (for example, yellow) used for the first push-button 2131. As one example, colors of the first mode mark 2161, the second mode mark 2162, and the third mode mark 2163 may be black, similarly to a portion of the dial 2110 not having a notation.

Further, in the display unit that displays the operation mode of the timepiece 2100 and is depicted in FIG. 23, the color of the pointer 2140 needs not be a color identical or similar to the color used for the first push-button 2131. In this manner, in the display unit that displays the operation mode of the timepiece 2100, a portion having a color identical or similar to the color used for the first push-button 2131 is not limited to the first mode mark 2161, the second mode mark 2162 and the third mode mark 2163 that correspond to the operation modes and, for example, may be the surrounding region 2601 surrounding the markers.

Further, for example, in the configuration depicted in FIG. 22, similarly to the configuration depicted in FIG. 23, the color of the region surrounding the character strings 2511 to 2513 may be a color identical or similar to the color used for the first push-button 2131. In this case, the color of the character strings 2511 to 2513 needs not be a color identical or similar to the color used for the first push-button 2131.

Figure 24:
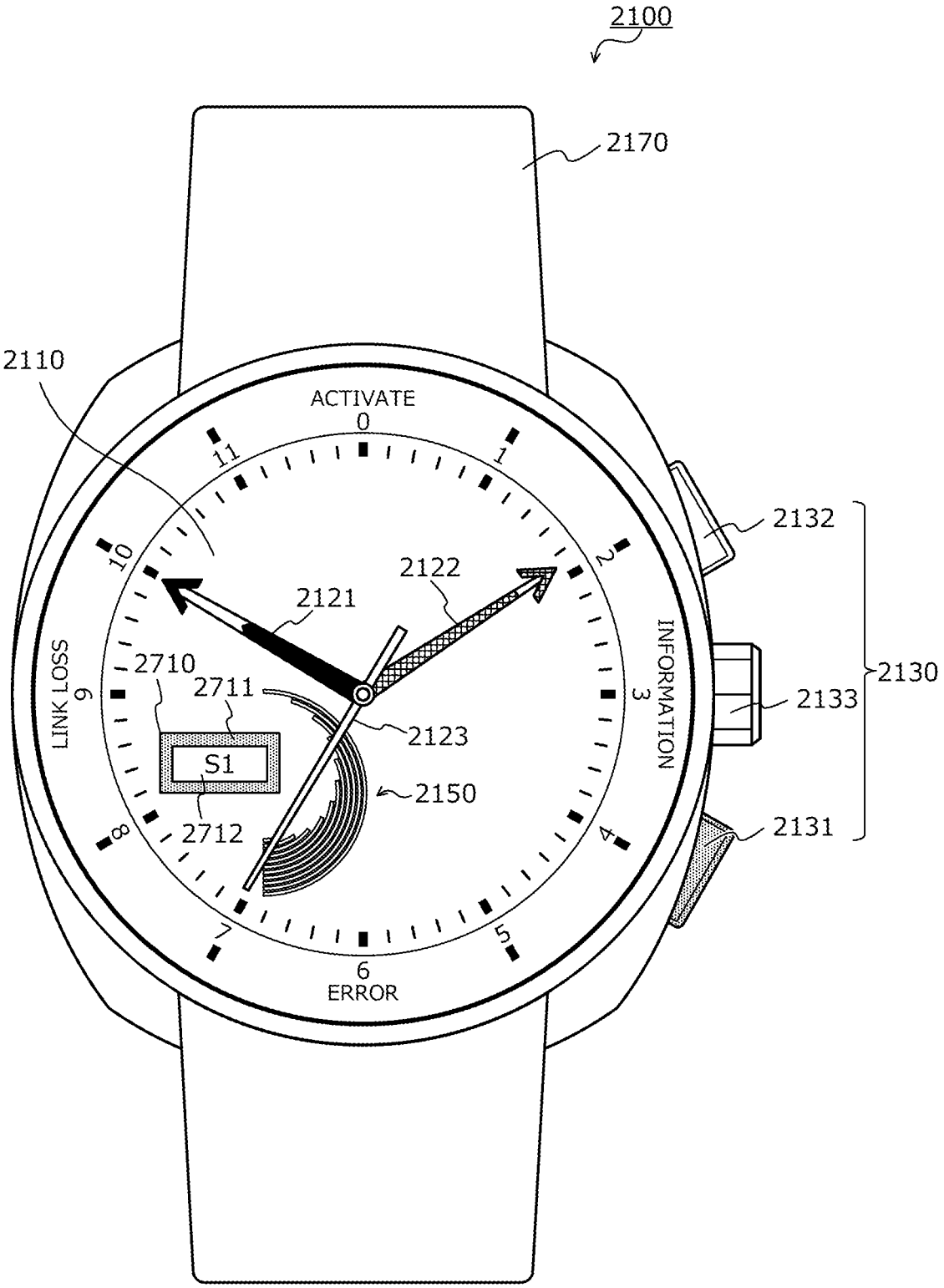
FIG. 24 is a diagram depicting another example of the display unit that displays the operation mode of the timepiece according to the third embodiment.

FIG. 24 is a diagram depicting another example of the display unit that displays the operation mode of the timepiece according to the third embodiment. In FIG. 24, parts identical to those depicted in FIG. 18 are given the same reference numerals used in FIG. 18 and description thereof is omitted hereinafter. As depicted in FIG. 24, the display unit that displays the operation mode of the timepiece 2100 may be realized by a display window 2710 instead of the pointer 2140, the first mode mark 2161, the second mode mark 2162, and the third mode mark 2163 depicted in FIG. 18.

The display window 2710 has a window frame 2711 and a rotating disk 2712. The window frame 2711 is a frame provided in a periphery of an opening provided in the dial 2110. The rotating disk 2712 is a rotating disk that is disposed at the rear side of the dial 2110 and in which only a portion thereof positioned in the opening surrounded by the window frame 2711 is exposed on the dial 2110.

The rotating disk 2712, for example, has notations such as "S1", "S2", "S3" depicted in FIG. 22 and representing the operation modes of the timepiece 2100. The current operation mode of the timepiece 2100 may be displayed by controlling the rotation of the rotating disk 2712 so that one of these notations is positioned in the window frame 2711.

The display window 2710, for example, is included in the display apparatus 2340 depicted in FIG. 20 and is controlled by the computing unit 2325 depicted in FIG. 20. For example, when the operation mode of the timepiece 2100 is the operation mode that displays a cardinal direction measurement result by the second hand 2123, the computing unit 2325 controls the motor driving circuit 2326 so that "S1" of the rotating disk 2712 is positioned in the window frame 2711.

Further, when the operation mode of the timepiece 2100 is the operation mode that displays a temperature measurement result by the second hand 2123, the computing unit 2325 controls the motor driving circuit 2326 so that "S2" of the rotating disk 2712 is positioned in the window frame 2711. Further, when the operation mode of the timepiece 2100 is the operation mode that displays an altitude measurement result by the second hand 2123, the computing unit 2325 controls the motor driving circuit 2326 so that "S3" of the rotating disk 2712 is positioned in the window frame 2711.

Further, as depicted in FIG. 24, in the display window 2710, the window frame 2711 has a color (for example, yellow) identical or similar to the color (for example, yellow) of the first push-button 2131. As a result, the user may easily know that the operation button for switching the operation mode of the timepiece 2100 displayed by the display window 2710 is the first push-button 2131 of the operation buttons 2130.

Nonetheless, a portion of the display window 2710 identical or similar in color to the first push-button 2131 is not limited to the window frame 271. For example, a color of notations such as "S1", "S2", "S3" on the rotating disk 2712 may be identical or similar to the color of the first push-button 2131. Alternatively, a color of a portion of the rotating disk 2712 other than a portion having a notation such as "S1", "S2", "S3" may be a color identical or similar to the color of the first push-button 2131. Alternatively, a color of multiple portions of these portions of the display window 2710 may be identical or similar to the color of the first push-button 2131.

As depicted in FIG. 24, the display unit that displays the operation mode of the timepiece 2100 is not limited to the display unit configured by the pointer 2140, etc. and, for example, may be a display unit realized by the display window 2710. Further, as described above, when the timepiece 2100 includes a display, the display window 2710 may be a virtual display window realized by an image displayed on the display.

Figure 25:
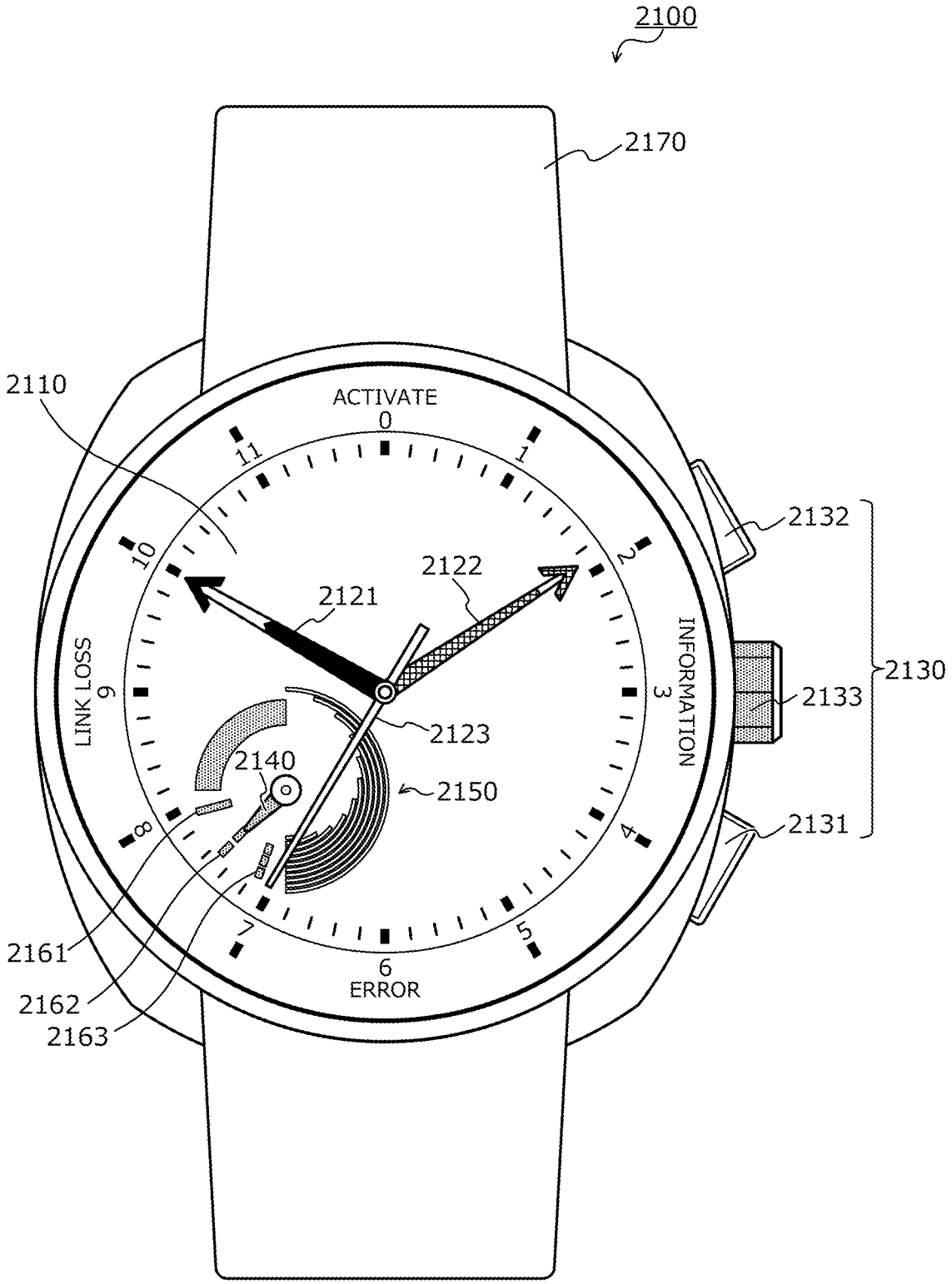
FIG. 25 is a diagram depicting another example of an operation button for switching the operation mode according to the third embodiment.

FIG. 25 is a diagram depicting another example of the operation button for switching the operation mode according to the third embodiment. In FIG. 25, parts identical to those depicted in FIG. 18 are given the same reference numerals used in FIG. 18 and description thereof is omitted hereinafter. While a configuration in which the first push-button 2131 is used as the operation button for switching the operation mode of the timepiece 2100 displayed by the pointer 2140 or the like is described, the operation button for switching the operation mode of the timepiece 2100 is not limited to the first push-button 2131.

For example, configuration may be such that the crown 2133 is used as the operation button for switching the operation mode of the timepiece 2100 displayed by the pointer 2140 or the like. In this case, with the crown 2133 as the first operation button, at least a part of a portion of the crown 2133, the portion visible to the user, has a color (for example, yellow) identical or similar to the color (for example, yellow) used for the display unit configured by the pointer 2140, etc. In the example depicted in FIG. 25, of the portion of the crown 2133 visible to the user, a portion excluding the tip is identical in color to the pointer 2140, the first mode mark 2161, the second mode mark 2162, and the third mode mark 2163.

Further, in this case, with the first push-button 2131 as the second operation button, the portion of the first push-button 2131 visible to the user, does not include a portion of a color (for example, yellow) identical or similar to the color (for example, yellow) used for the display unit configured by the pointer 2140, etc. As one example, the color of the first push-button 2131 may be black.

For example, in a state in which the crown 2133 is pulled out, each time the crown 2133 is rotated a predetermined amount, the operation mode of the timepiece 2100 is switched to an operation mode described above and the operation mode displayed by the pointer 2140 is also switched.

As depicted in FIG. 25, a configuration in which the crown 2133 is used as the operation button for switching the operation mode of the timepiece 2100 enables unintended switching of the operation mode of the timepiece 2100 by errant user operation to be suppressed.

Figure 26:
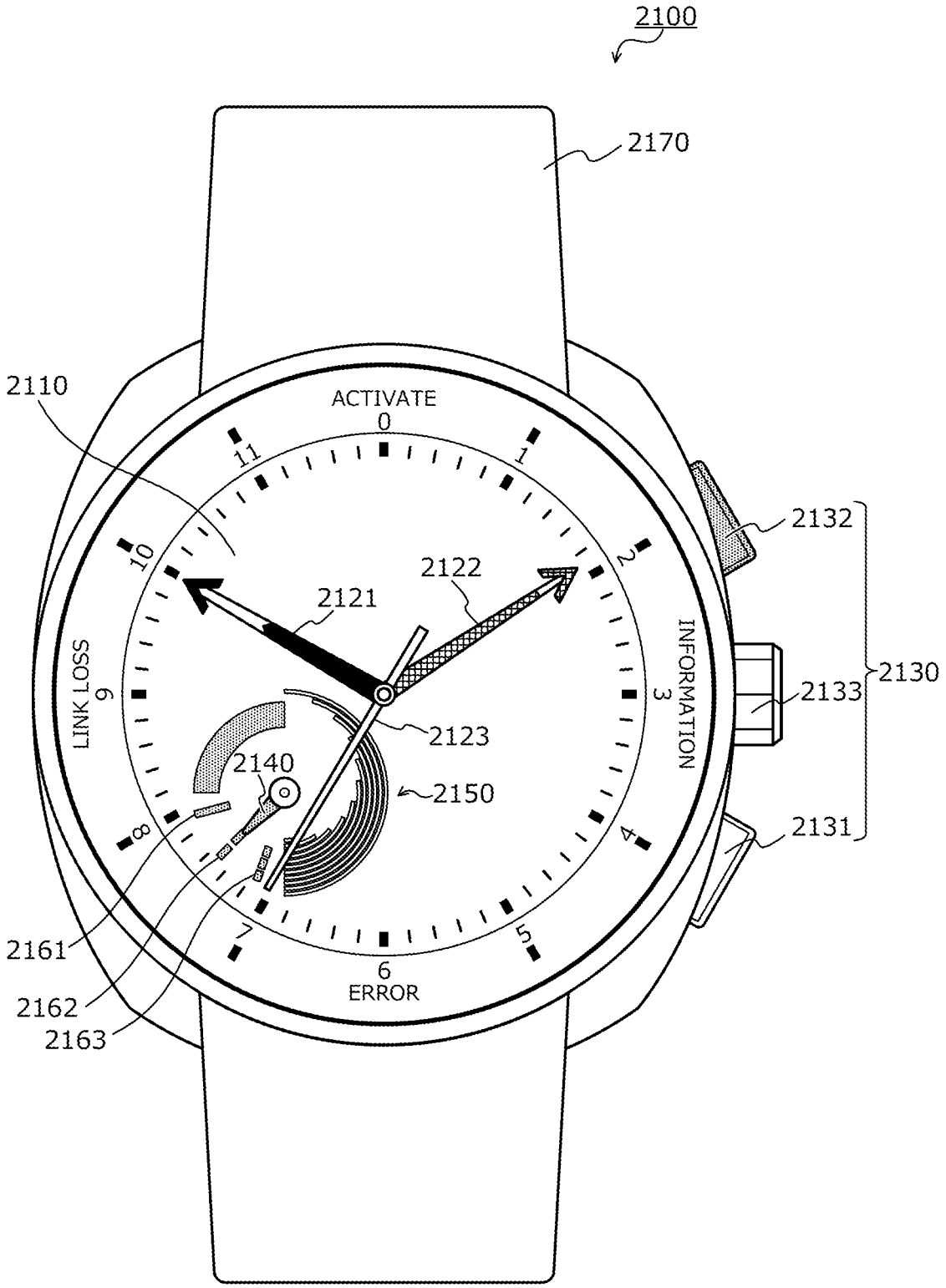
FIG. 26 is a diagram depicting another example of the operation button for switching the operation mode according to the third embodiment.

FIG. 26 is a diagram depicting another example of the operation button for switching the operation mode according to the third embodiment. In FIG. 26, parts identical to those depicted in FIG. 18 are given the same reference numerals used in FIG. 18 and description thereof is omitted hereinafter. In the example depicted in FIG. 26, the operation button for switching the operation mode displayed by the display unit configured by the pointer 2140, etc. is the second push-button 2132. In this case, with the second push-button 2132 as the first operation button, a color (for example, yellow) identical or similar to the color (for example, yellow) used for the display unit configured by the pointer 2140, etc. is used for the second push-button 2132 and not used for the first push-button 2131 that is the second operation button.

In other words, the operation button that switches the operation mode displayed by the display unit configured by the pointer 2140, etc. may be the second push-button 2132 that, of the operation buttons 2130, is farthest from the display unit. In this case as well, an identical color or similar colors are used for the display unit configured by the pointer 2140, etc. and the second push-button 2132, whereby the user may easily recognize a correspondence relationship between the display unit configured by the pointer 2140, etc. and the second push-button 2132. Therefore, the user may easily know that the operation button for switching the operation mode displayed by the display unit configured by the pointer 2140, etc. is the second push-button 2132.

Figure 27:
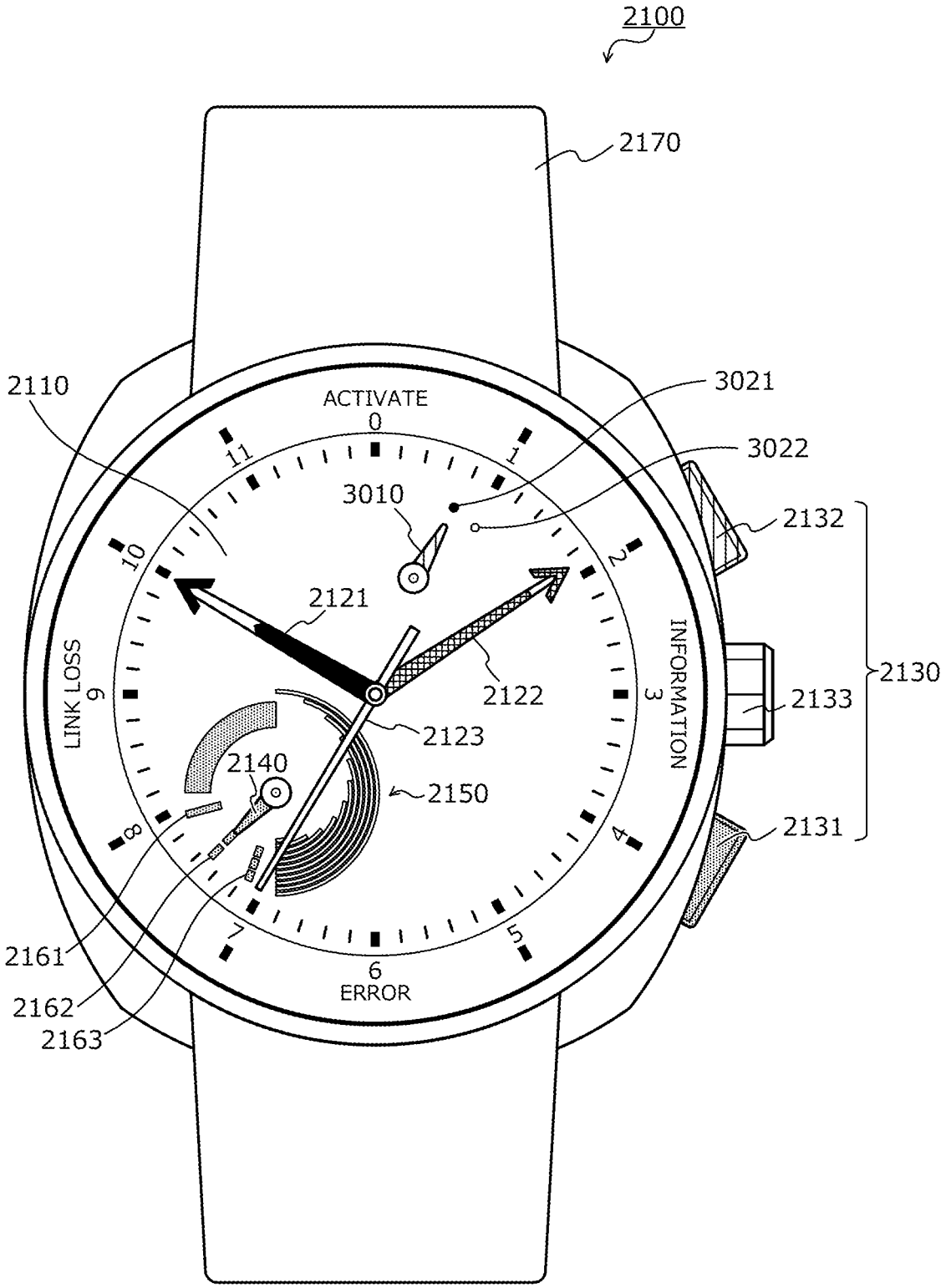
FIG. 27 is a diagram depicting an example of plural display units of the operation mode of the timepiece according to the third embodiment.

FIG. 27 is a diagram depicting an example of plural display units of the operation mode of the timepiece according to the third embodiment. In FIG. 27, parts identical to those depicted in FIG. 18 are given the same reference numerals used in FIG. 18 and description thereof is omitted hereinafter. As depicted in FIG. 27, in the configuration of the timepiece 2100 depicted in FIG. 18, a pointer 3010 may be further provided on the dial 2110, and a fourth mode mark 3021 and fifth mode mark 3022 may be shown on the dial 2110.

A driving unit (for example, the motor driving circuit 2326 and the drive mechanism 2330 depicted in FIG. 20) of the pointer 3010, the fourth mode mark 3021, the fifth mode mark 3022, and the pointer 3010 configure a display unit that displays the operation mode of the timepiece 2100 (second display unit) and that is other than the display unit configured by the pointer 2140, etc. described above. Hereinafter, this display unit may be called "display unit configured by the pointer 3010, etc." In this manner, the timepiece 2100 may include plural display units that display an operation mode.

The pointer 3010 points to a position of either the fourth mode mark 3021 or the fifth mode mark 3022 shown on the dial 2110, whereby the current operation mode related to a function of the timepiece 2100 different from the operation of the second hand 2123 is displayed. A function of the timepiece 2100 different from the operation of the second hand 2123, as one example, is the energy-saving function of the timepiece 2100 and operation modes related to this function, for example, are ON and OFF of the energy-saving function.

When the energy-saving function is ON, the timepiece 2100 switches to a state in which power consumption is low as compared to when the energy-saving function is OFF. Operation for which power consumption is low, for example, is a state in which movement of at least the hour hand 2121, the minute hand 2122 or the second hand 2123 (for example, the second hand 2123) is not performed, a state in which reception of radio waves for time measurement and/or positioning, etc. is not performed, a state in which communication with another communications device is not performed, etc.

For example, the fourth mode mark 3021 indicates that the energy-saving function is ON and the fifth mode mark 3022 indicates that the energy-saving function is OFF. When the of energy-saving function the timepiece 2100 is ON, the timepiece 2100 points to the fourth mode mark 3021 by the pointer 3010. Further, when the energy-saving function of the timepiece 2100 is OFF, the timepiece 2100 points to the fifth mode mark 3022 by the pointer 3010.

In this manner, the display unit configured by the pointer 3010, etc. displays a current operation mode of the timepiece, among the plural second operation modes (as one example, ON/OFF of the energy-saving function) that are mutually switchable and that are different from the operation mode displayed by the display unit configured by the pointer 2140, etc. described above.

The second push-button 2132 is an operation button (the second operation button) for switching the operation mode of the timepiece 210 displayed by the display unit configured by the pointer 3010, etc. When a user operation is received by the second push-button 2132, the timepiece 2100 performs control of switching the operation mode displayed by the display unit configured by the pointer 3010, etc. For example, each time the second push-button 2132 is pressed (pushed) by the user, the timepiece 2100 switches the energy-saving function described above ON or OFF and accordingly, also switches the operation mode (ON or OFF) displayed by the pointer 3010.

In the display unit configured by the pointer 3010, etc., a portion visible to the user of the timepiece 2100 does not include a color identical or similar to a color (first color) described above and used in the display unit configured by the pointer 2140, etc. Further, in the display unit configured by the pointer 3010, etc., at least a part of the portion visible to the user of the timepiece 2100 has a color (second color) that is not identical or similar to a color (first color) used in the display unit configured by the pointer 2140, etc. For example, of the pointer 3010, a portion visible to the user of the timepiece 2100 is green.

Of the second push-button 2132, a portion visible to the user of the timepiece 2100, as described above, does not include a color identical or similar to a color (first color) used in the display unit configured by the pointer 2140, etc. Further, of the second push-button 2132, at least a part of the portion visible to the user of the timepiece 2100 has a color identical or similar to a color (second color) used in the display unit configured by the pointer 3010, etc. For example, as described above the dial 2110 is black overall and the color of the pointer 3010 is green. In this case, the second push-button 2132 may also be green.

Further, the first push-button 2131 and the crown 2133 that are other operation buttons included among the operation buttons 2130 are not identical or similar in color to the second push-button 2132. As one example, as described above, the color of the first push-button 2131 is yellow and the color of the crown 2133 is black. As a result, the user may easily recognize that the operation button for switching the operation mode (ON or OFF of the energy-saving function) of the timepiece 2100 displayed by the display unit configured by the pointer 3010, etc. is the second push-button 2132 among the operation buttons 2130.

The operation mode displayed by the display unit configured by the pointer 3010, etc. is not limited to the energy-saving function and may be any of a variety of types of functions of the timepiece 2100. For example, the operation mode displayed by the display unit configured by the pointer 3010, etc. may be ON or OFF of a function of automatically correcting the internal time by the timepiece 2100 receiving a reference radio wave or the like. Alternatively, the operation mode displayed by the display unit configured by the pointer 3010, etc. may be an operation mode related to a time zone or daylight-savings time described above.

In this manner, in the timepiece according to the third embodiment, a color identical or similar to a predetermined color of the display unit that displays the current operation mode of the timepiece among the plural operation modes that are mutually switchable is included in the first operation button that is for switching the operation mode and not included in the second operation button that is different from the first operation button. Therefore, according to the timepiece according to the third embodiment, the user may easily recognize that the operation button for switching the operation mode displayed by the display unit is the first operation button and not the second operation button.

Further, according to the timepiece according to the third embodiment, for example, increases in the size of the timepiece for securing space necessary for notations such as character strings and degradation of the quality of the external appearance of the timepiece due to the notations such as character strings may be avoided as compared to a configuration in which character strings or the like are shown describing which operation button near the display unit for the operation mode is for switching the operation mode.

Further, according to the timepiece according to the third embodiment, for example, as compared to a configuration in which only the operation button for switching the operation mode is disposed near the display unit for the operation mode, an identical color or similar colors are used for the display unit and corresponding operation button, whereby the user may easily recognize the correspondence relationship between the operation button and the display unit.

Further, according to the timepiece according to the third embodiment, the operation button for switching the operation mode is not limited to disposal near the display unit for the operation mode and therefore, degrees of freedom in the layout of components in the timepiece may be enhanced. Therefore, for example, increases in the size of the timepiece and degradation of the quality of the external appearance of the timepiece due to the layout of the components in the timepiece being complicated may be avoided.

As described above, according to the timepiece according to the third embodiment, decreases in the ease of viewing information may be suppressed. In particular, for example, increases in the size of the timepiece and degradation of the quality of the external appearance of the timepiece may be avoided, and the user may easily recognize the operation button for switching the operation mode of the timepiece.

Parts having identical specifications may be used in the drive mechanism of the first pointer and in the drive mechanism of the second pointer. The user may easily distinguish the first pointer and the second pointer.

The user may visually confirm a measured physical quantity easily by counting arcs by moving the line of sight along a constant direction in which the pointer points.

The user may easily recognize that the operation button for switching the operation mode displayed by display unit is the first operation button and not the second operation button.

According to one aspect of the invention, an effect is achieved in that decreases in the ease of viewing information may be suppressed.

In this manner, the timepiece according to the present invention, for example, is useful for timepieces having a first pointer and a second pointer that have a common rotation axis and that are for displaying different types of information, respectively. The timepiece according to the present invention is particular suitable for timepieces that have an hour hand and a minute hand.

Further, the timepiece according to the present invention, for example, is useful for clocks that measure and display physical quantities of various types and is particularly suitable for timepieces that measure and display the remaining battery level.

Further, the timepiece according to the present invention, for example, is useful for timepieces in which the operation mode may be switched and is particularly suitable for timepieces that have plural operation buttons that are operated by the user.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A timepiece comprising:

a first pointer that rotates around a rotation axis;

a second pointer that rotates around the rotation axis independently of the first pointer and has a moment of inertia that is a same as a moment of inertia of the first pointer, the second pointer having a color scheme that is different from a color scheme of the first pointer; and a controller that displays first information by controlling rotation of the first pointer and displays second information different from the first information, by controlling rotation of the second pointer.

2. The timepiece according to claim 1, wherein in the first pointer, an hour hand that is shorter than the first pointer is drawn, in the second pointer, a minute hand that is shorter than the second pointer and longer than the hour hand is drawn, and the controller displays an hour of a current time by controlling the rotation of the first pointer and displays a minute of the current time by controlling the rotation of the second pointer.

3. The timepiece according to claim 2, wherein the hour hand and the minute hand are drawn in respectively different colors.

4. The timepiece according to claim 2, wherein a first pointing portion for displaying third information that is other than a time is provided at a tip of the first pointer, a second pointing portion for displaying fourth information that is other than the time and different from the third information is provided at a tip of the second pointer, and the controller, in a first state, displays the hour of the current time by controlling the rotation of the first pointer and displays the minute of the time by controlling the rotation of the second pointer, and while in a second state different from the first state, displays the third information by controlling the rotation of the first pointer and displays the fourth information by controlling the rotation of the second pointer.

5. The timepiece according to claim 2, wherein the first pointer and the second pointer rotate on a display face, in the first pointer, a color of at least a part of a region in which the hour hand is not drawn is a color that is a same as a color of the display face, and in the second pointer, a color of at least a part of a region in which the minute hand is not drawn is a color that is a same as the color of the display face.

6. The timepiece according to claim 1, wherein a length of the first pointer is a same as a length of the second pointer.

7. The timepiece according to claim 1, wherein a shape of the first pointer is a same as a shape of the second pointer.

8. The timepiece according to claim 1, further comprising:

a first motor that is controlled by the controller;

a first wheel train that transmits the rotation of the first motor to the first pointer;

a second motor that is controlled by the controller, a specification of the second motor is a same as a specification of the first motor; and a second wheel train that transmits the rotation of the second motor to the second pointer, a specification of the second wheel train is a same as a specification of the first wheel train.

9. The timepiece according to claim 1, further comprising:

a third pointer that changes pointing directions by rotation and different from the first pointer and the second pointer;

a display face that displays a plurality of arcs respectively included in a plurality of circles having radii that mutually differ and centers that coincide with a rotation center of the third pointer, of the plurality of arcs, a number of arcs present in the pointing direction of the third pointer as viewed from the rotation center of the third pointer differs according to the pointing direction of the third pointer;

a measuring unit that measures a predetermined physical quantity; and a controller that controls the rotation of the third pointer so that, of the plurality of arcs, the number of arcs present in the point direction of the third pointer as viewed from the rotation center of the third pointer is a number corresponding to the physical quantity measured by the measuring unit.

10. The timepiece according to claim 9, wherein the plurality of arcs are arcs obtained by rotating at mutually differing rotation angles in a same direction around the rotation center of the third pointer, points that are on the plurality of circles and positioned along a single direction as viewed from the rotation center of the third pointer.

11. The timepiece according to claim 10, wherein arcs of the plurality of arcs are relatively shorter with increasing proximity of the arcs to the rotation center of the third pointer.

12. The timepiece according to claim 10, wherein the display face displays lines that extend toward the rotation center of the third pointer from first ends of the plurality of arcs, opposite second ends of the plurality of arcs, the second ends positioned along the single direction as viewed from the rotation center of the third pointer.

13. The timepiece according to claim 9, wherein a tip of the third pointer in pointing direction has a width that is less than a smallest difference in length between the plurality of arcs.

14. The timepiece according to claim 9, wherein a portion of the third pointer is visible to a user and has a color that is different from a color of the plurality of arcs.

15. The timepiece according to claim 1, further comprising:

a display unit that, of a plurality of operation modes that are mutually switchable, displays a current operation mode of the timepiece and has a portion visible to a user, a color of at least a part of the portion visible to the user is a predetermined color;

a first operation button that receives a user operation and has a portion visible to the user, a color of at least a part of the portion visible to the user is identical or similar to the predetermined color;

a second operation button that receives a user operation and different from the first operation button, the second operation button being free of a portion having a color identical or similar to the predetermined color; and a controller that controls switching of an operation mode of the timepiece among the plurality of operation modes when the user operation is received by the first operation button and that performs an operation different from control when the user operation is received by the second operation button.

16. The timepiece according to claim 15, wherein the display unit includes a display face that includes notations representing the plurality of operation modes, and a third pointer that points to a notation that, of the notations on the display face, represents the current operation mode of the timepiece, the third pointer being different from the first pointer and the second pointer, at least a part of a portion of the notations or a part of a portion of the third pointer visible to the user has a color that is the predetermined color.

17. The timepiece according to claim 15, wherein the display unit is provided on a display face of a color not identical and not similar to the predetermined color.

18. The timepiece according to claim 15, wherein the first operation button is a crown.

19. The timepiece according to claim 15, wherein the first operation button is an operation button that is provided positioned nearest the display unit, among operation buttons of the timepiece receiving a user operation.

20. The timepiece according to claim 15, wherein the timepiece is free of an operation button that is different from the first operation button, that receives a user operation, and that has in at least a part of a portion visible to the user, a color identical or similar to the predetermined color.

* * * * *